US007669844B2

(12) United States Patent
Ohgita et al.

(10) Patent No.: US 7,669,844 B2
(45) Date of Patent: Mar. 2, 2010

(54) PAPER FEEDER

(75) Inventors: Toshiki Ohgita, Shiki-gun (JP); Jinichi Nagata, Joto-ku (JP); Naofumi Okada, Tenri (JP); Kouzou Yamaguchi, Kashihara (JP); Hideo Yoshikawa, Yamatokoriyama (JP); Yasuhiro Takai, Sakurai (JP); Syouichirou Yoshiura, Ikoma-gun (JP); Tsutomu Yoshimoto, Yamatokakada (JP)

(73) Assignee: Sharp Kabushiki Kaisha, Osaka-shi, Osaka (JP)

( * ) Notice: Subject to any disclaimer, the term of this patent is extended or adjusted under 35 U.S.C. 154(b) by 1211 days.

(21) Appl. No.: 11/114,081

(22) Filed: Apr. 26, 2005

(65) Prior Publication Data

US 2005/0236758 A1 Oct. 27, 2005

(30) Foreign Application Priority Data

| | | |
|---|---|---|
| Apr. 26, 2004 | (JP) | 2004-129608 |
| May 26, 2004 | (JP) | 2004-156503 |
| Jun. 7, 2004 | (JP) | 2004-168356 |
| Jun. 14, 2004 | (JP) | 2004-176048 |
| Jun. 14, 2004 | (JP) | 2004-176049 |
| Jun. 14, 2004 | (JP) | 2004-176050 |
| Jun. 28, 2004 | (JP) | 2004-189944 |
| Jun. 28, 2004 | (JP) | 2004-189945 |

(51) Int. Cl.
*B65H 3/44* (2006.01)

(52) U.S. Cl. ..... 271/9.01; 271/9.12; 271/9.13; 271/264; 271/9.06; 271/258.02; 271/10.02

(58) Field of Classification Search ..... 271/9.01, 271/9.12, 9.13, 162, 264, 258.01, 258.02, 271/9.06, 10.02, 10.01; 400/578, 582, 624, 400/625, 629, 642; 399/388, 391, 393; 270/58.14, 270/58.18, 58.19, 58.23, 58.29
See application file for complete search history.

(56) References Cited

U.S. PATENT DOCUMENTS

| | | | | |
|---|---|---|---|---|
| 5,433,425 | A * | 7/1995 | Kubota et al. | 271/9.12 |
| 5,472,183 | A * | 12/1995 | Kubo | 271/9.03 |
| 5,710,968 | A * | 1/1998 | Clark et al. | 399/382 |

(Continued)

FOREIGN PATENT DOCUMENTS

JP H05-193766 A 8/1993

(Continued)

*Primary Examiner*—Patrick H Mackey
*Assistant Examiner*—Prasad V Gokhale
(74) *Attorney, Agent, or Firm*—Birch, Stewart, Kolasch & Birch, LLP

(57) ABSTRACT

A paper feeder includes a storage section, a feed path, a delivery section, and a receiving section. The storage section is configured to store therein plural sheet members to be fed to a processing apparatus which is operative to perform processing on the sheet members. The feed path allows each of the plural sheet members fed from the storage section to pass therethrough in a feed direction toward the processing apparatus. The delivery section is located most downstream on the feed path in the feed direction. The feed path is open to exterior in the delivery section. The receiving section is located upstream of the feed path in the feed direction for communication with a delivery section of a separate paper feeder having an identical construction with the present paper feeder when the separate paper feeder is disposed upstream of the present paper feeder in the feed direction.

18 Claims, 36 Drawing Sheets

U.S. PATENT DOCUMENTS

| | | | | |
|---|---|---|---|---|
| 6,039,314 | A * | 3/2000 | Miller et al. | 271/9.01 |
| 6,206,360 | B1 * | 3/2001 | Urata et al. | 271/9.06 |
| 6,663,099 | B2 * | 12/2003 | Inoue | 271/162 |
| 6,695,303 | B2 * | 2/2004 | Okada et al. | 271/9.12 |
| 6,782,236 | B2 * | 8/2004 | Sasaki et al. | 399/401 |
| 7,063,317 | B2 * | 6/2006 | Sato et al. | 271/225 |
| 2001/0017441 | A1 * | 8/2001 | Yamaguchi et al. | 271/94 |
| 2004/0021262 | A1 * | 2/2004 | Yen et al. | 271/10.11 |
| 2005/0062222 | A1 * | 3/2005 | Willis | 271/272 |
| 2005/0082737 | A1 * | 4/2005 | Sasaki et al. | 271/9.12 |

FOREIGN PATENT DOCUMENTS

| | | | |
|---|---|---|---|
| JP | H06-135640 | A | 5/1994 |
| JP | 06-345290 | A | 12/1994 |
| JP | 08-231067 | A | 9/1996 |
| JP | 2003-095455 | A | 4/2003 |

* cited by examiner

PAPER FEEDER

CROSS REFERENCE

This Nonprovisional application claims priority under 35 U.S.C. § 119(a) on Japanese Patent Application Nos. 2004-129608 filed on Apr. 26, 2004; 2004-156503 filed on May 26, 2004; 2004-168356 filed on Jun. 7, 2004; 2004-176048, 2004-176049, and 2004-176050, filed on Jun. 14, 2004; and 2004-189944 and 2004-189945 filed on Jun. 28, 2004, the entire contents of which are hereby incorporated by reference.

BACKGROUND OF THE INVENTION

1. Field of the Invention

The present invention relates to a paper feeder configured to store in a storage section thereof a plurality of sheet members to be feed to a processing apparatus configured to perform processing on such sheet members, the paper feeder having a feed path for transporting the sheet members from the storage section to the processing apparatus.

2. Description of the Related Art

An image forming apparatus is one example of a processing apparatus configured to perform processing on sheet members, such as recording sheets, fed from a paper feeder. In recent years, such image forming apparatus have progressed toward increases in multifunction capability and in printing speed. For example, an image forming apparatus has been developed which has plural processing modes including a copier mode, printer mode and FAX mode and exhibits a printing speed of one or more sheets per second. Such a high-speed image forming apparatus calls for a paper feeder capable of feeding a large number of recording sheets. The necessity of such a paper feeder becomes high particularly when the image forming apparatus operates in such a mode as the printer mode or FAX mode which does not necessarily need the presence of the user near the apparatus.

In the FAX mode, in particular, a large-capacity paper feeder is indispensable. This is because where the image forming apparatus accumulates in its memory a large quantity of information received in the absence of the user, for example, during nighttime without performing printing for avoiding running out of recording sheet, the memory of the image forming apparatus is required to have a large capacity and a time loss will occur in later printing of the information accumulated in the memory.

However, even such a large-capacity paper feeder cannot store an unlimited number of recording sheets. Generally, the upper limit of a storable number of recording sheets ranges from about 2,000 to about 4,000. This is because the load to be imposed on the lift-up mechanism increases with increasing number of recording sheets to be stored and, when the number of recording sheets becomes excessive, the lift-up mechanism needs to be made more solid, which will result in increases in the size of the paper feeder and in cost while making it difficult to adjust the height of a stack of recording sheets precisely. The lift-up mechanism is configured to lift up such a recording sheet stack in order to keep the height position of the topmost sheet of the stack held in the paper feeder within a predetermined range, whenever necessary.

In view of this situation, a large-capacity paper feeder to be disposed adjacent to such an image forming apparatus separately from the paper feeder section provided within the image forming apparatus is under development. For example, Japanese Patent Laid-Open Publication No. HEI 5-193766 discloses a paper feeder having plural sheet storage sections vertically arranged in tier for storing an increased number of recording sheets. Each recording sheet fed from this paper feeder is taken into the image forming apparatus through a sheet feed inlet which is continuous with sheet feed path defined in the image forming apparatus. The sheet feed inlet of the image forming apparatus is positioned so as to be continuous with the sheet feed path.

Since the sheet feed inlet of the image forming apparatus is thus positioned so as to be continuous with the sheet feed path for communication, a sheet storage section of the conventional paper feeder which is positioned at a height different from that of the sheet feed inlet defines a bent or curved sheet feed path between the sheet storage section and the sheet feed inlet. For this reason, each recording sheet being fed within the paper feeder is likely to curve due to increasing possibility of folding or bending, which will incur the occurrence of jam during feeding and degradation in print quality.

A feature of the present invention is to provide a paper feeder which is capable of feeding a large number of sheet members such as recording sheets while preventing such sheet members from curving, hence, from jamming during feeding.

SUMMARY OF THE INVENTION

According to the present invention, a paper feeder includes a storage section, a feed path, a delivery section, and a receiving section.

The storage section is configured to store therein plural sheet members to be fed to a processing apparatus which is operative to perform processing on the sheet members.

The feed path allows each of the plural sheet members fed from the storage section to pass therethrough in a feed direction toward the processing apparatus.

The delivery section is located most downstream on the feed path in the feed direction. The feed path is open to exterior in the delivery section.

The receiving section is located upstream of the feed path in the feed direction for communication with a delivery section of a separate paper feeder having an identical construction with the present paper feeder when the separate paper feeder is disposed upstream of the present paper feeder in the feed direction.

The foregoing and other features and attendant advantages of the present invention will become more apparent from the reading of the following detailed description of the invention in conjunction with the accompanying drawings.

DETAILED DESCRIPTION OF THE PREFERRED EMBODIMENTS

Hereinafter, embodiments of the present invention will be described in detail with reference to the accompanying drawings.

Figure 1:
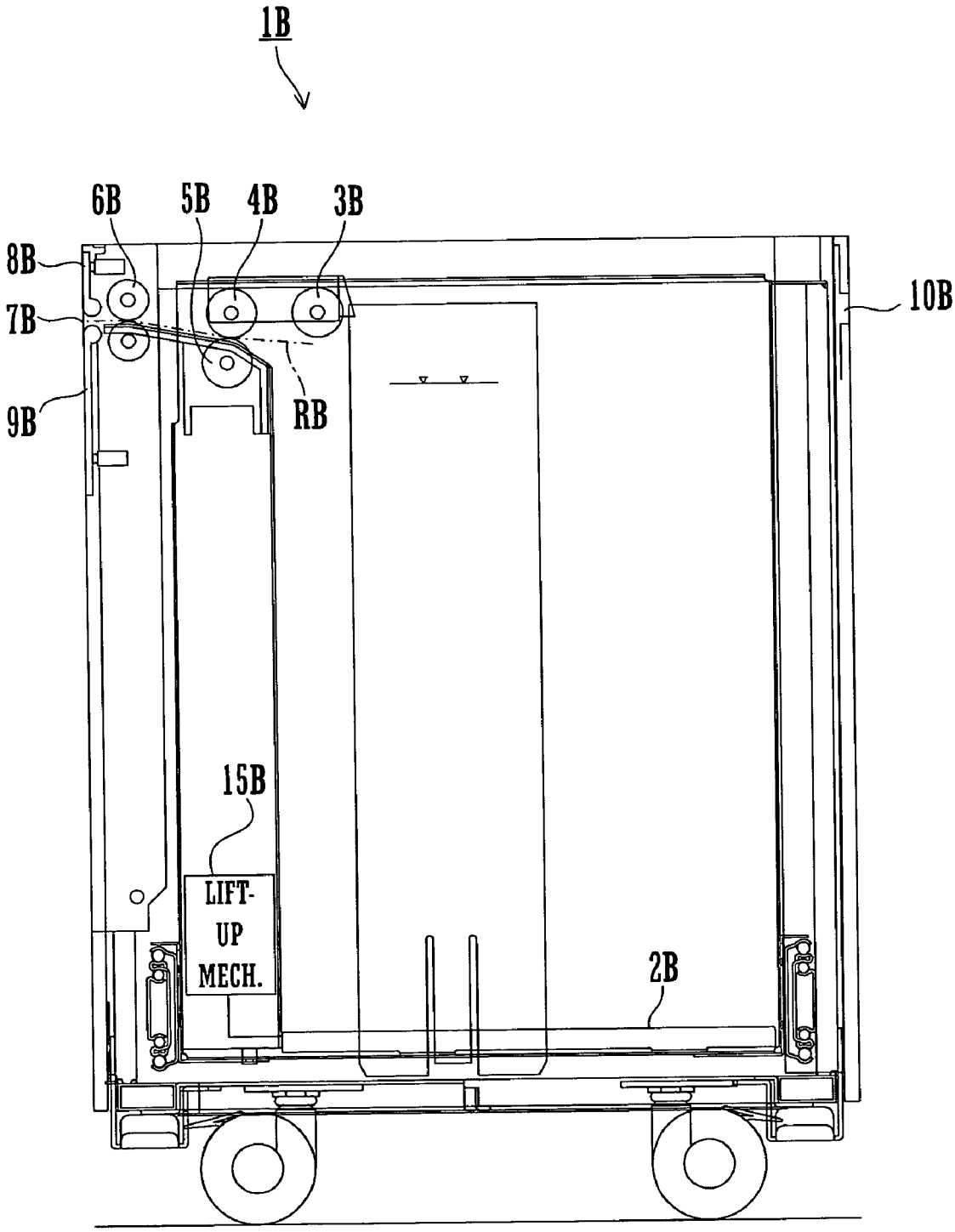
FIG. 1 is a sectional view showing a paper feeder 1A according to a first embodiment of the present invention.

Referring initially to FIG. 1, a paper feeder 1B according to a first embodiment of the present invention includes a sheet carrier plate 2B, a lift-up mechanism 15B, a pickup roller 3B, a feed roller 4B, a reverse roller 5B, a transport roller 6B, a delivery section 7B, paper guides 8B and 9B, and a receiving section 10B.

A stack of recording sheets (the sheet members defined by the present invention) to be fed to an image forming apparatus 100 is stored as positioned on the sheet carrier plate 2B, which corresponds to the storage section defined by the present invention. The image forming apparatus 100 corresponds to the processing apparatus of the invention. The paper feeder 1B is configured to be capable of storing a large number of recording sheets on the sheet carrier plate 2B. The lift-up mechanism displaces the sheet carrier plate 2B vertically so that the upper surface of topmost recording sheet SB of the sheet stack placed on the sheet carrier plate 2B is kept at a predetermined height position.

The pickup roller 3B, which corresponds to the pickup member defined by the present invention, is vertically displaceable. In the feeding operation the pickup roller 3B descends to pick up the topmost recording sheet SB of the recording sheets placed on the sheet carrier plate 2B. The feed roller 4B and the reverse roller 5B are disposed to face each other at a location downstream of the pickup roller 3B in the sheet feed direction. The feed roller 4B rotates in the same direction as the pickup roller 3B, while the reverse roller 5B rotates reversely of the direction in which the feed roller 4B rotates. Recording sheets picked up by the pickup roller 3B are separated by the feed roller 4B and the reverse roller 5B from each other and then fed one by one onto a sheet feed path RB.

The transport roller 6B, which corresponds to the transport member defined by the present invention, is disposed at a location downstream of the combination of feed roller 4B and reverse roller 5B in the sheet feed direction. The delivery section 7B provided on the sheet feed path RB at a location downstream of the transport roller 6B is open to the exterior of the paper feeder 1B. The recording sheets SB picked up by the pickup roller 3B and then separated by the combination of feed roller 4B and reverse roller 5B from each other are delivered exteriorly of the paper feeder 1B by the transport roller 6B through the delivery section 7B.

The paper guides 8B and 9B, which correspond to the guide members defined by the present invention, are disposed in the delivery section 7B. The paper guides 8B and 9B are each supported to pivot between a collapsed position parallel with a sidewall of the paper feeder 1B and a use position in which the paper guide is supported horizontally. In the use position the paper guides 8B and 9B determine the delivery direction in which each recording sheet is delivered from the delivery section 7B.

The receiving section 10B is located upstream of the sheet feed path RB. The receiving section 10B is formed at a lateral side of the paper feeder 1B opposite to the side on which the delivery section 7B is formed. The receiving section 10B and the delivery section 7B are on substantially the same level of height. The receiving section 10B is open to the exterior of the paper feeder 1B for taking each recording sheet fed from the exterior of the paper feeder 1B into the paper feeder 1B. The receiving section 10B is configured to be capable of being continuous with the delivery section 7B of another paper feeder with identical construction disposed upstream of the feeder 1B in the sheet feed direction.

Figure 2:
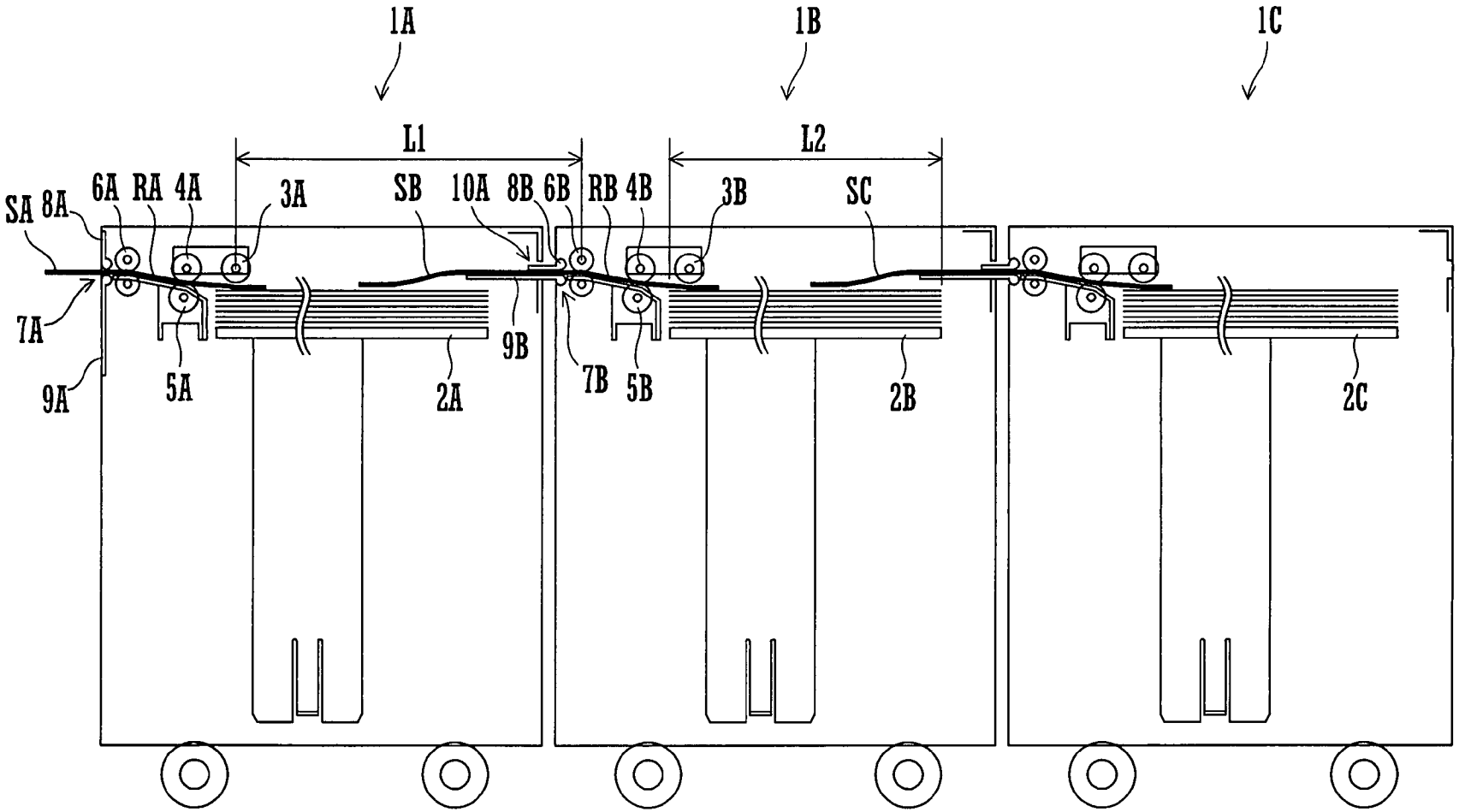
FIG. 2 is a view showing a state where a plurality of such paper feeders are arranged in a row.

FIG. 2 shows three paper feeders 1A, 1B and 1C arranged in a row along the sheet feed direction in which each recording sheet is to be fed. Each of the paper feeders 1A and 1C is of the same construction as the paper feeder 1B. The paper feeder 1C located upstream of the paper feeder 1B in the sheet feed direction corresponds to the first separate paper feeder defined by the present invention, while the paper feeder 1A located downstream of the paper feeder 1B in the sheet feed direction corresponds to the second separate paper feeder defined by the present invention.

The paper feeder 1B serves as the first separate paper feeder of the present invention with respect to the paper feeder 1A and as the second separate paper feeder with respect to the paper feeder 1C.

Each recording sheet is transported from right to left in FIG. 2. The following description is directed to the relation between the paper feeder 1A and the paper feeder 1B, which is the same as the relation between the paper feeder 1B and the paper feeder 1C.

The paper feeders 1A and 1B are arranged side by side so that the receiving section 10A of the paper feeder 1A located downstream in the sheet feed direction faces the delivery section 7B of the paper feeder 1B located upstream in the sheet feed direction. The pair of paper guides 8B and 9B and the pair of paper guides 8C and 9C of respective of the paper feeders 1B and 1C other than the paper feeder 1A are in their use positions and are inserted into the receiving sections 10A and 10B, respectively, of the paper feeders 1A and 1B each located downstream of a respective one of the paper feeders 1B and 1C in the sheet feed direction.

The paper guide 9B of the paper feeder 1B to face the underside of each recording sheet is sized so as to be capable of guiding recording sheet SB onto the upper surface of topmost recording sheet SA of a stack of recording sheets placed on the sheet carrier plate 2A of the paper feeder 1A when the paper guide 9B is inserted into the adjacent paper feeder 1A located downstream of the paper feeder 1B in the sheet feed direction. When the paper guides 8B and 9B of the paper feeder 1B are inserted into the receiving section 10A of the paper feeder 1A, the sheet feed path RB of the paper feeder 1B and the sheet feed path RA of the downstream paper feeder 1A become continuous with each other so as to communicate with each other.

The pickup roller 3A and the transport roller 6B are positioned so that the downstream edge of recording sheet SB being transported reaches the location of the pickup roller 3A of the paper feeder 1A before the upstream edge thereof passes the location of the transport roller 6B of the paper feeder 1B. Specifically, distance L1 between the pickup roller 3A of the paper feeder 1A and the transport roller 6B of the upstream paper feeder 1B is set shorter than dimension L2 of recording sheet SB parallel with the sheet feed direction.

More specifically, the pickup roller 3A is positioned to pick up each recording sheet on the sheet carrier plate 2 at a location spaced 50-60 mm upstream from the downstream edge thereof. Accordingly, while recording sheet SB is gripped and transported by the transport roller 6B of the paper feeder 1B, the recording sheet SB is also gripped, picked up, and transported by the pickup roller 3A of the paper feeder 1A. Therefore, even when recording sheet SB is fed through the plural paper feeders 1A and 1B, the feeding force is constantly exerted on recording sheet SB without break, thus preventing the occurrence of jam during feeding.

Recording sheet SB fed from the paper feeder 1B and then received by the receiving section 10A is fed as guided by the upper surface of topmost recording sheet SA of the stack of recording sheets on the sheet carrier plate 2A. That is, the upper surface of the topmost recording sheet SA forms part of the sheet feed path RA.

Recording sheet SB moved on the upper surface of recording sheet SA located within the paper feeder 1A by the driving force of the transport roller 6B of the paper feeder 1B is gripped at its downstream edge portion by the pickup roller 3A of the paper feeder 1A configured to descend with predetermined timing while being gripped by the transport roller 6B of the paper feeder 1B. Subsequently, recording sheet SB is further fed by the pickup roller 3A of the paper feeder 1A and then continuously fed downstream in the sheet feed direction by the transport roller 6A of the paper feeder 1A.

Thus, each recording sheet stored in the paper feeder 1B is transported to the image forming apparatus 100 through the feed path RB of the paper feeder 1B and then the feed path RA of the paper feeder 1A. That is, the feed path RA of the paper feeder 1A is used to feed recording sheets stored in the paper feeder 1A as well as recording sheets stored in the paper feeders 1B and 1C.

Figure 3:
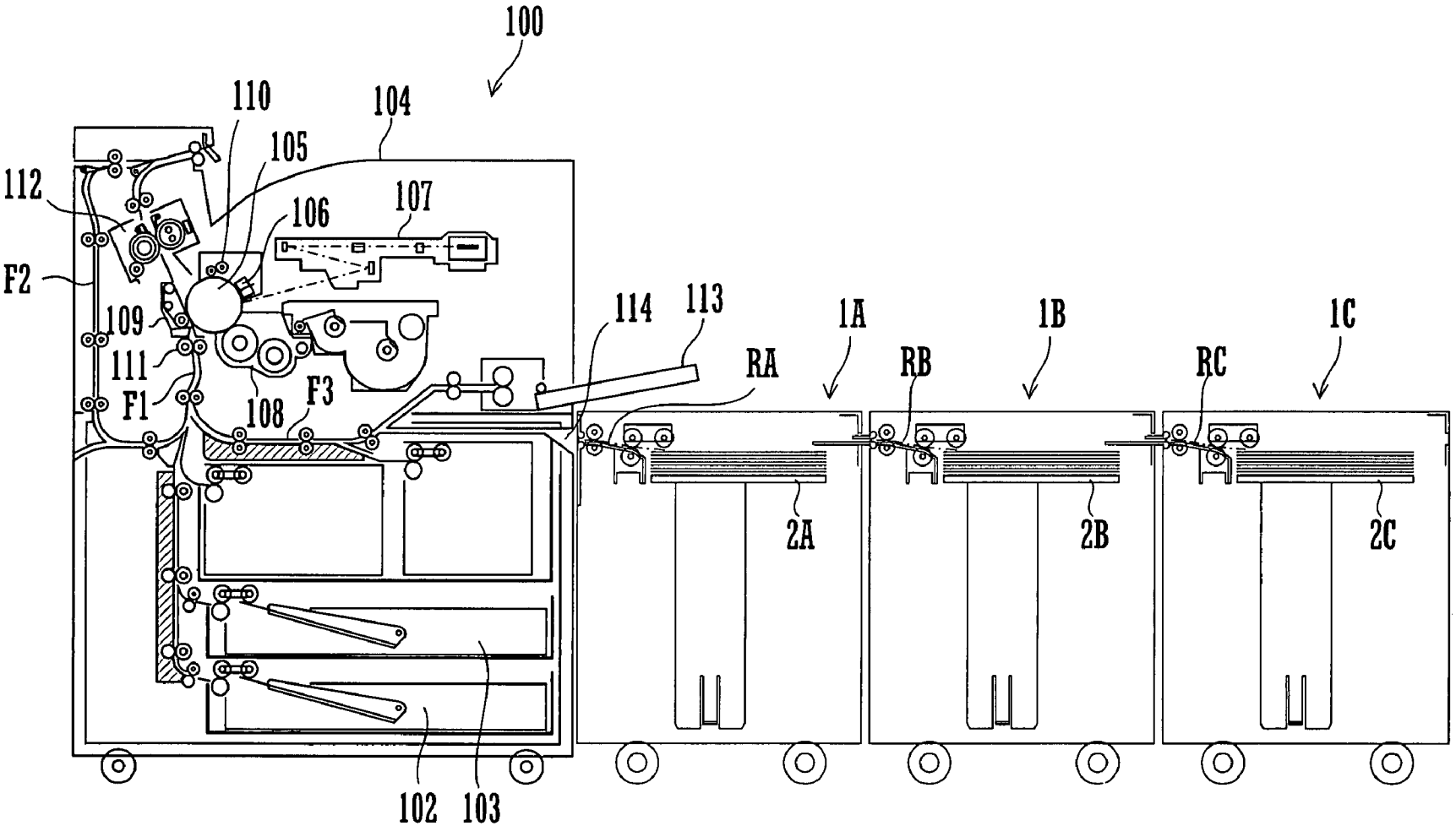
FIG. 3 is a view showing one example of a state where the plurality of paper feeders are used.

As shown in FIG. 3, the paper feeders 1A, 1B and 1C are arranged in a row laterally of the image forming apparatus 100. The number of such paper feeders can be varied in accordance with the number of recording sheets required by the image forming apparatus 100. Since the paper feeders 1A, 1B and 1C have the same construction, there is no limitation on the sequence of their arrangement.

The image forming apparatus 100 according to this embodiment performs image formation on each recording sheet through electrophotographic image forming process. The image forming apparatus 100 includes sheet feed cassettes 102 and 103 in a bottom portion thereof and an ejected sheet tray 104 in an upper portion thereof.

A sheet transport path F1 is defined between the ejected sheet tray 104 and the sheet feed cassettes 102 and 103. A photosensitive drum 105 is disposed adjacent the sheet transport path F1. Around the photosensitive drum 105 are disposed a static charger 106, an optical scanning unit 107, a developing unit 108, a transfer device 109, a cleaning unit 110, and a static eliminator not shown.

A registration roller 111 for adjustment of the timing with which each recording sheet is fed to a transfer position between the photosensitive drum 105 and the transfer device 109 is disposed upstream of the photosensitive drum 105 in the sheet feed direction. A fixing device 112 is disposed downstream of the photosensitive drum 105.

The static charger 106 charges the outer periphery of the photosensitive drum 105 to a predetermined potential. The optical scanning unit 107 forms an electrostatic latent image on the outer periphery of the photosensitive drum 105 according to image data inputted from the exterior. The developing unit 108 feeds toner to the outer periphery of the photosensitive drum 105 to turn the electrostatic latent image into a visible toner image.

The toner image formed on the photosensitive drum 105 is transferred to a recording sheet by the transfer device 109 and then fixed thereto by the fixing device 112. The recording sheet having the toner image fixed thereon is ejected onto the ejected sheet tray 104. The cleaning unit 110 collects residual toner which remains on the outer periphery of the photosensitive drum 105 after the transfer of the toner image to the recording sheet. The static eliminator eliminates electrostatic charge from the outer periphery of the photosensitive drum 105.

The image forming apparatus 100 has a switchback path F2 for transporting a recording sheet bearing an image formed on one side thereof in an upside-down condition in order for the reverse side of the recording sheet to be formed with an image.

The image forming apparatus 100 further has a sheet transport path F3 which joins the sheet transport path F1 at a location intermediate the transfer position and the sheet feed cassettes 102 and 103. The sheet transport path F3 extends substantially horizontally. The sheet transport path F3 extends to a manual feed tray 113 which is provided on a lateral part of the image forming apparatus 100 and to a sheet receiving section 114 which is configured to receive each recording sheet fed from an external device in order to transport each recording sheet fed from the manual feed tray 113 or the sheet receiving section 114 to the transfer position.

The paper feeder 1A is disposed adjacent to the image forming apparatus 100 so that the delivery section 7A thereof faces the sheet receiving section 114 of the image forming apparatus 100. Each recording sheet stored in the paper feeder 1A, 1B or 1C are fed to the sheet transport path F3 through the sheet receiving section 114 of the image forming apparatus 100 and then transported to the transfer position. Each of recording sheets stored in the paper feeder 1C for example is passed through the feed path RC of the paper feeder 1C, feed path RB of the paper feeder 1B and feed path RA of the paper feeder 1A sequentially, taken into the image forming apparatus 100 from the sheet receiving section 114, and then transported to the transfer position.

Since the paper feeders 1A, 1B and 1C are arranged in a row laterally of the image forming apparatus 100, the feed paths RA, RB and RC form a substantially straight line. Therefore, as compared to the conventional paper feeder defining a feed path which is likely to curve or bend, the paper feeders 1A, 1B and 1C can feed each recording sheet through their feed paths RA, RB and RC with less possibility of curving, thereby inhibiting the occurrence of jam during feeding. Further, it is less likely that each recording sheet deforms during feeding through the feed paths RA, RB and RC and within the image forming apparatus 100, since the possibility that the recording sheet is curved is very low. Thus, degradation in the quality of an image to be on a recording sheet due to deformation of the recording sheet can be prevented.

Further, in the arrangement of the paper feeders 1A, 1B and 1C, the upper surface of each of topmost recording sheets SA and SB on respective sheet carrier plates 2A and 2B forms part of the feed path RA or RB. This feature eliminates the need to provide a feed path separately and hence allows each of the paper feeders 1A, 1B and 1C to be downsized.

Additionally, since there is no limitation on the sequence of arrangement of the paper feeders 1A, 1B and 1C, the paper feeders 1A, 1B and 1C can be installed efficiently.

Figure 4:
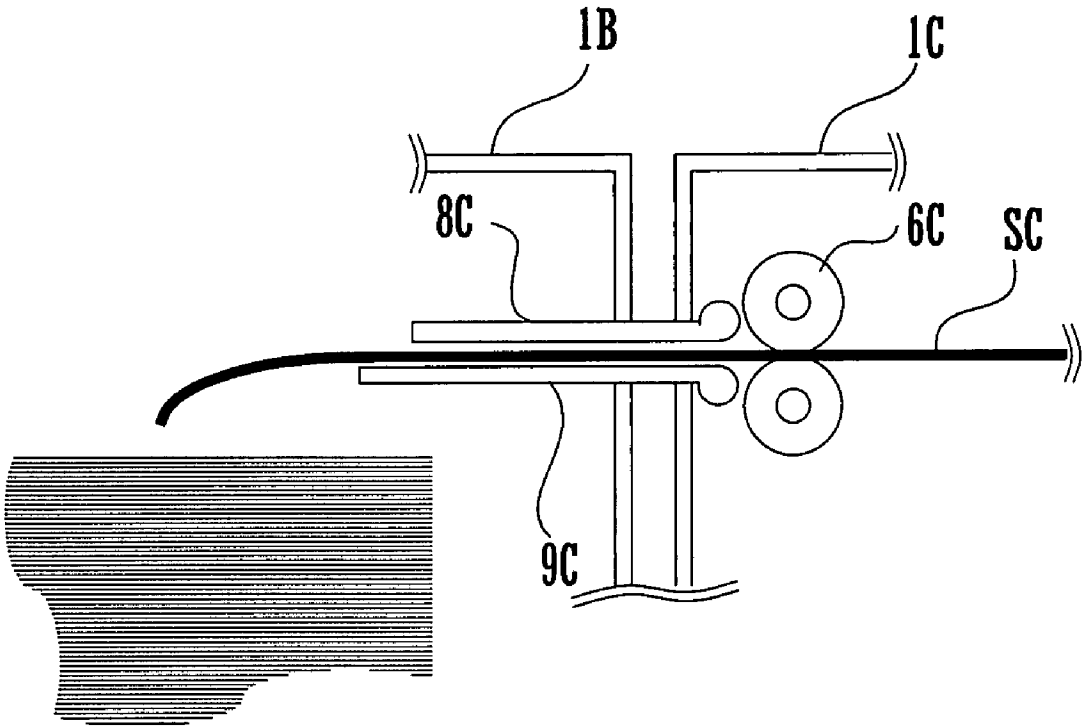
FIG. 4 is an enlarged view of a portion of the paper feeder.

As shown in FIG. 4, the pair of paper guides 8C and 9C is inserted into the immediately downstream paper feeder 1B so that its downstream end is positioned downstream from the upstream edge of the recording sheet stack carried on the sheet carrier plate 2B of the paper feeder 1B. This holds true for the pair of paper guides 8B and 9B of the paper feeder 1B.

Accordingly, when the pair of paper guides 8B and 9B and the pair of paper guides 8C and 9C of each of the paper feeders 1B and 1C is inserted into the immediately downstream paper feeder 1A or 1B, the pair of paper guides can guide each recording sheet not to the upstream edge of the topmost recording sheet of the sheet stack carried on the sheet carrier plate 2A or 2B of the adjacent paper feeder 1A or 1B but to a location above the upper surface of the topmost recording sheet.

This feature makes it possible to prevent each recording sheet fed from the paper feeder 1B or 1C from colliding with the upstream edge of the topmost recording sheet of the sheet stack carried on the sheet carrier plate 2A or 2B of the immediately downstream paper feeder 1A or 1B. For this reason, each recording sheet can be prevented from being fed askew, which results in smooth feeding of the recording sheet. This advantage is very effective when the feeding distance within the paper feeders 1A, 1B and 1C is very long.

Figures 5A, 5B, 5C:
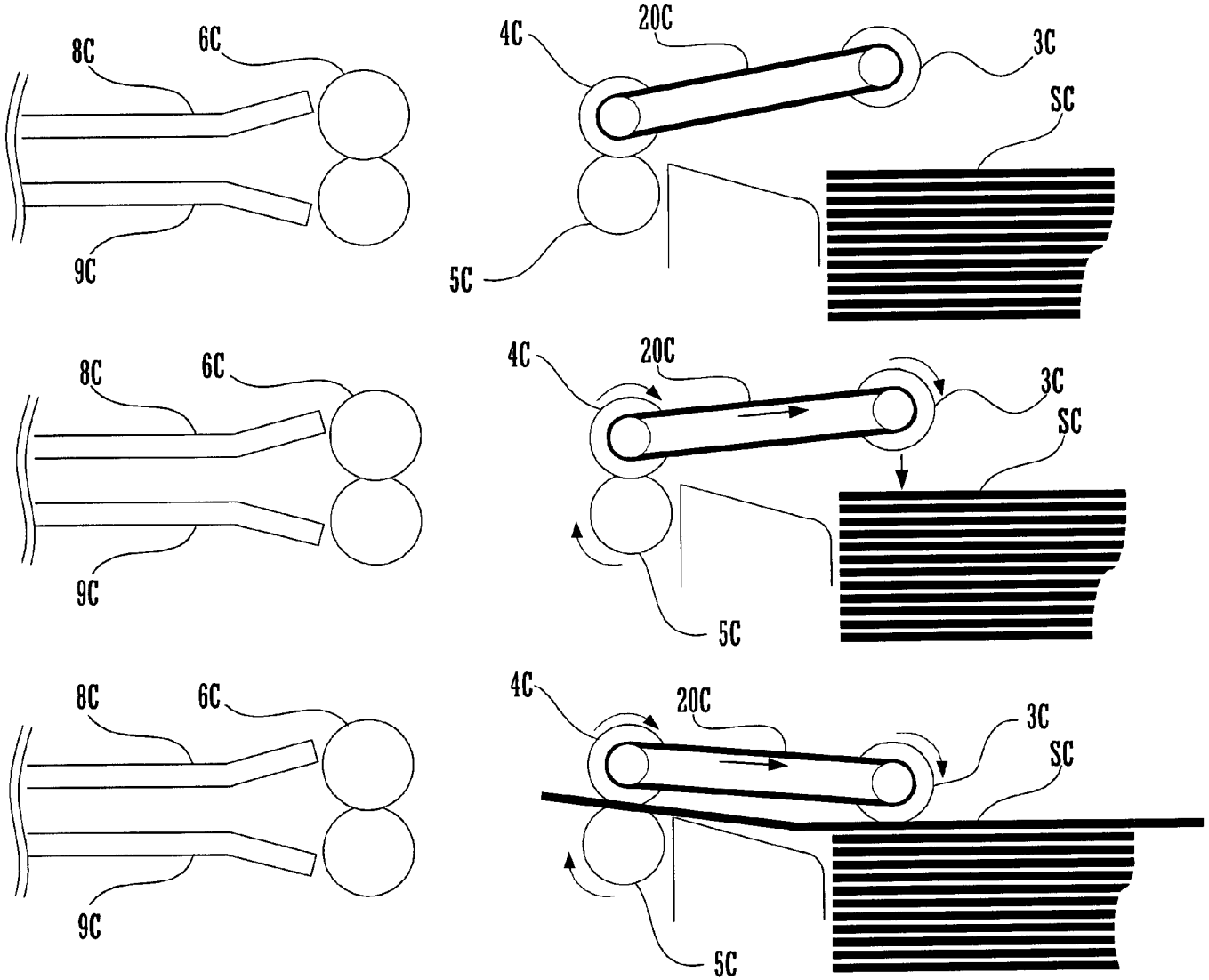
FIG. 5A is a view showing the paper feeder in a state before feeding of recording sheets.
FIG. 5B is a view showing the paper feeder in a state just after the start of rotation of a pickup roller.
FIG. 5C is a view showing the paper feeder in a state just after the start of sheet feeding by the pickup roller.

Before starting the feeding of the recording sheet placed on the sheet carrier plate 2C of the paper feeder 1C, the rollers 3C to 6C remain stationary without rotation as shown in FIG. 5A. When feeding each of the recording sheets, the pickup roller 3C is caused to rotate and move downwardly by drive means not shown to abut against the upper surface of topmost recording sheet SC of the sheet stack carried on the sheet carrier plate 2C, as shown in FIG. 5B. The drive means for rotating the pickup roller 3C is also used to move it downwardly.

Rotation of the pickup roller 3C causes the feed roller 4C to rotate via an endless belt 20C. On the other hand, the reverse roller 5C is rotated reversely of the direction of rotation of the feed roller 4C within the nip zone between the feed roller 4C and the reverse roller 5C by non-illustrated drive means which is separate from the drive means for driving the pickup roller 3C.

The recording sheet SC contacting the pickup roller 3C is paid out into the nip zone between the feed roller 4C and the reverse roller 5C, as shown in FIG. 5C.

Figure 6A:
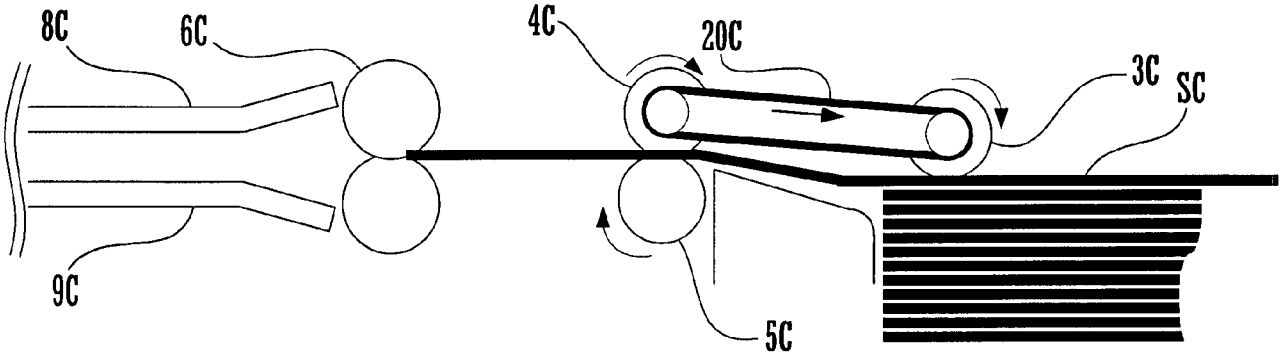
FIG. 6A is a view showing the paper feeder in a state where the downstream edge of a recording sheet has reached a transport roller.

If plural recording sheets are picked up by the pickup roller 3C as laid one upon another before passage of the recording sheet SC through the nip zone between the feed roller 4C and the reverse roller 5C, the feed roller 4C feeds only the topmost recording sheet SC of the plural sheets toward the transport roller 6C, while at the same time the reverse roller 5*c* rotates so as to return the rest of the recording sheets to the sheet carrier plate 2C, as shown in FIG. 6A.

Figure 6B:
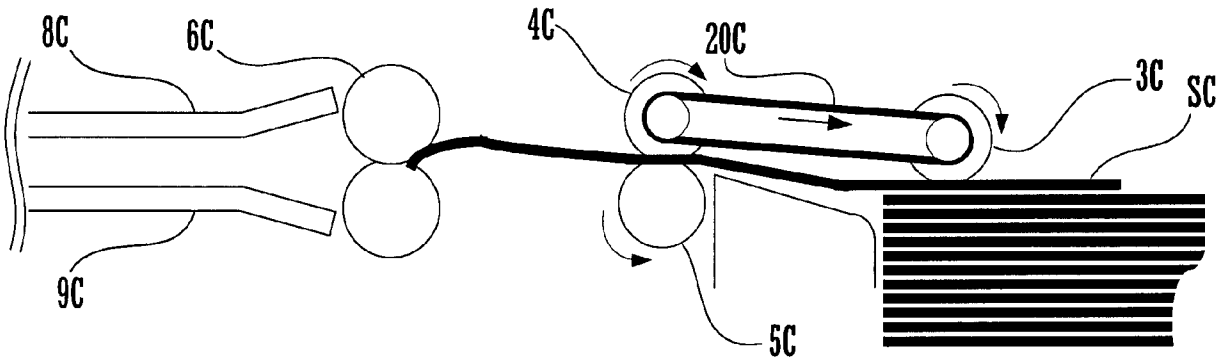
FIG. 6B is a view showing the paper feeder in a state just before the start of rotation of the transport roller.

After separation of the recording sheet SC from the rest, the reverse roller 5C is rotated in the same direction as the feed roller 4C within the nip zone as shown in FIG. 6B in order to enhance the force of feeding the recording sheet SC toward the transport roller 6C.

Because the transport roller 6C is not rotated at that time, the downstream edge of the recording sheet SC entirely abuts against the transport roller 6C with a portion adjacent the downstream edge in a warped condition.

Figure 6C:
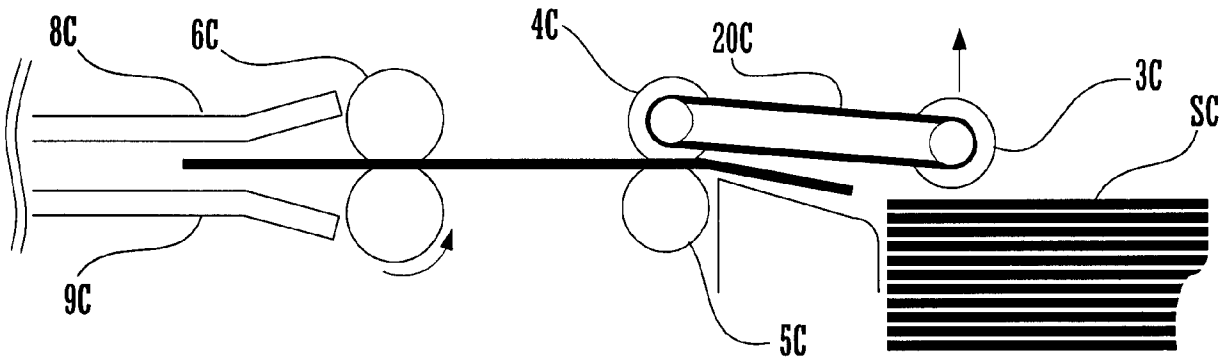
FIG. 6C is a view showing the paper feeder in a state just after the start of rotation of the transport roller.

After lapse of a predetermined time from the start of rotation, the pickup roller 3C stops rotating and moves away from the topmost recording sheet on the sheet carrier plate 2C, as shown in FIG. 6C. The feed roller 4C and the reverse roller 5C also stop rotating upon the stop of rotation of the pickup roller 3C. Subsequently, the transport roller 6C starts rotating to resume the feeding of the recording sheet SC.

Here, the recording sheet SC is caused to abut against the transport roller 6C temporarily for the purpose of correcting skew feeding of the recording sheet SC. For example, when the recording sheet SC is fed askew to the transport roller 6C, a portion of the downstream edge of the recording sheet SC first abuts against the transport roller 6C. Subsequently, a portion of the recording sheet SC adjacent the portion having abutted against the transport roller 6C begins warping while the other portion of the downstream edge begins abutting against the transport roller 6C, since the pickup roller 3C continues feeding the recording sheet SC. Finally, the downstream edge of the recording sheet SC entirely becomes abutted against the transport roller 6C.

With rotation of the transport roller 6C as shown in FIGS. 6A to 6C, the downstream edge of the recording sheet SC is entirely passed through the nip zone defined by the transport roller 6C. After the upstream edge of the recording sheet 6C has passed through the nip zone of the transport roller 6C, the transport roller 6C stops rotating and waits to correct skew feeding of the succeeding recording sheet SC.

Where there is the succeeding recording sheet SC to be fed, the rollers which are not rotating currently, including the pickup roller 3C, resume rotation to feed the succeeding recording sheet SC upon detection of the downstream edge of the recording sheet SC being fed currently by a sensor 120 provided on the sheet transport path F1.

The sensor 120 is disposed at such a location as to allow the succeeding recording sheet SC to start being fed in order to reach the registration roller 111 in time for transfer of a toner image. The length of time from the start feeding of recording sheet SC to the arrival of recording sheet SC at the registration roller 111 is shorter than the length of time required for the image forming process from the formation of an electrostatic latent image on the photosensitive drum 105 up to the completion of transfer of a toner image to recording sheet SC. For this reason, there is no possibility that recording sheet SC is fed as delayed for transfer of a toner image at the transfer position.

The length of time required for recording sheet SC to be transported from the paper feeder 1A to the registration roller 111 is shorter than that required for recording sheet SC to be transported from, for example, the paper feeder 1C to the registration roller 111. Even though recording sheet SC reaches the registration roller 111 much earlier than the time the recording sheet is to be fed to the transfer position, the registration roller 111 appropriately adjusts the timing with which the recording sheet SC is fed and, hence, no problem arises.

In successively feeding recording sheets SC carried on the sheet carrier plate 2C of the paper feeder 1C to the image forming apparatus 100 by repeating by above-described operation, it is possible to keep appropriate spacing between adjacent recording sheets during feeding and hence stabilize the feeding of recording sheets with a simple arrangement.

By causing each of the transport rollers 6A, 6B and 6C to rotate after lapse of a predetermined time from the start rotating of the pickup roller 3A, 3B or 3C to feed each recording sheet fed by the pickup roller 3A, 3B, or 3C to the image forming apparatus 100, skew feeding of each recording sheet can be corrected.

The aforementioned predetermined time is a time period from the start feeding of recording sheet SC by the pickup roller 3C until the downstream edge of the recording sheet becomes wholly abutted against the transport roller 6C.

Thus, even the above-described arrangement wherein the paper feeders 1A, 1B and 1C are arranged in a row laterally of the image forming apparatus 100, is capable of correcting skew feeding of recording sheets every time each recording sheet passes the transport roller 6A, 6B or 6C of a respective one of paper feeders 1A, 1B and 1C, thus ensuring stabilized sheet feeding.

Figure 7A:
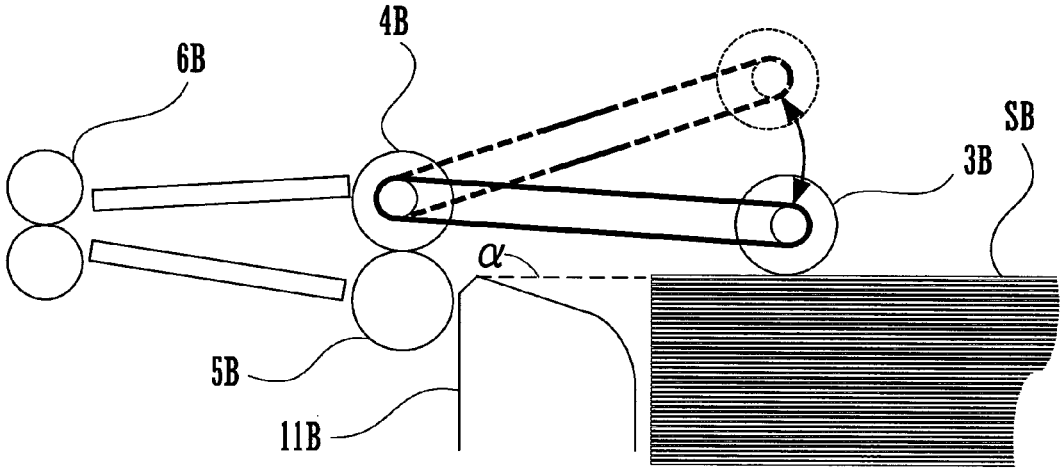
FIG. 7A is a view illustrating an operation of the pickup roller of the paper feeder in feeding recording sheets.

With reference to FIGS. 7 and 8, description will be made of the operation of lift-up mechanism 15B provided as the lifting mechanism of the present invention in the paper feeder 1B. In the case where recording sheets are fed to the image forming apparatus 100 from only the paper feeder 1B, the sheet carrier plate 2B is lifted up and down by means of the lift-up mechanism 15B so that the height position of the upper surface of topmost recording sheet SB of a sheet stack carried on the sheet carrier plate 2B is adjusted to height $\alpha$, as shown in FIG. 7A.

Thereafter, the pickup roller 3B is moved down to the topmost recording sheet SB and rotated to start feeding the recording sheet SB.

The height $\alpha$ is an upper limit height position which allows recording sheet SB picked up by the pickup roller 3B to pass over the topmost point of a navigator member 11B linearly thereby ensuring smooth feeding of the recording sheet SB to the feed roller 4B and reverse roller 5B.

Figure 7B:
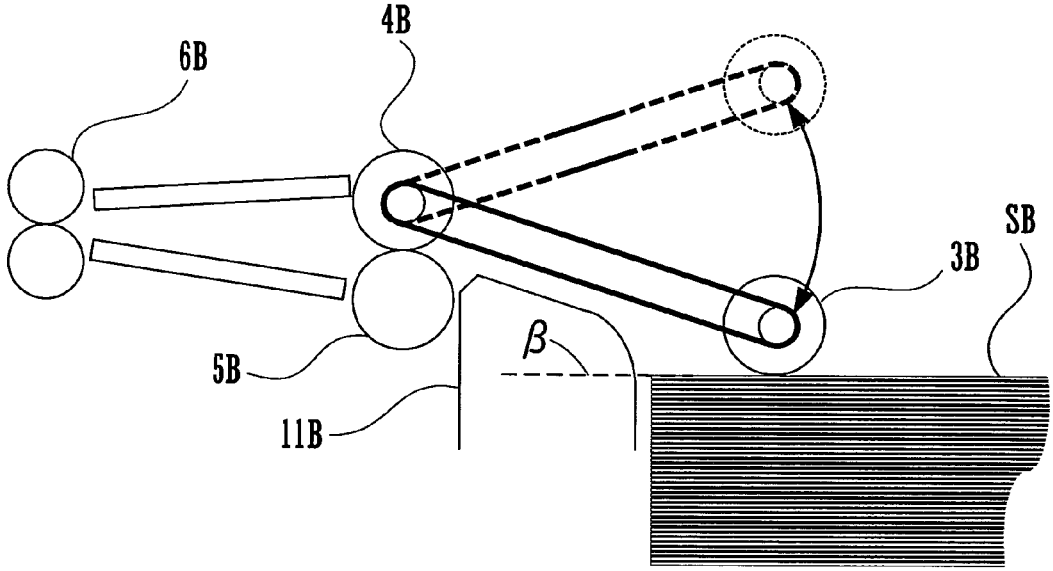
FIG. 7B is a view illustrating an operation of the pickup roller of the paper feeder in feeding recording sheets.

As recording sheets are fed successively, the height position of topmost recording sheet SB on the sheet carrier plate 2B lowers gradually. When the height position of topmost recording sheet SB reaches height $\beta$ as shown in FIG. 7B, a non-illustrated sensor detects this fact. In response to a detection signal from the sensor the lift-up mechanism 15B lifts up the sheet carrier plate 2B until the height position of topmost recording sheet SB is moved to the height $\alpha$.

The height $\beta$ is a lower limit height position which allows recording sheet SB picked up by the pickup roller 3B to be smoothly fed to the feed roller 4B and reverse roller 5B by utilizing the curvature of the navigator member 11B.

Accordingly, the range between the height $\alpha$ and the height $\beta$ is a range which allows recording sheet SB to be fed and which corresponds to the predetermined pickup range A. Usually, the difference between the height $\alpha$ and the height $\beta$ is set equal to the thickness of a stack of 30 to 50 recording sheets. If the height $\beta$ is lowered, the pickup force of the pickup roller 3B working on recording sheet SB positioned at the height $\beta$ is decreased, which is likely to cause a delay in sheet feeding. Thus, the occurrence of jam is likely due to such a delay in sheet feed timing.

Figure 8A:
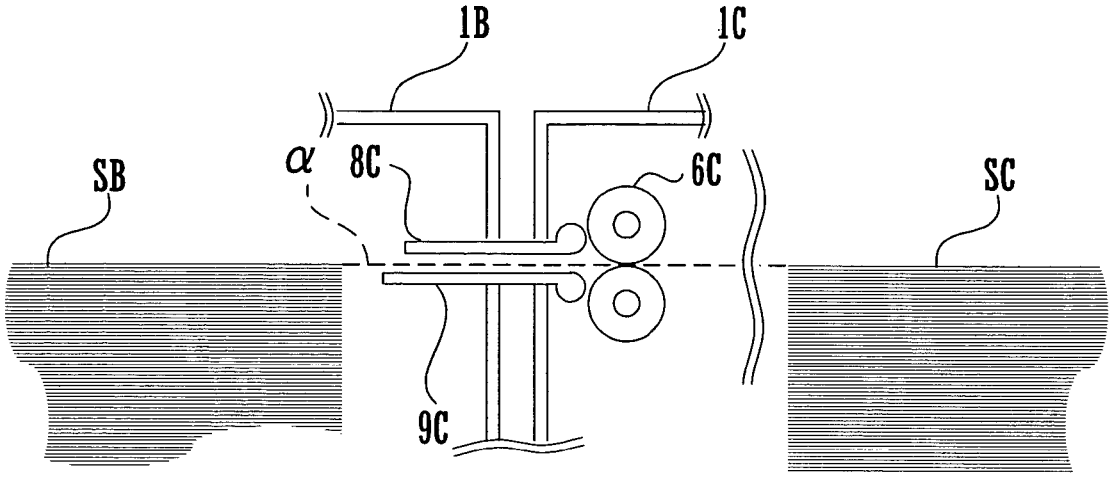
FIG. 8A is a view illustrating an operation of a lift-up mechanism of the paper feeder in feeding recording sheets.

In the arrangement shown in FIG. 3, when the image forming apparatus 100 is in a standby state where image formation is not performed or when the paper feeders 1A, 1B and 1C are in a standby state in which any recording sheet is not fed from any one of the paper feeders 1A, 1B and 1C though image formation is being performed by the image forming apparatus 100, the upper surface of any one of topmost recording sheets SA, SB and SC on the respective sheet carrier plates 2A, 2B and 2C of the paper feeders 1A, 1B and 1C is positioned at the height $\alpha$, as shown in FIG. 8A.

Figure 8B:
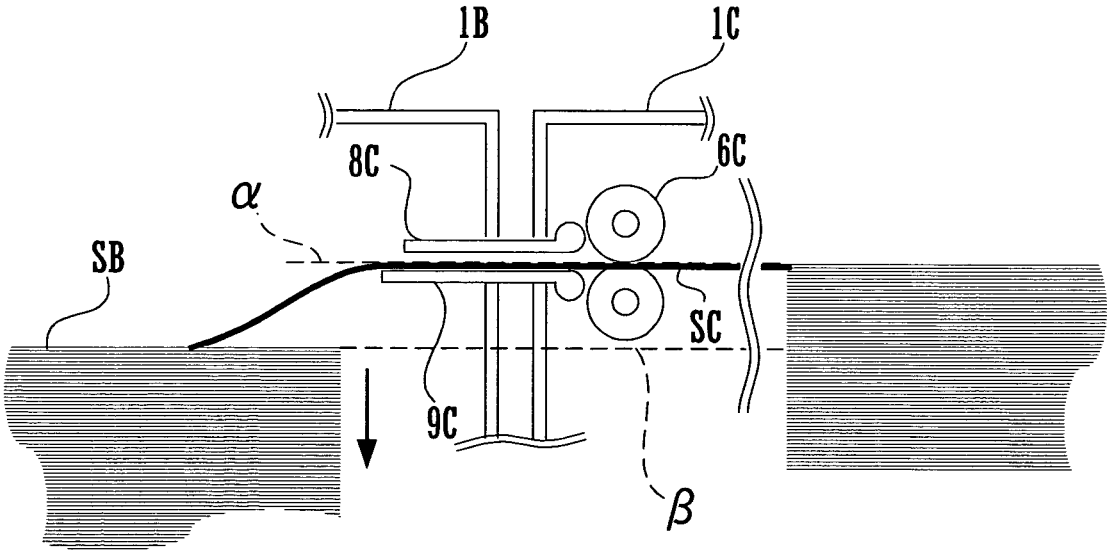
FIG. 8B is a view illustrating an operation of the lift-up mechanism of the paper feeder in feeding recording sheets.

In feeding recording sheet SC from, for example, the paper feeder 1C toward the image forming apparatus 100, the height position of the upper surface of topmost recording sheet SB within the paper feeder 1B is lowered from the condition shown in FIG. 8A to the height $\beta$ by means of the lift-up mechanism 15B, as shown in FIG. 8B. Also, the height position of the upper surface of topmost recording sheet SA within the paper feeder 1A is lowered to the height $\beta$ by means of the lift-up mechanism 15A.

Subsequently, the pickup roller 3C is lowered and rotated to start feeding topmost recording sheet SC of a sheet stack carried on the sheet carrier plate 2 of the paper feeder 1C. In harmony with the operation of the pickup roller 3C, the pickup roller 3B of the paper feeder 1B is lowered with predetermined timing to grip the incoming recording sheet SC.

Subsequently, the sheet carrier plate 2B of the paper feeder 1B is lifted up by means of the lift-up mechanism 15B to raise the height position of the incoming recording sheet SC to the height α. Thereafter, necessary rollers including the pickup roller 3B are caused to start rotating to feed the recording sheet SC to the paper feeder 1A. In harmony with the operation of the pickup roller 3B, the pickup roller 3A of the paper feeder 1A is lowered with predetermined timing to grip the incoming recording sheet SC and then immediately rotated to feed the recording sheet SC onto the sheet transport path F3 of the image forming apparatus 100.

The height position of the incoming recording sheet SC having been fed into the paper feeder 1A may be raised to the height . The recording sheet SC can be fed from the paper feeder 1A onto the sheet transport path F3 of the image forming apparatus 100 even if the height position of the recording sheet SC is not raised to the height α. If the recording sheet SC is fed askew to some extent, the sheet transport path F3 can guide the recording sheet SC properly. For this reason there is no possibility that such a trouble as jam occurs during feeding.

As described above, in feeding recording sheet SC from the paper feeder 1C, the height position of the upper surface of each of topmost recording sheets SA and SB on the respective sheet carrier plates 2A and 2B of the downstream paper feeders 1A and 1B is made lower than the height position of the upper surface of recording sheet SC. By so doing, the incoming recording sheet SC fed from the paper feeder 1C can be prevented from colliding with the sheet stack stored in each of the paper feeder 1A and 1B, whereby recording sheet SC can be fed reliably without the occurrence of such a trouble as jam during feeding.

Similarly, in feeding recording sheet SB from the paper feeder 1B, the height position of the upper surface of topmost recording sheet SA on the sheet carrier plate 2A of the downstream paper feeder 1A is made lower than the height position of the upper surface of recording sheet SB. By so doing, the incoming recording sheet SB fed from the paper feeder 1B can be prevented from colliding with the sheet stack stored in the paper feeder 1A, whereby recording sheet SB can be fed reliably without the occurrence of such a trouble as jam during feeding.

Each of the paper feeders 1A, 1B and 1C arranged in a row in the sheet feed direction toward the image forming apparatus 100 can appropriately vary the height position of the upper surface of topmost recording sheet SA, SB or SC in a respective one of the paper feeders 1A, 1B and 1C. For this reason, there is no need to fix the height positions of respective recording sheets SA, SB and SC within the paper feeders 1A, 1B and 1C into a descending order as the image forming apparatus 100 becomes closer. Thus, the paper feeders 1A, 1B and 1C can have the same construction.

Since the lift-up mechanism 15A and 15B for lifting up and down each of the sheet carrier plates 2A and 2B in accordance with the amount of storage of recording sheets is used as the means of varying the height position of each of recording sheets SA and SB in a respective one of the paper feeders 1A and 1B during feeding of each recording sheet SA or SB, an additional mechanism is not needed, which can avoid an increase in cost.

Further, the height position of recording sheets SB or SC in the upstream paper feeders 1B or 1C during feeding of recording sheet SB or SC is adjusted to the height α which is the upper limit of the pickup range, while the height position of recording sheet SA or SB in the downstream paper feeders 1A or 1B is adjusted to the height β which is the lower limit of the pickup range. By so doing, each of recording sheets SB and SC can be fed to the image forming apparatus 100 reliably under very simple control.

Moreover, since the height position of each of the pair of paper guides 8B and 8C and the pair of paper guides 9B and 9C is set to a height substantially equal to the height α, straight-ahead feeding of recording sheet SB or SC is improved, which allows recording sheet SB or SC to be fed more reliably.

On condition that a sufficient difference in height is provided between the height position of the upper surface of recording sheet SB or SC in the upstream paper feeder 1B or 1C and that of the upper surface of recording sheet SA or SB in the downstream paper feeder 1A or 1B, these height positions may be set to respective heights other than the height α and the height β.

Each of the sheet members to be fed from each of the paper feeders 1A, 1B and 1C to the image forming apparatus 110 is not limited to a recording sheet but may be an OHP film or the like.

Also, the processing apparatus to be fed with such sheet members by each of the paper feeders 1A, 1B and 1C is not limited to image forming apparatus 100. Each of the paper feeders 1A, 1B and 1C can be used with any processing apparatus which performs processing on such sheet members.

Figure 9:
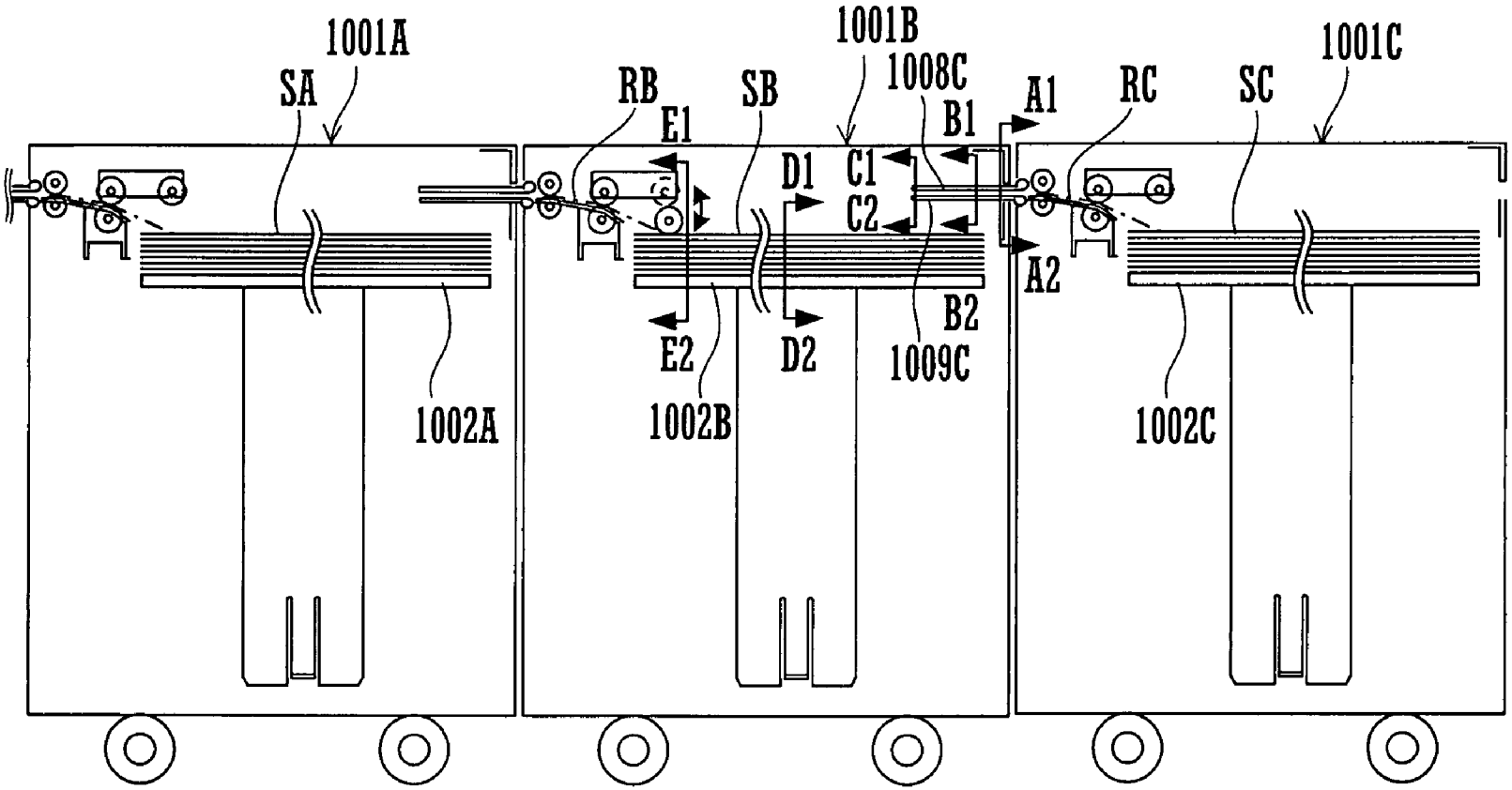
FIG. 9 is a view showing a paper feeder according to a second embodiment of the present invention.

FIG. 9 shows paper feeders 1001A, 1001B and 1001C according to a second embodiment of the present invention. These paper feeders 1001A, 1001B and 1001C are of the same construction. Here, description is directed to the paper feeder 1001C. Paper guides 1008C and 1009C of the paper feeder 1001C have equal length in the feed direction in which recording sheet SC is to be fed.

The paper guides 1008C and 1009C are formed such that when the paper guides 1008C and 1009C are inserted into receiving section 1010B of the adjacent paper feeder 1001B located downstream of the paper feeder 1C, their downstream ends are positioned above the upper surface of topmost recording sheet SB of a sheet stack carried on sheet carrier plate 1002B of the paper feeder 1001B and downstream of the upstream edge of the recording sheet SB.

This feature makes it possible to smoothly transport recording sheet SC fed from the paper feeder 1001C onto the upper surface of recording sheet SB in the immediately downstream paper feeder 1001B while preventing the recording sheet SC from colliding with the sheet stack stored in the paper feeder 1001B.

Other features of the paper feeders 1001A, 1001B and 1001C are similar to the corresponding features of the paper feeders 1A, 1B and 1C of the first embodiment.

Figure 10A:
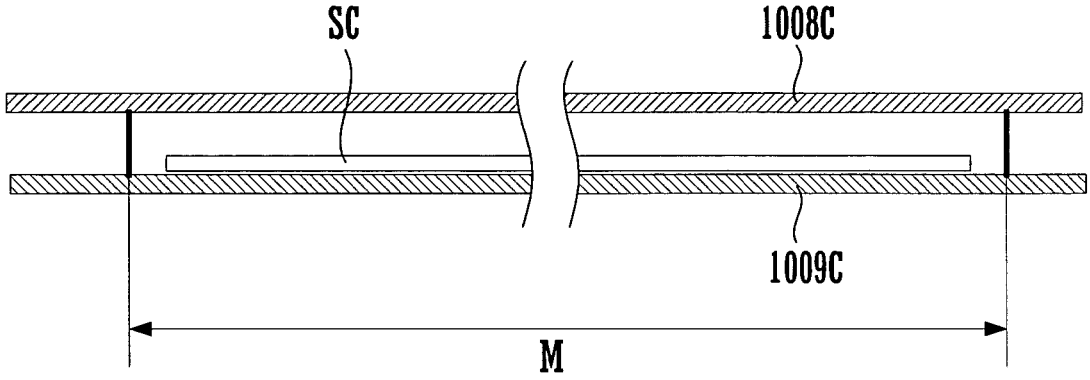
FIG. 10A is a sectional view taken on line A1-A2 of FIG. 9.

As shown in FIG. 10A, an upstream portion of the paper guides 1008C and 1009C is made flat without any curvature in a plane perpendicular to the sheet feed direction at least within a width M within which recording sheet SC is to be fed.

Figure 10B:
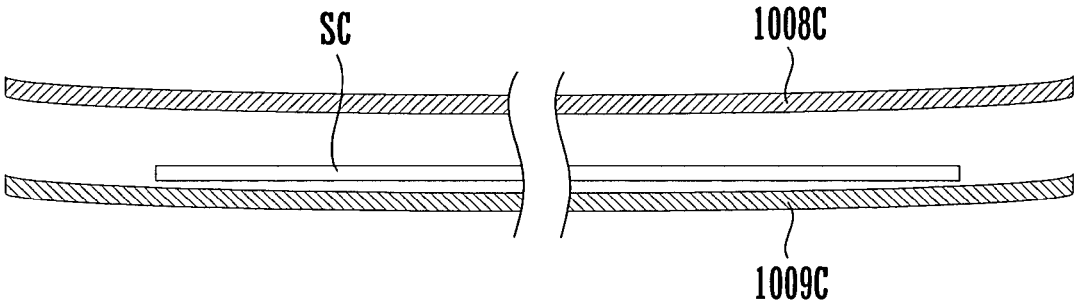
FIG. 10B is a sectional view taken on line B1-B2 of FIG. 9.

As shown in FIG. 10B, a downstream portion of the paper guides 1008C and 1009C is curved in a plane perpendicular to the sheet feed direction such that a central portion thereof protrudes downwardly.

Figure 10C:
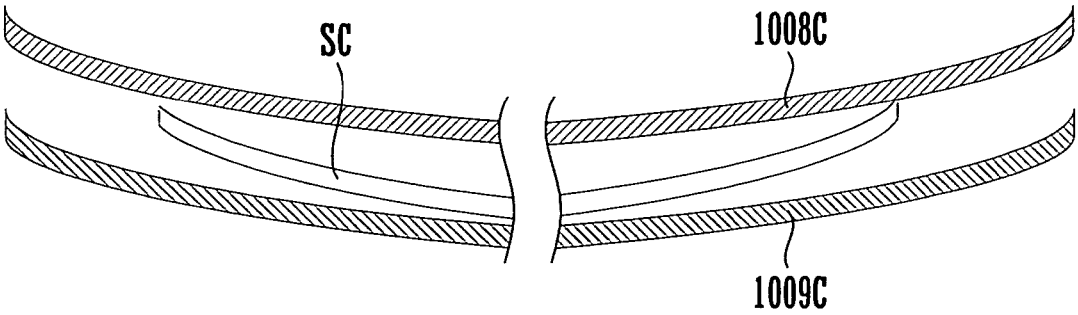
FIG. 10C is a sectional view taken on line C1-C2 of FIG. 9.

As shown in FIGS. 10B and 10C, the curvature of the paper guides 1008C and 1009C in a plane perpendicular to the sheet feed direction becomes sharper as the paper guides 1008C and 1009C extend downstream in the sheet feed direction.

Figure 11A:
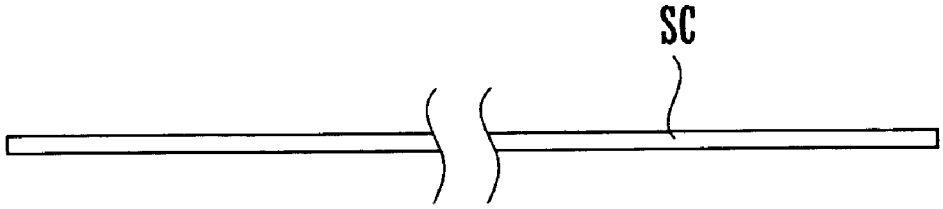
FIG. 11A is a sectional view, taken on line A1-A2 of FIG. 9, showing a condition of a recording sheet.
Figure 11B:
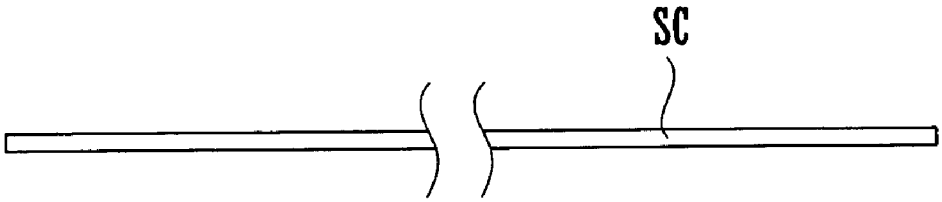
FIG. 11B is a sectional view, taken on line B1-B2 of FIG. 9, showing a condition of a recording sheet.

As shown in FIG. 11A, the upstream portion of the paper guides 1008C and 1009C guides recording sheet SC while keeping it flat without any curvature in a plane perpendicular to the sheet feed direction. Also, as shown in FIG. 11B, through the paper guides 1008C and 1019C are slightly curved in the section taken on line B1-B2 of FIG. 9, recording sheet SC is curved little because predetermined spacing is defined between the paper guides 1008C and 1009C.

Figure 11C:
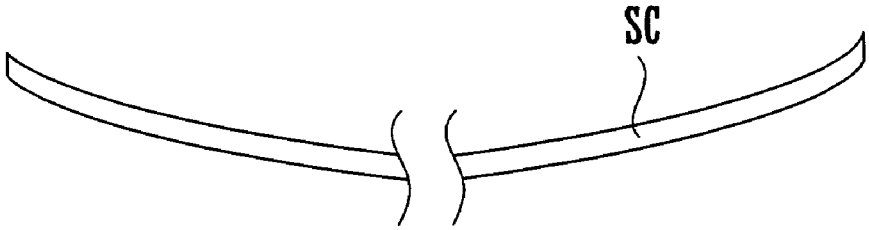
FIG. 11C is a sectional view, taken on line C1-C2 of FIG. 9, showing a condition of a recording sheet.
Figure 11D:
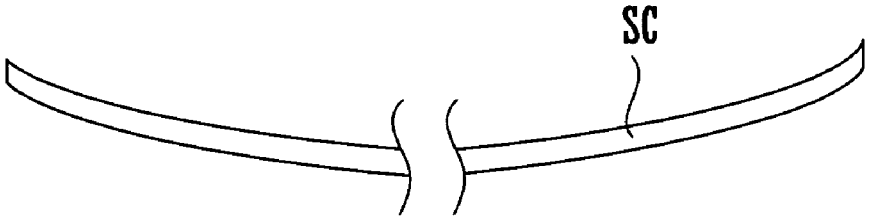
FIG. 11D is a sectional view, taken on line D1-D2 of FIG. 9, showing a condition of a recording sheet.

As shown in FIG. 11C, the downstream portion of the paper guides 1008C and 1009C guides recording sheet SC as kept curved along the shape of this portion in a plane perpendicular to the sheet feed direction. Also, as shown in FIG. 11D, recording sheet SC being fed with its upstream edge portion still passing within the paper guides 1008C and 1009C has its downstream edge portion still kept curved such that a central portion thereof lying in a plane perpendicular to the sheet feed direction protrudes downwardly because the recording sheet SC is temporarily imparted with stiffness by the curved upstream edge portion.

Figure 12A:
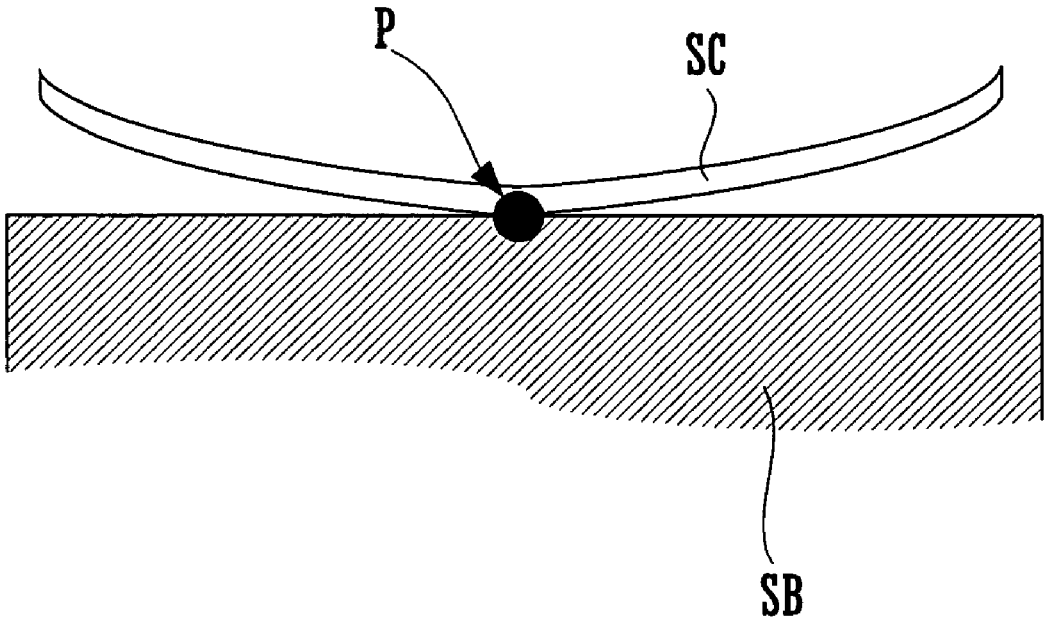
FIG. 12A is a sectional view taken on line D1-D2 of FIG. 9.

Thus, the downstream edge portion of recording sheet SC having passed through the paper guides 1008C and 1009C advances in a state in which only the central portion thereof lying in a plane perpendicular to the sheet feed direction is in contact with the upper surface of topmost recording sheet SB on the sheet carrier plate 1002B of the immediately downstream paper feeder 1001B, as shown in FIG. 12A.

Figure 12B:
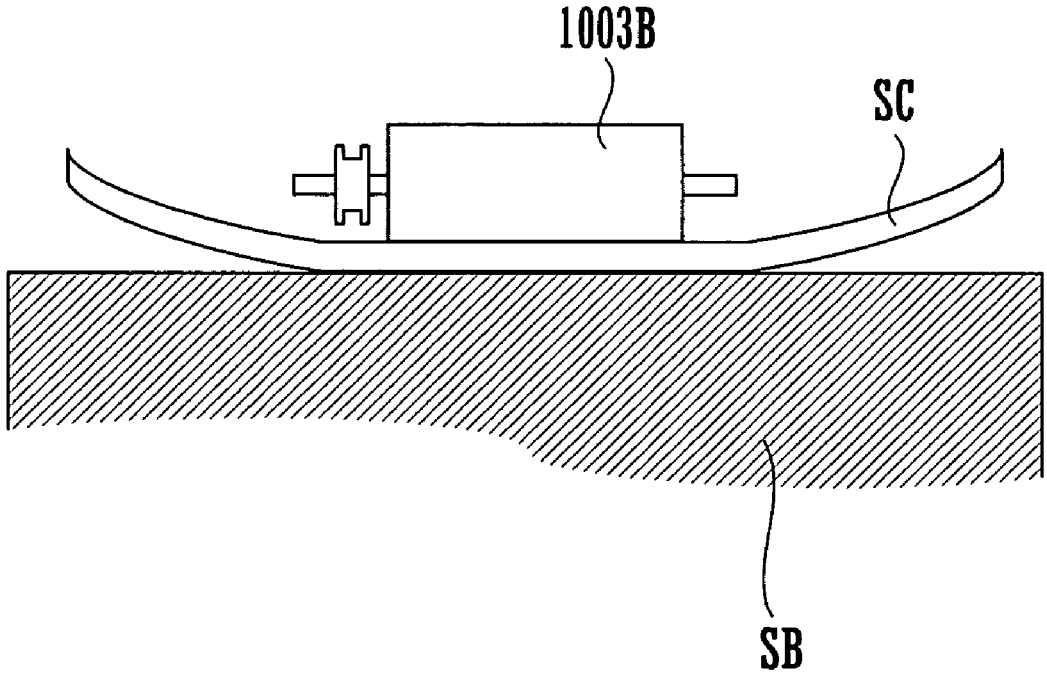
FIG. 12B is a sectional view taken on line E1-E2 of FIG. 9.

When the downstream edge portion of recording sheet SC reaches the location at which the pickup roller 1003B presses against the downstream edge portion, a portion around the central portion of the downstream edge portion lying in a plane perpendicular to the sheet feed direction becomes flat in the plane perpendicular to the sheet feed direction, as shown in FIG. 12B.

This is because the location at which the pickup roller 1003B presses against recording sheet SC is spaced a predetermined distance from the paper guides 1008C and 1009C and hence recording sheet SC having been curved along the shape of the paper guides becomes flat along the upper surface of recording sheet SB on the sheet carrier plate 1002B because of gravity and restoring force produced by the stiffness of recording sheet SC. Stated otherwise, the paper guides 1008C and 1009C are curved in a plane perpendicular to the sheet feed direction to such an extent that recording sheet SC becomes flat in a plane perpendicular to the sheet feed direction at the location at which the pickup roller 1003B of the adjacent paper feeder 1001B positioned downstream in the sheet feed direction presses against the downstream portion of the recording sheet SC.

The pickup roller 1003B picks up recording sheet SC by abutting against the upper surface of that portion of recording sheet SC which has become flat in a plane perpendicular to the sheet feed direction.

The downstream edge portion of recording sheet SC having passed through the paper guides 1008C and 1009C advances without immediately contacting the upper surface of recording sheet SB stored in the paper feeder 1001B and with only the curved central portion thereof lying in a plane perpendicular to the sheet feed direction contacting the upper surface of recording sheet SB. As a result, recording sheet SC is brought into contact with recording sheet SB with reduced frictional resistance. For this reason, the occurrences of skew feeding of recording sheet SC and feeding jam can be prevented.

Since the curvature of the paper guides 1008C and 1009C in a plane perpendicular to the sheet feed direction becomes sharper as the paper guides extend downstream, recording sheet SC can be curved smoothly.

Further, since the upstream portion of the paper guides 1008C and 1009C in the sheet feed direction is made flat in a plane perpendicular to the sheet feed direction, the occurrence of jam of recording sheet SC can be prevented during feeding through feed path RC extending from a location above the sheet carrier plate 1002C to the paper guides 1008C and 1009C.

The paper guides 1008A and 1009A of the paper feeder 1001A located adjacent to the image forming apparatus 100 may be used in their collapsed condition. In this case there will arise no problem even if the paper guides 1008A and 1009A are curved in a plane perpendicular to the sheet feed direction like the paper guides 1008B, 1009B and 1008C, 1009C of the other paper feeders 1001B and 1001C. Therefore, the paper feeders 1001A, 1001B and 1001C can have completely the same construction.

Figure 13:
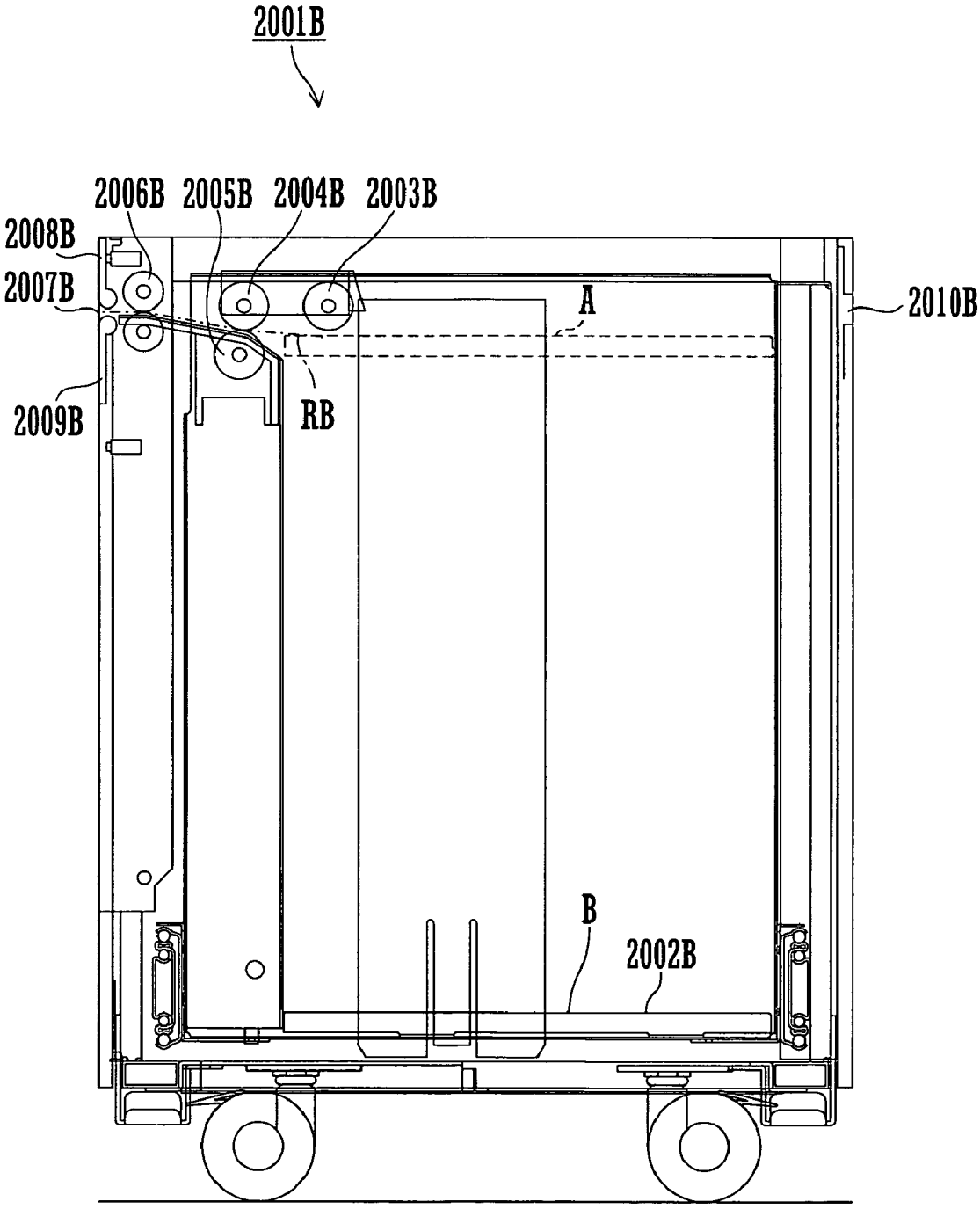
FIG. 13 is a sectional view showing the construction of a paper feeder according to a third embodiment of the present invention.
Figure 14:
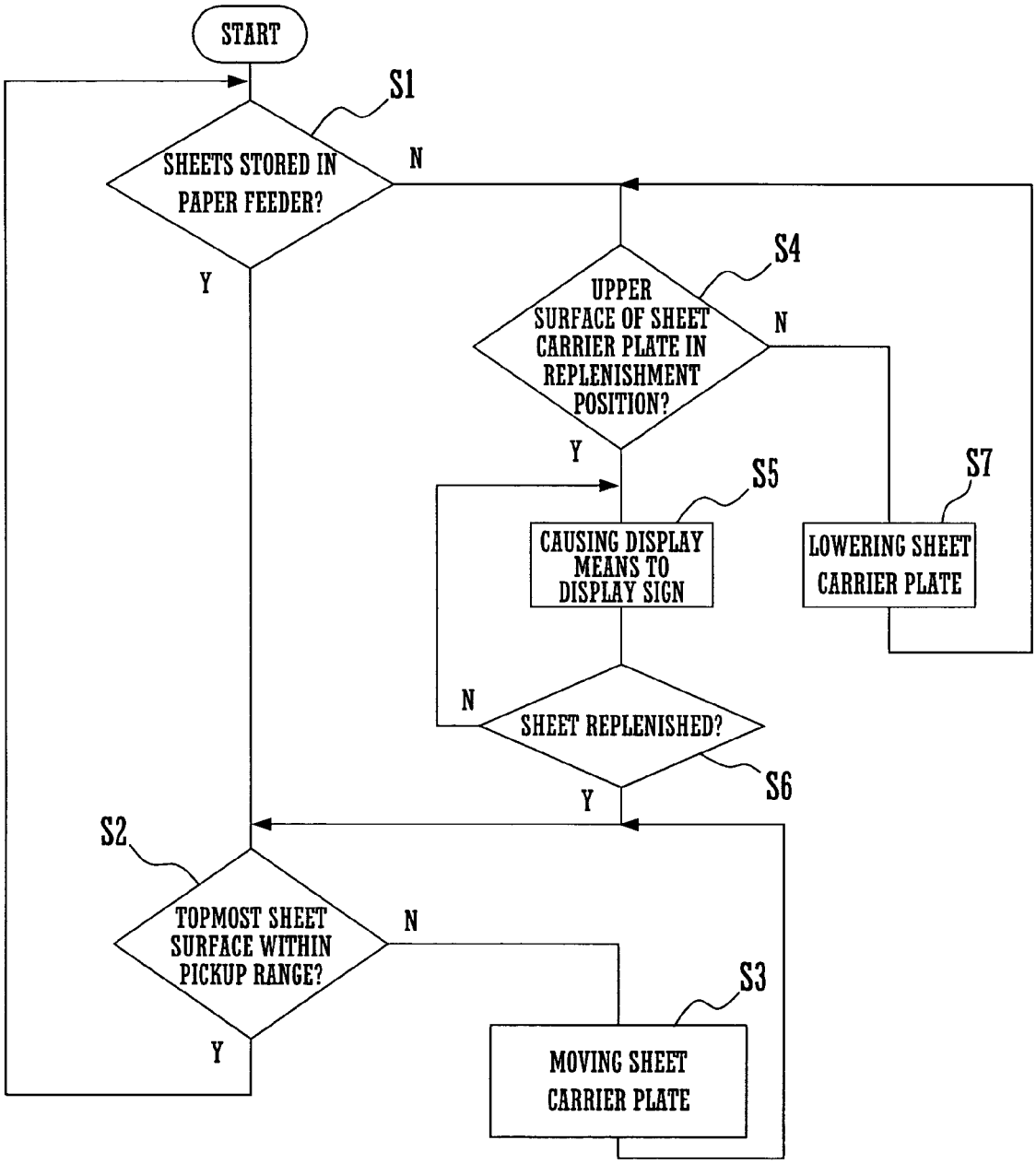
FIG. 14 is a flowchart of movement of a sheet carrier plate of the paper feeder during a period for which an image forming operation does not proceed.

FIG. 14 is a flowchart of movement of sheet carrier plate 2002B of paper feeder 2001B according to a third embodiment of the present invention shown in FIG. 13 during a period for which an image forming operation does not proceed. Since the construction of the paper feeder 2001B shown in FIG. 13 is the same as that of the paper feeder 1B shown in FIG. 1, description thereof will be omitted. During the period for which the image forming operation does not proceed, initially, judgment is made as to whether or not a stack of recording sheets is present on the sheet carrier plate 2002B (step S1). For example, the presence or absence of the recording sheet stack is detected based on the quantity of light with use of a known optical sensor having a light-emitting section and a light-receiving section. Such an optical sensor corresponds to the sheet detection means defined by the present invention.

If it is judged that the recording sheet stack is present on the sheet carrier plate 2002B in step S1, judgment is made as to whether or not the height position of topmost recording sheet SB of the recording sheet stack is within a predetermined pickup range A (step S2). If the height position is judged as not falling within the predetermined pickup range A, process step (S3) of moving the sheet carrier plate 2002B is repeated until the height position of recording sheet SB reaches to a height within the predetermined pickup range A. Subsequently, if the height position is judged as falling within the predetermined pickup range A in step S2, the process returns to step S1. The predetermined pickup range A is the range between the aforementioned upper limit height position $\alpha$ and lower limit height position $\beta$.

Alternatively, if it is judged that the recording sheet stack is absent on the sheet carrier plate 2002B in step S1, judgment is made as to whether or not the upper surface of the sheet carrier plate 2002B is in a predetermined replenishment position B (step S4). If the upper surface of the sheet carrier plate 2002B is judged as being in the predetermined replenishment position B, a sign prompting replenishment of recording sheets is displayed by, for example, display means provided on the paper feeder 2001B (step S5). Subsequently, judgment is made using the optical sensor as to whether or not replenishment of recording sheet has been made (step S6). If not, the process step (S5) is repeated until replenishment of recording sheets has been made.

If it is judged that the upper surface of the sheet carrier plate 2002B is not in the predetermined replenishment position B, process step (S7) of lowering the sheet carrier plate 2002B to the predetermined replenishment position B is performed. Since the upper surface of the sheet carrier plate 2002B is thus previously positioned in the predetermined replenishment position B when the recording sheet stack is absent on the sheet carrier plate 2002B, the user can place the recording sheet stack on the sheet carrier plate 2002B immediately without the need to wait for the sheet carrier plate 2002B to move to the predetermined replenishment position B.

Alternatively, if it is judged that replenishment of recording sheets has been made in step S6, the process step S2 is performed. The above-described control is exercised by means of a non-illustrated paper feeder control section included in the paper feeder 2001B. The paper feeder control section controls all the operations of the paper feeder 2001B. The paper feeder control section is connected to the control section of the image forming apparatus 100 for communication. If there is not provided such a the paper feeder control section, the control section of the image forming apparatus 100 may be configured to control the paper feeder 1 cooperatively through communication means such as a network. The control section of the image forming apparatus 100 controls all the operations of the image forming apparatus 100.

Figure 15:
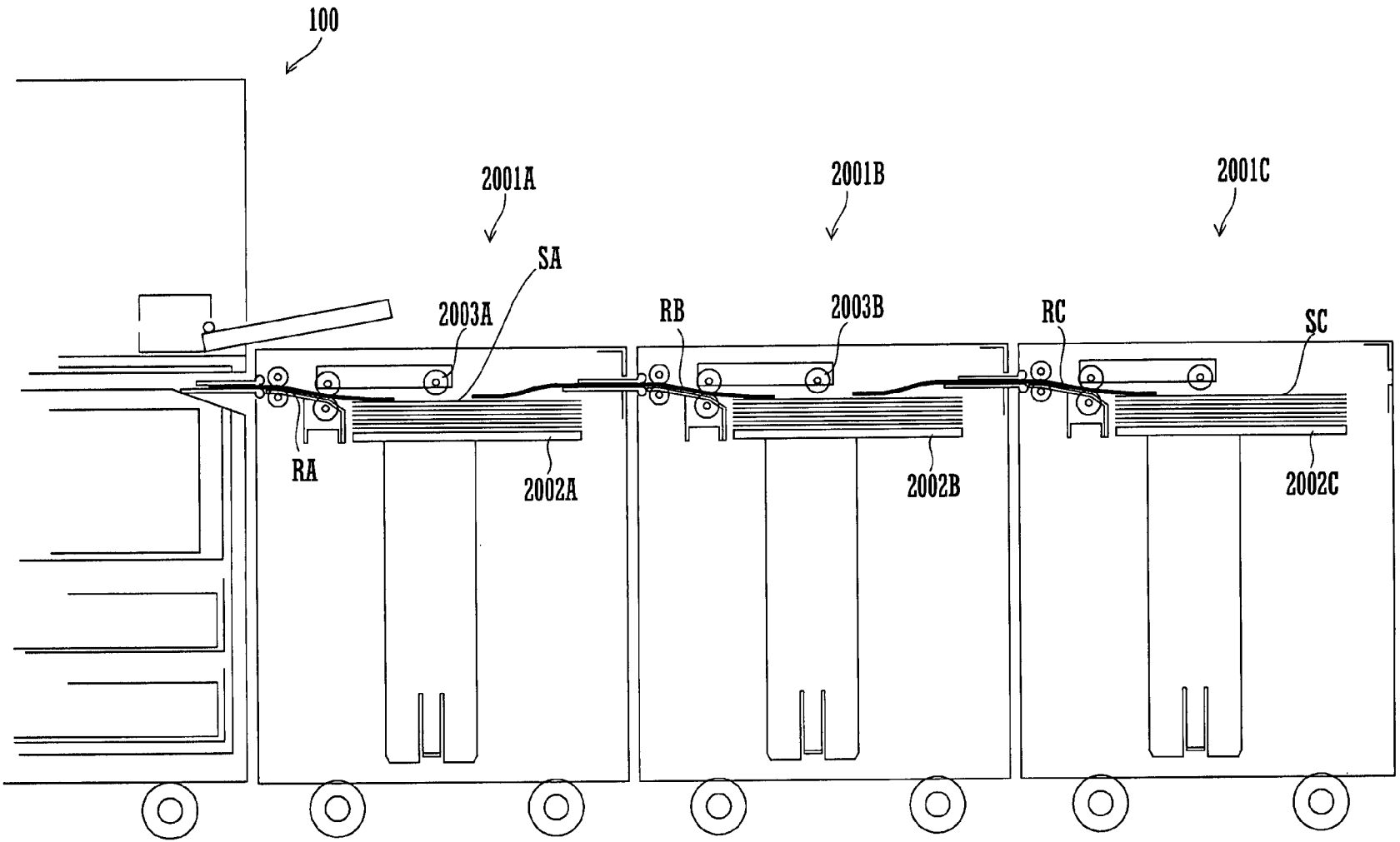
FIG. 15 is a view illustrating the disposition of three paper feeders relative to an image forming apparatus.
Figure 16:
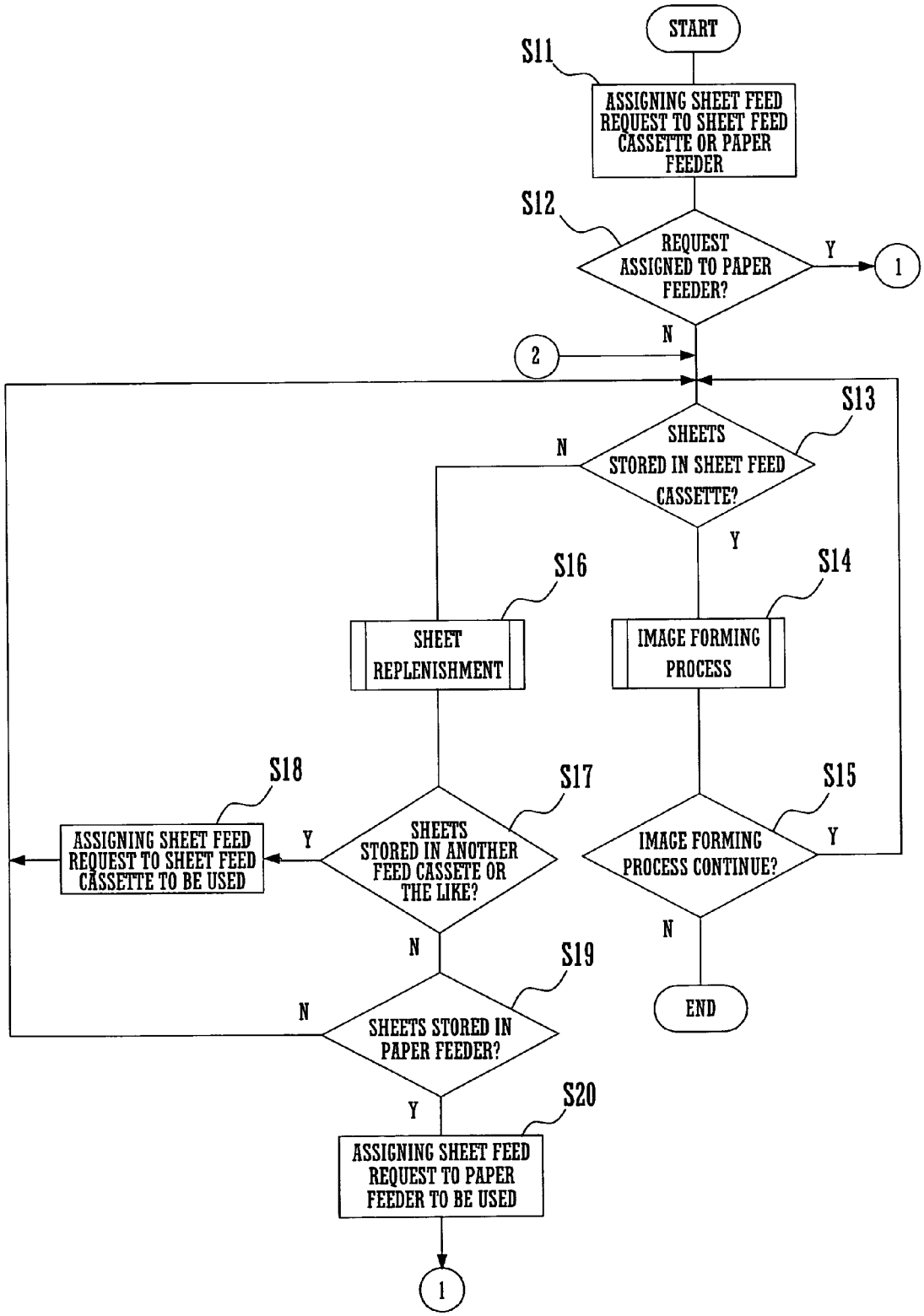
FIG. 16 is a flowchart of a sheet feed procedure followed by image forming apparatus provided with the three paper feeders during the image forming operation.
Figure 17:
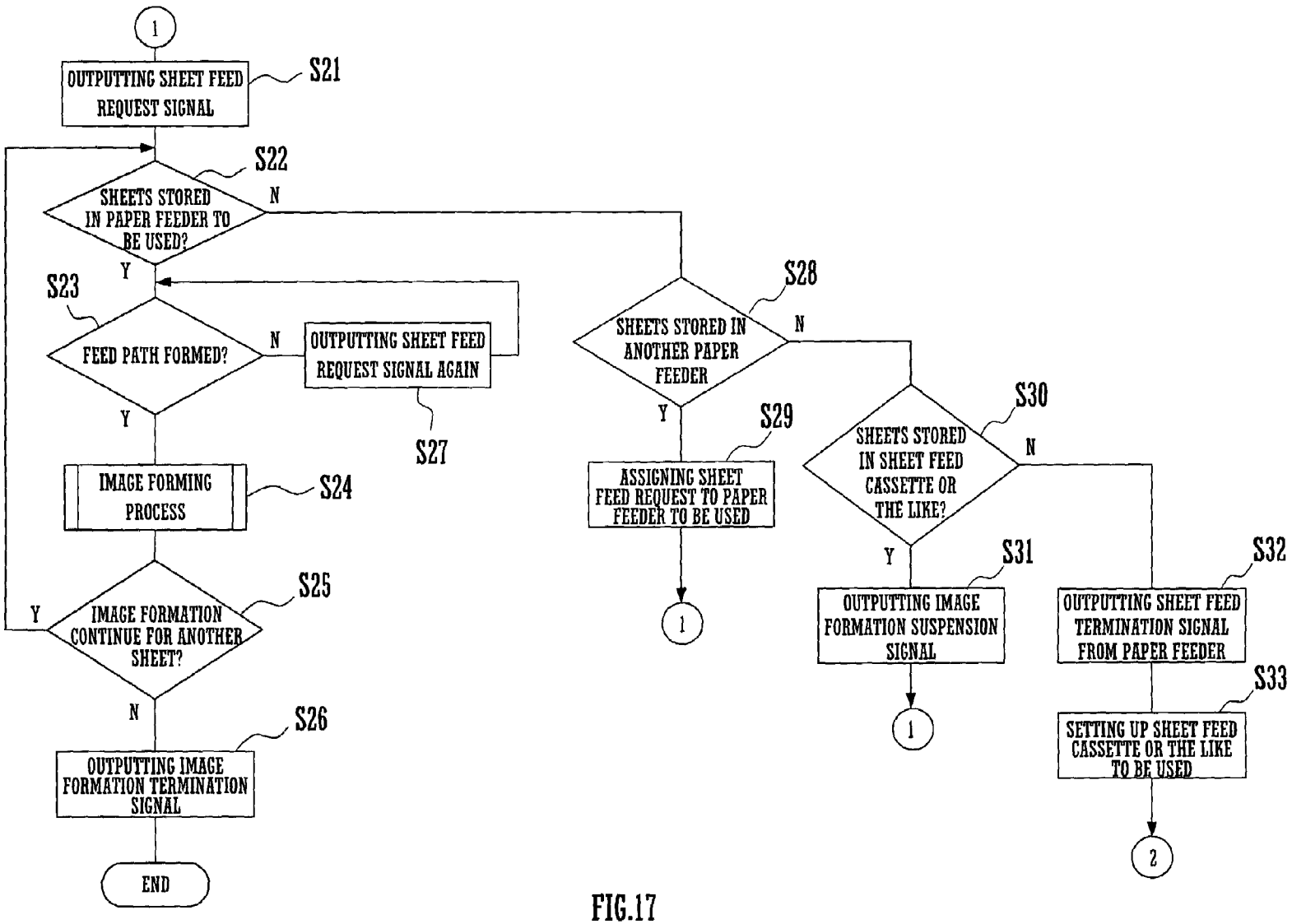
FIG. 17 is a flowchart of the sheet feed procedure.

FIGS. 16 and 17 show a flowchart of a sheet feed procedure followed by the image forming apparatus 100 provided with three paper feeders 2001A, 2001B and 2001C as shown in FIG. 15 during the image forming operation. Initially, upon receipt of an image formation request from the user via a network or the like connected to the image forming apparatus 100, a sheet feed request is assigned to either sheet feed cassette 102, 103 or paper feeder 2001A, 2001B, 2001C based on information on the number of copies and image data received together with the image formation request (step S11).

Subsequently, judgment is made as to whether or not the sheet feed request has been assigned to any one of the paper feeders 2001A, 2001B and 2001C (step S12). If it is judged that the sheet feed request has been assigned to any one of the paper feeders 2001A, 2001B and 2001C, the process proceeds to step S21.

In step S12, if the sheet feed request is judged as having been assigned not to any one of the paper feeders 2001A, 2001B and 2001C but to a sheet feed cassette included in the image forming apparatus 100, for example, the sheet feed cassette 102, judgment is made as to whether or not the sheet feed cassette 102 contains recording sheets (step S13).

If the sheet feed cassette 102 is judged as containing recording sheets in step S13, the image forming process is started (step S14) while the sheet feed cassette 102 is caused to feed recording sheets.

Subsequently, judgment is made as to whether or not the image forming process should be performed on recording sheet SC (step S15). If it is judged that image formation is to continue on another recording sheet, the process returns to step S13. Alternatively, if it is not judged that image formation is to continue on another recording sheet in step S15, the image forming operation is terminated.

If the sheet feed cassette 102 is judged as not containing recording sheets in step S13, a sheet replenishment process including causing the display section of the image forming apparatus 100 to display a sign prompting replenishment of recording sheet is performed (step S16). Subsequently, judgment is made as to whether or not recording sheets stored in another sheet feed cassette 103 or the like can be used as a substitute in the current image formation (step S17). If it is judged that such recording sheets can be used as a substitute, the sheet feed request is assigned to the sheet feed cassette 103 or the like (step S18), and then the process returns to step S13.

Alternatively, if it is judged that the recording sheets stored in the sheet feed cassette 103 or the like cannot be used as a substitute in the current image formation in step S17, judgment is made as to whether or not recording sheets stored in paper feeder 2001A, 2001B or 2001C can be used as a substitute in the current image formation (step S19). If it is judged that such recording sheets can be used as a substitute, the sheet feed request is assigned to any one of the paper feeders 2001A, 2001B and 2001C (step S20), and then the process proceeds to step S21.

On the contrary, if it is judged that such recording sheets cannot be used as a substitute, the process returns to step S13.

In step S21 shown in FIG. 17, a sheet feed request signal attached with information specifying any one of the paper feeders 2001A, 2001B and 2001C to which the sheet feed request has been assigned is outputted to all the paper feeders 2001A, 2001B and 2001C associated with the image forming apparatus 100. The purpose of this step is to cause all the paper feeders 2001A, 2001B and 2001C to start necessary operations for sheet feeding based on the sheet feed request signal received.

If the sheet feed request is assigned to the paper feeder 2001B for example, judgment is made as to whether or not the assigned paper feeder 2001B contains recording sheets (step S22). If the paper feeder 2001B is judged as containing recording sheets, then judgment is made as to whether or not the feed paths RA, RB and RC have been formed (step S23).

Judgment is made here as to whether or not the feed paths RA, RB and RC have been formed because these feed paths are formed by the upper surfaces of topmost recording sheets SA, SB and SC on respective sheet carrier plates 2002A, 2002B and 2002C or the upper surfaces of the sheet carrier plates 2002A, 2002B and 2002C.

Specifically, when feeding recording sheet SC from the paper feeder 2001C, recording sheet SC is transported to the image forming apparatus 100 by passing along the upper surface of topmost recording sheet SB on a recording sheet stack carried on the sheet carrier plate 2002B of the paper feeder 2001B or the upper surface of the sheet carrier plate 2002B not carrying any recording sheet thereon and along the upper surface of topmost recording sheet SA on a recording sheet stack carried on the sheet carrier plate 2002A of the paper feeder 2001A or the upper surface of the sheet carrier plate 2002A not carrying any recording sheet thereon. When feeding recording sheet SB from the paper feeder 2001B, recording sheet SB is transported to the image forming apparatus 100 by passing along the upper surface of topmost recording sheet SA on a recording sheet stack carried on the sheet carrier plate 2002A of the paper feeder 2001A or the upper surface of the sheet carrier plate 2002A not carrying any recording sheet thereon.

The judgment in step S23 as to whether or not the feed paths RA, RB and RC have been formed is made if, for example, a signal indicative of completion of preparation for sheet feeding outputted from each of the paper feeders 2001A, 2001B and 2001C is received.

If it is judged that the feed paths RA, RB and RC have been formed in step S23, the image forming apparatus 100 starts the image forming process including transmitting a sheet feed start request signal to the paper feeder 2001B for example (step S24). Subsequently, judgment is made as to whether or not the image forming process is to continue for another recording sheet (step S25). If it is judged that image formation is to continue for another recording sheet, the process returns to step S22. Alternatively, if it is not judged that image formation is to continue for another recording sheet in step S25, a signal indicative of termination of image formation is outputted to each of the paper feeders 2001A, 2001B and 2001C to terminate the image forming operation (step S26).

If it is judged that the feed paths RA, RB and RC have not been formed yet in step S23, the sheet feed request signal is outputted until the feed paths RA, RB and RC have been formed (step S27).

If the assigned paper feeder 2001B is judged as not containing recording sheets in step S22, judgment is made as to whether or not recording sheets stored in either of the other paper feeders 2001A and 2001B can be used as a substitute (step S28). If it is judged that such recording sheets can be used as a substitute, the paper feeder 2001A or 2001C of concern is set up to use its recording sheets (step S29), and then the process returns to step S21.

Alternatively, if it is judged that the recording sheets stored in the other paper feeders 2001A and 2001C cannot be used as a substitute in step S28, judgment is made as to whether or not recording sheets stored in the sheet feed cassette 102 or the like included in the image forming apparatus 100 can be used as a substitute in the current image formation (step S30).

If it is judged that such recording sheets can be used as a substitute, a sheet feed termination signal is outputted to the paper feeders 2001B (step S32) and then the sheet feed cassette 102 or the like is set up so as to be used for sheet feeding (step S33). Subsequently, the process returns to step S13.

On the contrary, if it is judged that such recording sheets cannot be used as a substitute, a signal indicative of suspension of the image forming operation is outputted to the assigned paper feeder 2001B (step S31) and then the process returns to step S21. Thus, the image forming operation is suspended until replenishment of recording sheets is made.

Figure 18:
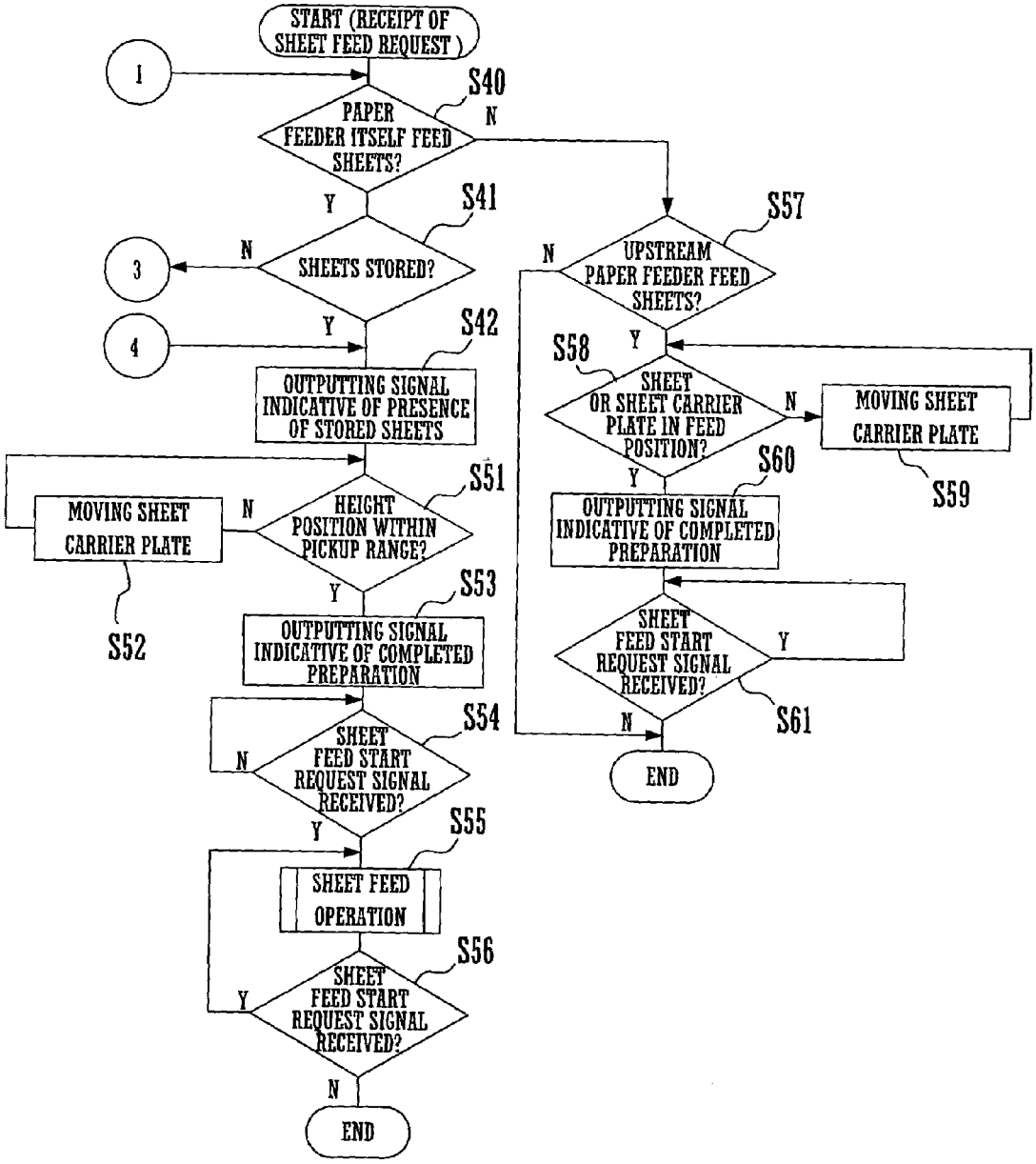
FIG. 18 is a flowchart of a sheet feed procedure following a receipt of a sheet feed request signal by the paper feeder shown in FIG. 13.
Figure 19:
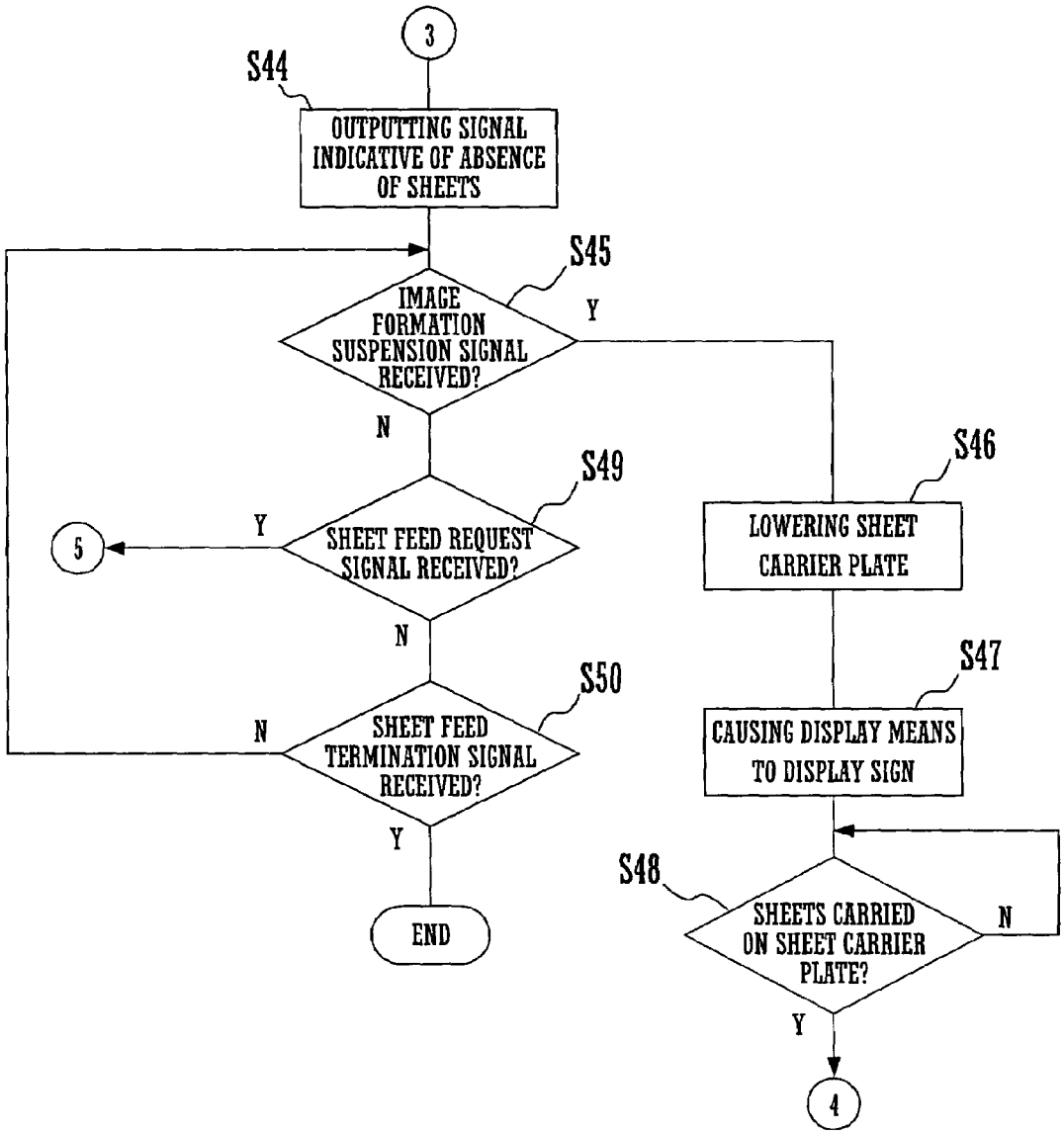
FIG. 19 is a flowchart of the sheet feed procedure following the receipt of the sheet feed request signal by the paper feeder shown in FIG. 13.

FIGS. 18 and 19 show a flowchart of a sheet feed procedure following a receipt of a sheet feed request signal by the paper feeder 2001B. When the paper feeder 2001B has received the sheet feed request signal from the image forming apparatus 100, the paper feeder 2001B judges whether itself or other paper feeders 2001A and 2001C have to feed recording sheets (step S40). If it is judged that the paper feeder 2001B itself has to feed recording sheets, judgment is made by using the optical sensor as to whether or not recording sheets are present on the sheet carrier plate 2002B (step S41).

If it is judged that recording sheets are present on the sheet carrier plate 2002B, the paper feeder 2001B outputs to the image forming apparatus 100 a signal indicative of the presence of recording sheets on the sheet carrier plate 2002B (step S42) and then the process proceeds to step S51. Alternatively, if it is judged that no recording sheet is present on the sheet carrier plate 2002B, the paper feeder 2001B outputs to the image forming apparatus 100 a signal indicative of the absence of any recording sheet on the sheet carrier plate 2002B (step S44).

Subsequently, judgment is made as to whether or not the signal indicative of suspension of the image forming operation has been received from the image forming apparatus 100 in step S45. If it is judged that the signal has been received, the sheet carrier plate 2002B is lowered to predetermined sheet replenishment position B (step S46). Further, the display means provided on the paper feeder 2001B is caused to display the sign prompting sheet replenishment (step S47).

Subsequently, judgment is made as to whether or not recording sheets have been placed on the sheet carrier plate 2002B (step S48). If not, the paper feeder 2001B waits until recording sheets are placed on the sheet carrier plate 2002B. If it is judged that recording sheets have been placed on the sheet carrier plate 2002B, the process proceeds to step S42.

If it is judged in step S45 that the signal indicative of suspension of the image forming operation has not been received, judgment is made as to whether or not a fresh sheet feed request signal has been received (step S49). The purpose of this step is to judge whether or not recording sheets stored in other paper feeder 2001A or 2001C are used as a substitute. If it is judged that the sheet feed request signal has been received, the process returns to step S40 since other paper feeder 2001A or 2001C starts feeding recording sheets stored therein.

Alternatively, if it is judged in step S49 that the sheet feed request signal has not been received, judgment is made as to whether or not the sheet feed termination signal has been received (step S50). If it is judged that the sheet feed termination signal has been received, the sheet feed operation is terminated. If it is judged in step S50 that the sheet feed termination signal has not been received, steps S45, S49 and S50 are repeated until any one of the associated signals has been received.

Subsequently, judgment is made in step S51 as to whether or not the height position of topmost recording sheet SB of a recording sheet stack on the sheet carrier plate 2002B is within the predetermined pickup range A. If the height position is judged as not falling within the predetermined pickup range A, the sheet carrier plate 2002B is lifted up and down until the height position of recording sheet SB reaches a height within the predetermined pickup range A (step S52).

Alternatively, if the height position is judged as falling within the predetermined pickup range A in step S51, a signal indicating that the preparation for sheet feeding has been completed is outputted to the image forming apparatus 100 (step S53).

Subsequently, judgment is made as to whether the sheet feed start request signal has been received (step S54). If it is judged that the sheet feed start request signal has not been received, step S54 is repeated until that signal is received. Alternatively, if it is judged that the sheet feed start request signal has been received, the sheet feed process including rotating the pickup roller 2003B (step S55) is started.

Subsequently, judgment is made as to whether or not another sheet feed start request signal has been received successively (step S56). If it is judged that the signal has been received, sheet feed step S55 is repeated until the sheet feed start request is stopped. Alternatively, if it is judged in step S56 that the signal has not been received, the sheet feed operation is terminated.

If it is judged in step S40 that other paper feeder 2001A or 2001C has to feed recording sheets, judgment is made as to whether or not the upstream paper feeder 2001C has to feed recording sheets (step S57). If it is judged that the upstream paper feeder 2001C has to feed recording sheets, judgment is made as to whether or not the height position of the upper surface of topmost recording sheet SB of the sheet stack on the sheet carrier plate 2002B or the height position of the upper surface of the sheet carrier plate 2002B not carrying any recording sheet thereon is within the predetermined pickup range A (step S58). That is, judgment is made as to whether or not a part of the feed paths RA, RB and RC has been formed.

If it is judged in step S57 that the downstream paper feeder 2001A has to feed recording sheets, the sheet feed operation of the paper feeder 2001B is terminated.

If the height position of the upper surface of topmost recording sheet SB or the height position of the upper surface of the sheet carrier plate 2002B is judged as not falling within the predetermined pickup range A, the sheet carrier plate 2002B is lifted up and down until the height position of the upper surface of topmost recording sheet SB or the height position of the upper surface of the sheet carrier plate 2002B reaches a height within the predetermined pickup range A (step S59). Alternatively, if the height position of the upper surface of topmost recording sheet SB or the height position of the upper surface of the sheet carrier plate 2002B is judged as falling within the predetermined pickup range A in step S58, the signal indicating that the preparation for sheet feeding has been completed is outputted to the image forming apparatus 100 (step S60).

Subsequently, judgment is made in step S61 as to whether or not the image forming operation has to be terminated by, for example, judging whether or not a fresh sheet feed request signal has been received. If it is judged that the fresh signal has been received, step S61 is repeated until the sheet feed request signal is stopped. That is, the current state is maintained until termination of the image forming operation.

As described above, the height position of the upper surface of topmost recording sheet SB of the sheet stack on the sheet carrier plate 2002B or the height position of the upper surface of the sheet carrier plate 2002B not carrying any recording sheet thereon is thus set within the predetermined pickup range A during sheet feeding from the paper feeder 2001C located upstream of the paper feeder 2001B. By so doing, sheet members can be properly fed from the upstream paper feeder 2001C without the occurrence of jam even when the sheet carrier plate 2002B is not carrying any recording sheet thereon. This holds true for the paper feeder 2001A in the feeding of recording sheets from the upstream paper feeder 2001B or 2001C.

Further, the height position of the upper surface of topmost recording sheet SB of the sheet stack on the sheet carrier plate 2002B or the height position of the upper surface of the sheet carrier plate 2002B not carrying any recording sheet thereon is kept at the predetermined sheet replenishment position B during periods other than the feed path RB forming period. Thus, the user is allowed to place recording sheets on the sheet carrier plate 2002B as soon as sheet replenishment becomes required.

The above-described features make it possible to ensure satisfactory performance in feeding recording sheets from another paper feeder 2001A, 2001B or 2001C as well as to keep easiness for the user to place recording sheet on the sheet carrier plate.

In this embodiment, the height position of the upper surface of topmost recording sheet SB of the sheet stack on the sheet carrier plate 2002B or the height position of the upper surface of the sheet carrier plate 2002B not carrying any recording sheet thereon is set within the predetermined pickup range A only during sheet feeding from the paper feeder 2001C for example. However, there is no limitation to this feature. It is possible that the height position of the upper surface of topmost recording sheet SB of the sheet stack on the sheet carrier plate 2002B or the height position of the upper surface of the sheet carrier plate 2002B not carrying any recording sheet thereon is set within the predetermined pickup range A during a period from the time immediately after receipt of an image formation request from the user until the image forming operation has been completely terminated.

Alternatively, the height position of the upper surface of topmost recording sheet SB of the sheet stack on the sheet carrier plate 2002B or the height position of the upper surface of the sheet carrier plate 2002B not carrying any recording sheet thereon may be set within the predetermined pickup range A during periods other than the sheet replenishment period. By so doing, the sheet feed operation can be started immediately without the need to wait for such a height position to move into the predetermined pickup range A and, hence, the image forming apparatus 100 also can start its image forming process immediately.

Further, since the height position of the upper surface of topmost recording sheet SB of the sheet stack on the sheet carrier plate 2002B or the height position of the upper surface of the sheet carrier plate 2002B not carrying any recording sheet thereon is set within the predetermined pickup range A only during sheet feeding from the upstream paper feeder 2001C for example, part of the feed path RB can be formed for a period during which the feed path RB is necessary and, hence, the frequency of up-and-down movement of the sheet carrier plate 2002B and recording sheet SB can be minimized.

Accordingly, the power consumption for driving the lift-up mechanism in lifting up and down the sheet carrier plate 2002B can be reduced. Further, it is possible to reduce the load to be imposed on the lift-up mechanism in moving the sheet carrier plate 2002B and recording sheet SB.

Moreover, since the user is prompted to replenish recording sheets by means of the display means when no recording sheet is carried on the sheet carrier plate 2002B, the length of time for which no recording sheet is carried on the sheet carrier plate 2002B is shortened, whereby the frequency of up-and-down movement of the sheet carrier plate 2002B can be reduced.

Figure 20:
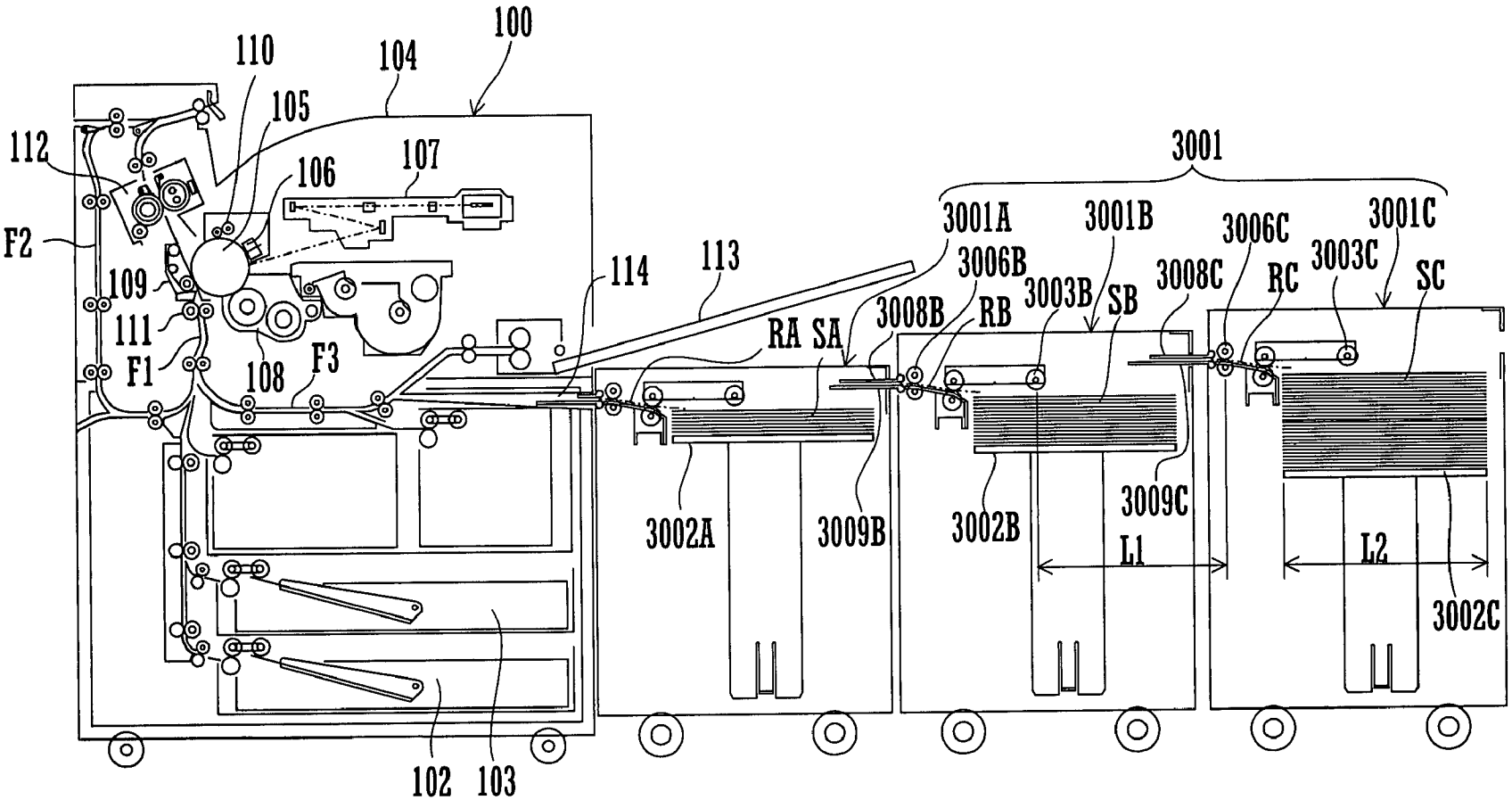
FIG. 20 is a sectional view schematically showing the construction of a paper feeder according to a fourth embodiment of the present invention.

A paper feeder 3001 according to a fourth embodiment of the present invention will be described with reference to the accompanying drawings. Referring to FIG. 20, the paper feeder 3001 includes plural (three in this embodiment) paper feeder units 3001A, 3001B and 3001C. These paper feeder units 3001A, 3001B and 3001C are arranged in a row extending in the sheet feed direction laterally of image forming apparatus 100 as the processing apparatus configured to perform image formation on recording sheets, or sheet members.

Each of the sheet members to be fed from the paper feeder 3001A, 3001B, or 3001C to the image forming apparatus 100 is not limited to such a recording sheet but may be an OHP film or the like. The paper feeder units 3001A, 3001B and 3001C stores therein recording sheets of the same size.

The image forming apparatus 100, which is configured to form an image on each recording sheet through the electrophotographic image forming process, is identical with that shown in FIG. 3.

Figure 21:
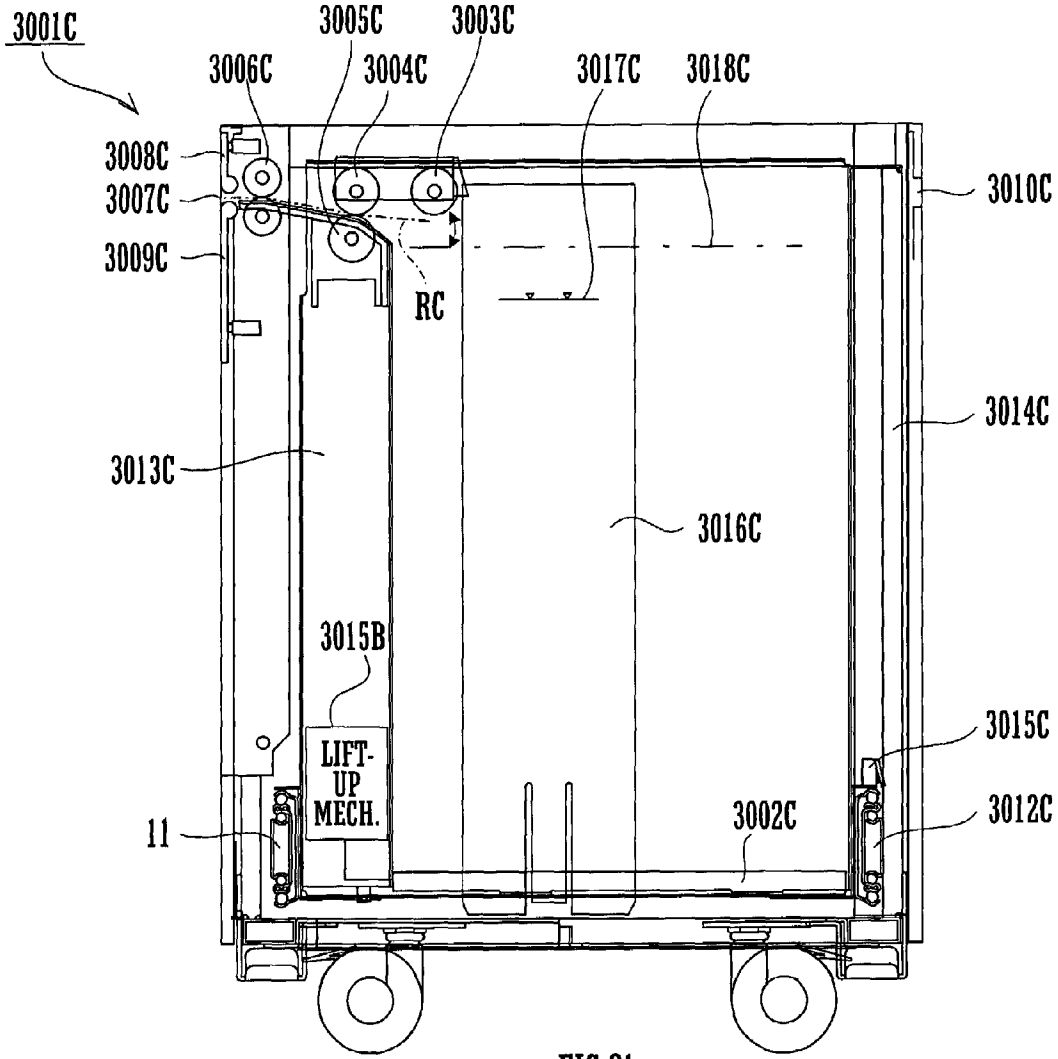
FIG. 21 is a sectional view schematically showing the construction of a paper feeder unit included in the paper feeder.

Referring to FIG. 21, the paper feeder unit 3001C includes a sheet carrier plate 3002C, a pickup roller 3003C corresponding to the pickup member defined by the present invention, a feed roller 3004C, a reverse roller 3005C, a transport roller 3006C corresponding to the transport member defined by the present invention, a delivery section 3007C, paper guides 3008C and 3009C forming the guide member defined by the present invention, and a receiving section 3010C. Each of these members functions like the corresponding one of the sheet carrier plate 2B, pickup roller 3B, feed roller 4B, reverse roller 5B, transport roller 6B, delivery section 7B, paper guides 8B and 9B and receiving section 10B of the paper feeder 1B shown in FIG. 1.

The paper feeder units 3001A and 3001B are each similar in construction to the paper feeder 3001C except the difference in height. The paper feeder unit 3001B is constructed so that the receiving section 3010B thereof is positioned at the same height as the delivery section 3007C of the paper feeder unit 3001C. Likewise, The paper feeder unit 3001A is constructed so that the receiving section 3010A thereof is positioned at the same height as the delivery section 3007B of the paper feeder unit 3001B.

The sheet carrier plates 3002A, 3002B and 3002C of the respective paper feeders units 3001A, 3001B and 3001C are arranged so that the height position of upper surface of the topmost recording sheet on the sheet carrier plate of a farther one of the paper feeder units 3001A, 3001B and 3001C from the image forming apparatus 100 is higher than the height position of upper surface of the topmost recording sheet on the sheet carrier plate of a closer one of the paper feeder units 3001A, 3001B and 3001C to the image forming apparatus 100. The paper guides 3008A and 3009A of the paper feeder unit 3001A immediately adjacent to the image forming apparatus 100 are inserted into sheet receiving section 114 of the image forming apparatus 100.

The paper feeder units 3001A, 3001B and 3001C thus constructed are arranged in a row laterally of the image forming apparatus 100. The paper feeder unit 3001A has a height lower than the height position of manual feed tray 113 of the image forming apparatus 100 so as to feed each recording sheet into the sheet receiving section 114 of the image forming apparatus 100 without interference with the manual feed tray 113. The following description is directed to the relation between the paper feeder unit 3001B and the paper feeder unit 3001C, which is the same as the relation between the paper feeder unit 3001A and the paper feeder unit 3001B. Recording sheets are transported leftwardly in FIG. 21.

The paper feeder units 3001B and 3001C are arranged side by side so that the receiving section 3010B of the paper feeder unit 3001B located downstream in the sheet feed direction faces the delivery section 3007C of the paper feeder unit 3001C located upstream in the sheet feed direction. The pair of paper guides 3008B and 3009B of the paper feeder unit 3001B are inserted into the receiving section 3010A of the paper feeder unit 3001A located immediately downstream of the paper feeder unit 3001B. Likewise, the pair of paper guides 3008C and 3009C of the paper feeder unit 3001C are inserted into the receiving section 3010B of the paper feeder unit 3001B located immediately downstream of the paper feeder 3001C unit. By so doing, the feed paths RA, RB and RC of the respective paper feeder units 3001A, 3001B and 3001C become continuous with each other for communication.

Figure 22:
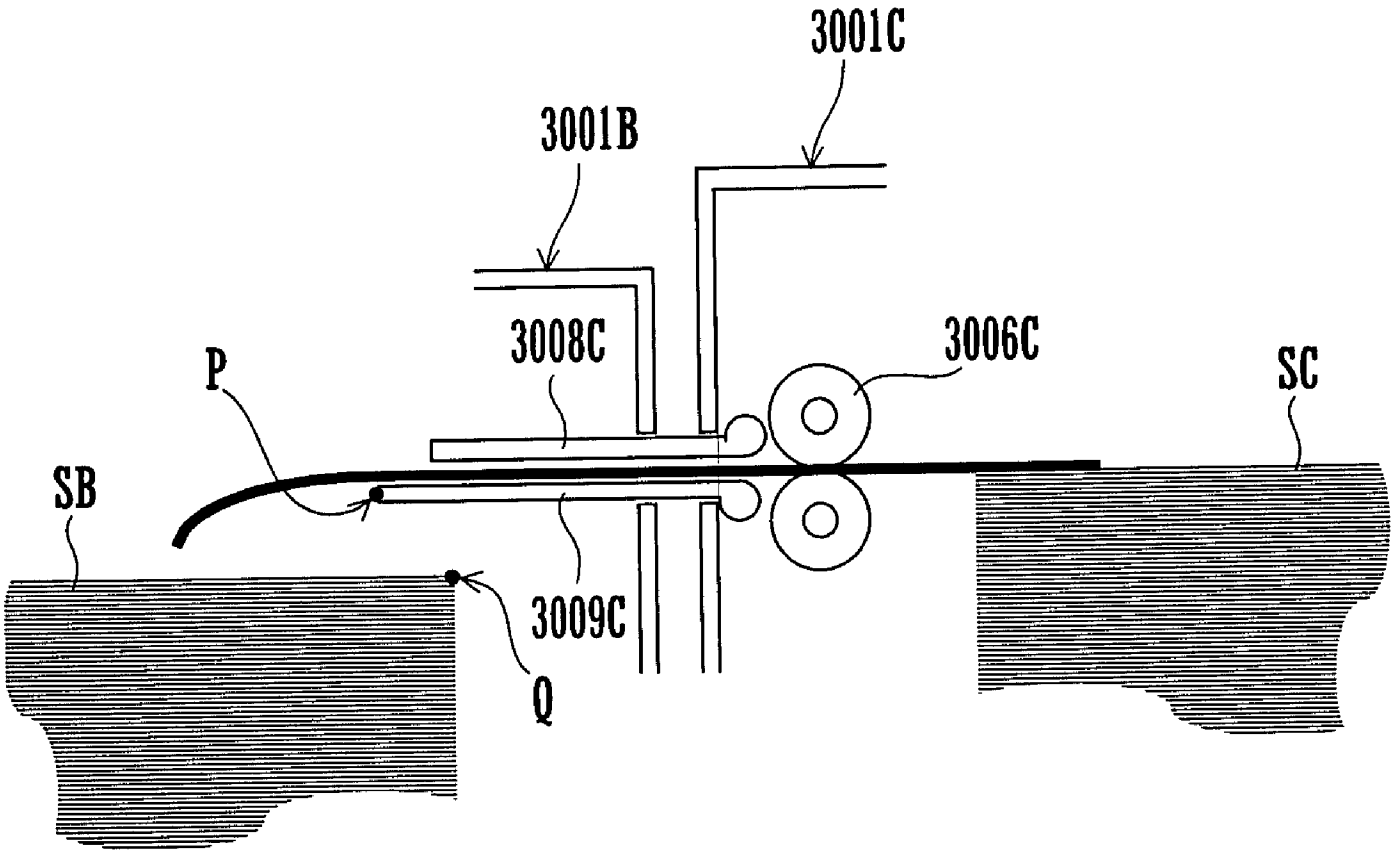
FIG. 22 is a fragmentary enlarged view of the paper feeder.

FIG. 22 is an enlarged fragmentary view of the paper feeder 3001. The paper guides 3008C and 3009C of the paper feeder unit 3001C are formed such that when the pair of paper guides 3008C and 3009C is inserted into the receiving section 3010B of the paper feeder unit 3001B, its downstream end P becomes positioned above the upper surface of topmost recording sheet SB of a sheet stack carried on the sheet carrier plate 3002B of the paper feeder unit 3001B and downstream from the upstream edge Q of the recording sheet SB. This feature makes it possible to smoothly transport recording sheet SC fed from the paper feeder unit 3001C onto the upper surface of topmost recording sheet SB while preventing the recording sheet SC from colliding with the sheet stack stored in the paper feeder unit 3001B.

As shown in FIG. 20, distance L1 between the pickup roller 3003B of the paper feeder unit 3001B and the transport roller 3006C of the paper feeder unit 3001C is set shorter than dimension L2 of each recording sheet parallel with the sheet feed direction. For example, the pickup roller 3003C is positioned to pick up each recording sheet on the sheet carrier plate 3002C at a location spaced 50-60 mm upstream from the downstream edge of topmost recording sheet SC. Accordingly, while recording sheet SC is gripped and transported by the transport roller 3006C of the paper feeder unit 3001C, the recording sheet SC is also picked up by the pickup roller 3003B of the paper feeder unit 3001B. Therefore, when feeding a recording sheet through the paper feeder units 3001B and 3001C, the feeding force is exerted on the recording sheet without break, thus preventing the occurrence of jam during feeding.

Recording sheet SC fed from the paper feeder unit 3001C and then received by the paper feeder unit 3001B is guided onto the upper surface of topmost recording sheet SB of the stack of recording sheets stored in the paper feeder unit 3001B. That is, the upper surface of the recording sheet SB forms part of the feed path RB. In the absence of any recording sheet on the sheet carrier plate 3002B, recording sheet SC is guided onto the upper surface of the sheet carrier plate 3002B. In this case the upper surface of the sheet carrier plate 3002B forms part of the feed path RB.

Recording sheet SC being fed along the upper surface of topmost recording sheet SB of the sheet stack carried on the sheet carrier plate 3002B of the paper feeder unit 3001B by the driving force of the transport roller 3006C of the paper feeder unit 3001C is picked up by the pickup roller 3003B of the paper feeder unit 3001B configured to descend with predetermined timing while being gripped by the transport roller 3006C of the paper feeder unit 3001C. Subsequently, recording sheet SC is fed by the pickup roller 3003B of the paper feeder unit 3001B and then fed further downstream by the transport roller 3006B of the paper feeder unit 3001B.

Thus, each recording sheet stored in the paper feeder unit 3001C is fed to the image forming apparatus 100 through the feed path RC of the paper feeder unit 3001C and then the feed paths RB and RA of respective of the downstream paper feeder units 3001B and 3001A sequentially. That is, the feed path RA of the paper feeder unit 3001A is used to feed recording sheets stored in the paper feeder unit 3001A as well as recording sheets stored in the upstream paper feeder units 3001B and 3001C, while the feed path RB of the paper feeder unit 3001B is used to feed recording sheets stored in the paper feeder unit 3001B as well as recording sheets stored in the upstream paper feeder unit 3001C.

The paper feeder 3001 is configured such that the topmost surface of a recording sheet stack stored within the most upstream paper feeder unit 3001C is positioned higher than that of a recording sheet stack stored within the immediately downstream paper feeder unit 3001B while the topmost surface of a recording sheet stack stored within the most downstream paper feeder unit 3001A is positioned lower than that of the recording sheet stack stored within the immediately upstream paper feeder unit 3001B. This configuration makes it possible to prevent each recording sheet from colliding with a sheet stack during feeding as well as to transport recording sheet SC fed from the upstream paper feeder unit 3001C onto the upper surface of topmost recording sheet SB stored in the downstream paper feeder unit 3001B and then guide the recording sheet SC downstream along the upper surface of the recording sheet SB smoothly.

Further, the paper feeder 3001 prevents each recording sheet from curving in the sheet feed direction and hence being imparted with undesirable warp, thereby making it possible to inhibit the occurrence of skew feeding and the occurrence of jam during feeding. Also, since the upper surfaces of respective of topmost recording sheets SA and SB form parts of the feed paths RA and RB, there is no need to provide a feed path separately, which will result in the paper feeder 3001 made compact.

Further, since the paper feeder 3001 is configured such that the delivery sections 3007B and 3007C communicate with the receiving sections 3010A and 3010B, respectively, it is possible to make the feed paths RA, RB and RC of the respective paper feeder units 3001A, 3001B and 3001C continuous with each other.

Further, since the delivery sections 3007B and 3007C are each provided with a respective one of the pair of paper guides 3008B and 3009B and the pair of paper guides 3008C and 3009C, each recording sheet delivered from the delivery section 3007B or 3007C can be guided into the feed path RA or RB smoothly, whereby the occurrence of jam during feeding can be further inhibited.

Furthermore, since each recording sheet is gripped by the pickup roller 3003A or 3003B while being gripped by the transport roller 3006B or 3006C, the feeding force is exerted on the recording sheet without break, whereby the occurrence of jam during feeding can be suppressed.

In case of the occurrence of jam of a recording sheet to be fed to the image forming apparatus 100, toner undesirably adheres to transfer device 109 in the transfer section of the image forming apparatus 100, which causes a transfer failure to occur in the succeeding process. In such a case, unfixed toner, which has not been transferred to a recording sheet, is collected in an increased amount by cleaning unit 110 disposed adjacent photosensitive drum 105, thus imposing increased load on the cleaning unit 110. Further, such unfixed toner is likely to scatter within the image forming apparatus 100. As described above, the occurrence of sheet jam during feeding gives rise to various problems including a transfer failure in the image forming apparatus 100, increased load on the cleaning unit 110 and scattering of toner within the image forming apparatus 100, thus resulting in increased printing cost per recording sheet. The paper feeder 3001 according to the present invention, which can suppress the occurrence of sheet jam during feeding, can suppress the occurrences of the aforementioned problems thereby decreasing the printing cost per recording sheet.

While the above-described embodiment has the pair of paper guides 3008C and 3009C which is formed such that its downstream end P can be positioned above the upper surface of topmost recording sheet SB of a sheet stack carried on the sheet carrier plate 3002B of the immediately downstream paper feeder unit 3001B and downstream from the upstream edge Q of the recording sheet SB, there is not limitation to this feature.

Figure 23:
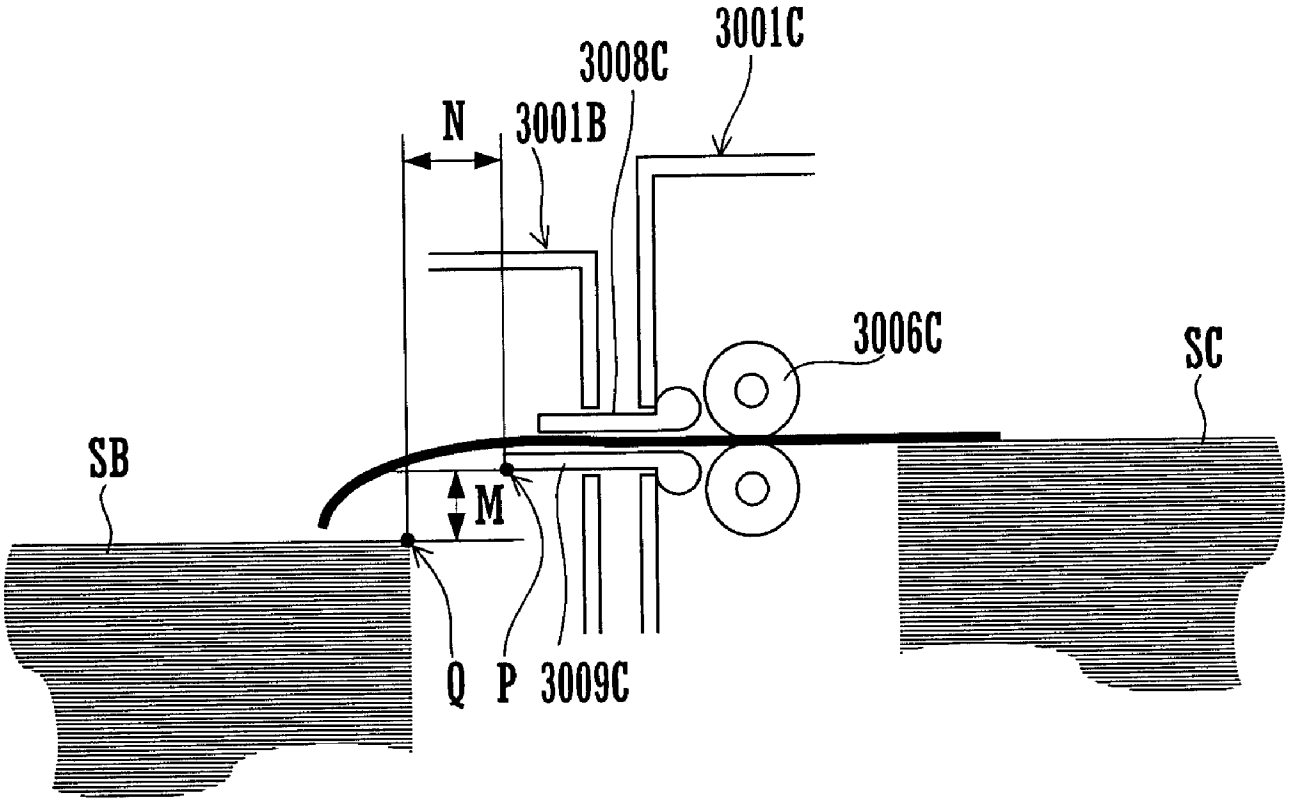
FIG. 23 is a fragmentary enlarged view showing the structure of a variation of the paper feeder.

For example, the pair of paper guides 3008C and 3009C may be formed such that its downstream end P can be positioned above the upper surface of recording sheet SB stored in the paper feeder unit 3001B with a predetermined distance M therebetween and a predetermined distance N apart upstream from the upstream edge Q of recording sheet SB, as shown in FIG. 23.

In this case the distances M and N are determined based on the thickness, size and water content of each recording sheet and the like. The distances M and N are set substantially equal to each other in many cases so that the downstream edge portion of recording sheet SC having passed through the paper guides 3008C and 3009C is fed onto the upper surface of recording sheet SB even when bent down. Each of the distances M and N is set within the range from several millimeters to the order of 10 millimeters.

As the distances M and N decrease, the difference in height among the paper feeder units 3001A to 3001C decreases. Accordingly, in the case where the pair of paper guides 3008C and 3009C are formed such that its downstream end P can be positioned above the upper surface of topmost recording sheet SB of a sheet stack stored in the immediately downstream paper feeder unit 3001B and downstream from the upstream edge Q of the recording sheet SB as shown in FIG. 22, it is possible to suppress the occurrence of sheet jam during feeding as well as to minimize the differences in height among the paper feeder units 3001A to 3001B.

Figure 24:
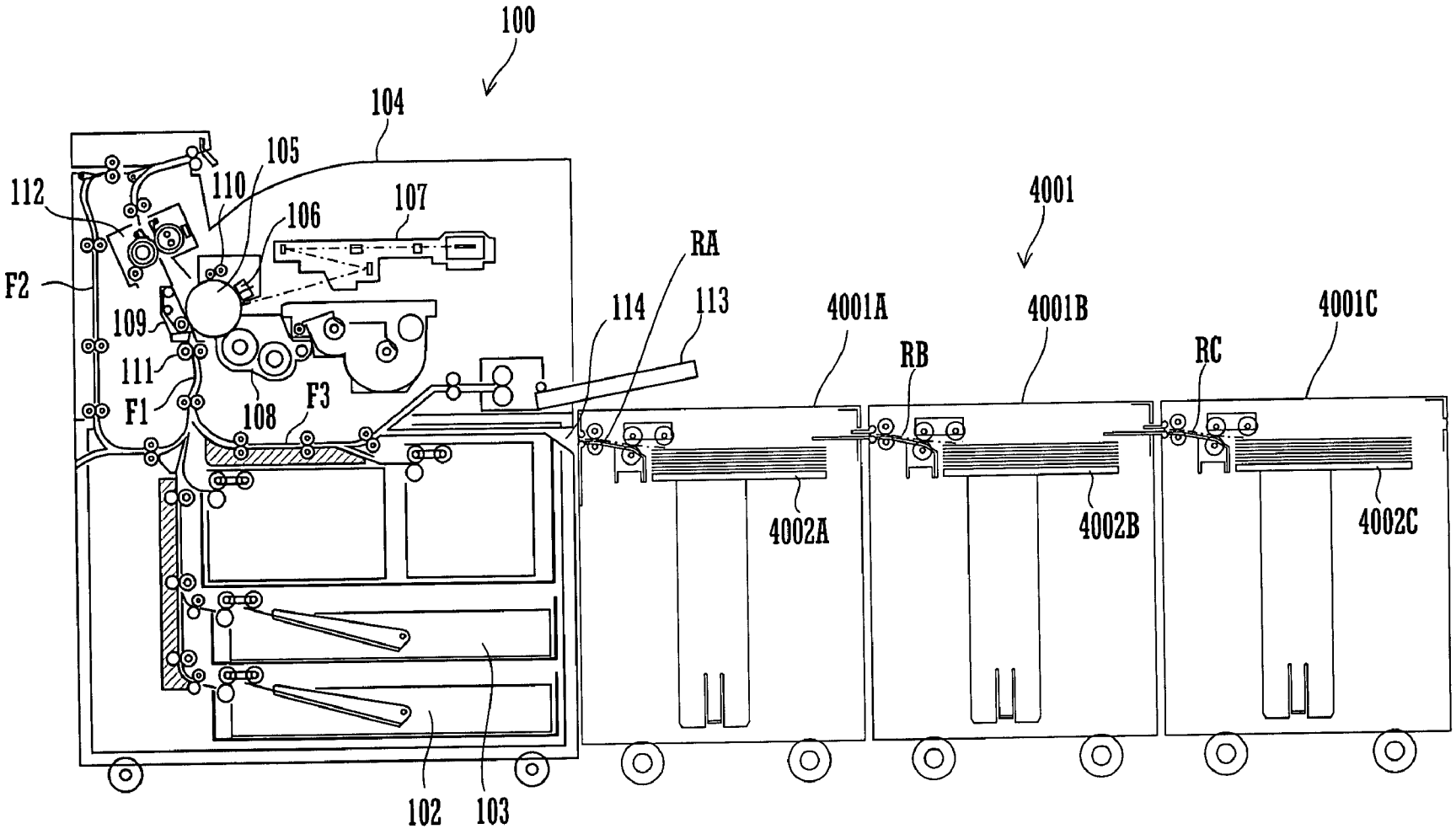
FIG. 24 is a view showing a paper feeder according to a fifth embodiment of the present invention as coupled to image forming apparatus.

A paper feeder 4001 according to a fifth embodiment of the present invention is laterally coupled to image forming apparatus 100 as one example of the processing apparatus, as shown in FIG. 24. The image forming apparatus 100 shown is identical with that shown in FIG. 3.

Figure 25:
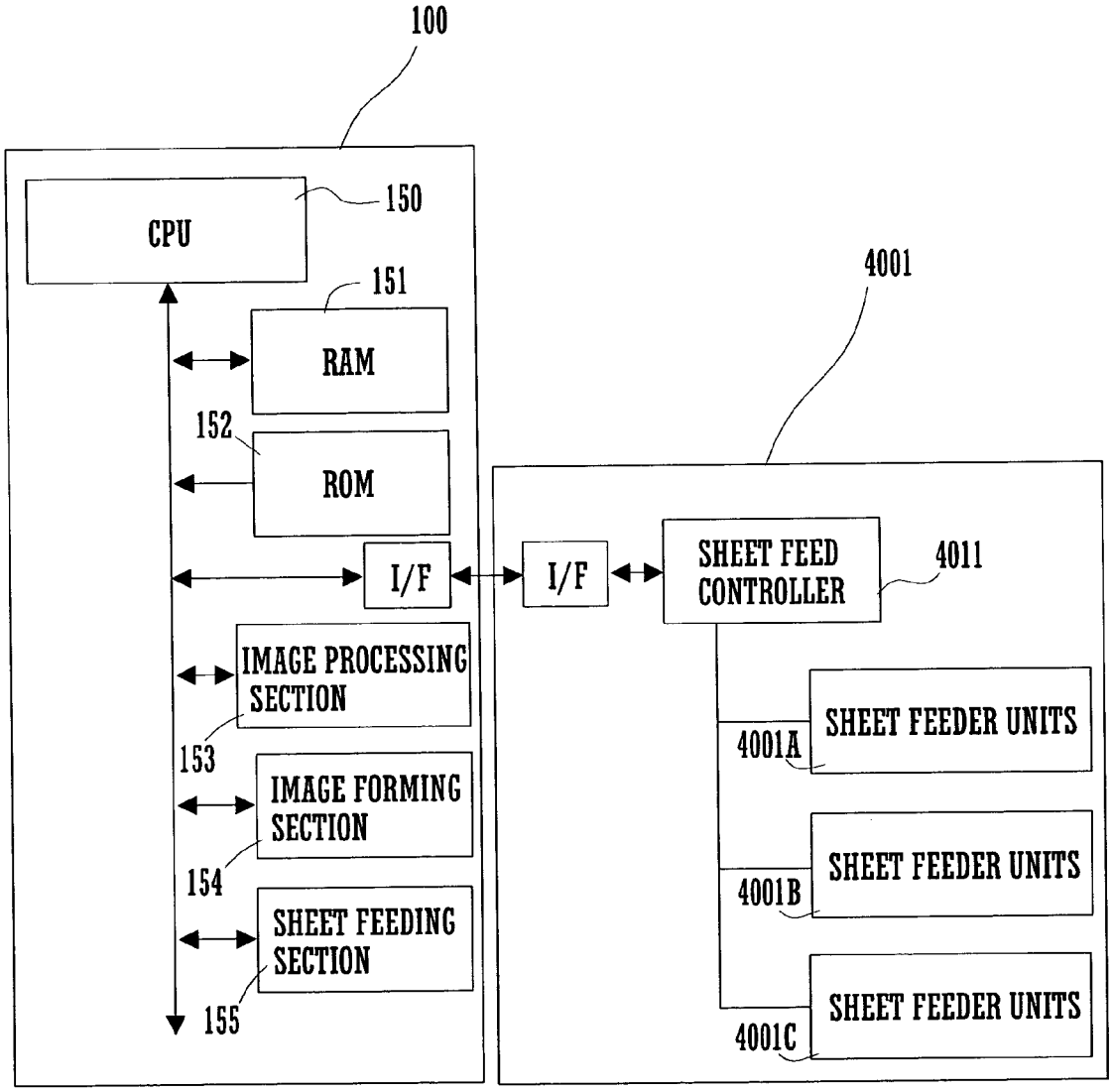
FIG. 25 is a block diagram schematically illustrating the configurations of the paper feeder and the image forming apparatus.

FIG. 25 shows the configuration of the main part of each of image forming apparatus 100 and paper feeder 4001. The image forming apparatus 100 includes CPU 150, RAM 151, ROM 152, image processing section 153, image forming section 154, and sheet feeding section 155. RAM 151 is nonvolatile memory for temporarily storing data therein. ROM 152 has stored therein a program required for the operation of the image forming apparatus 100. The image processing section 153 performs image processing following a predetermined procedure based on image data inputted thereto. The image forming section 154 carries out an image forming process on a recording sheet based on the image data transferred from the image processing section 153. The sheet feeding section 155 feeds each recording sheet to the image forming section 154.

The paper feeder 4001 includes a sheet feed controller 4011 and sheet feeder units 4001A, 4001B and 4001C. The sheet feed controller 4011 causes each of the sheet feeder units 4001A, 4001B and 4001C according to signals from the CPU 150. In the present embodiment each of the sheet feeder units 4001A, 4001B and 4001C constitutes the sheet storage section defined by the present invention.

Figure 26:
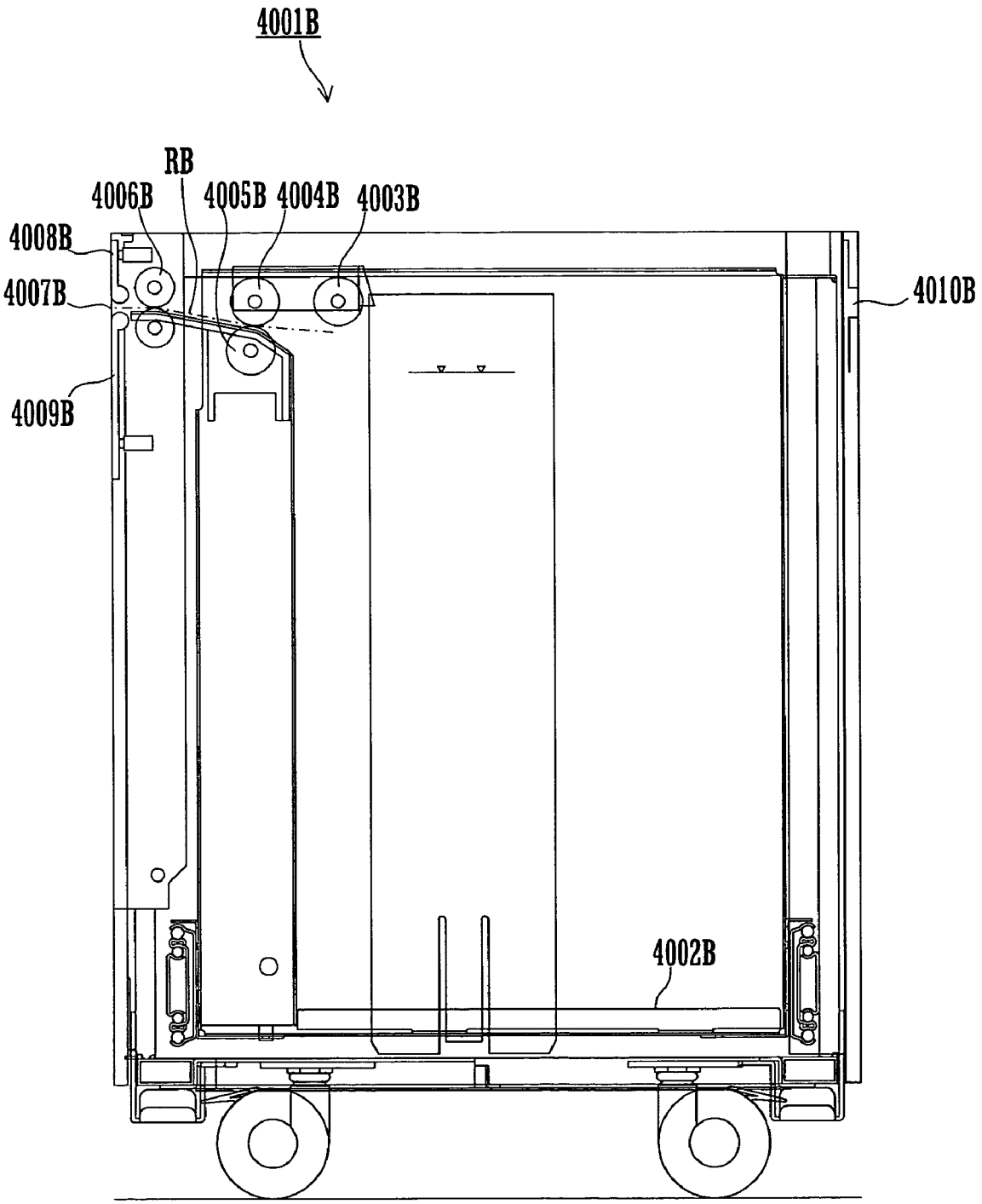
FIG. 26 is a view schematically showing the construction of a sheet feeder unit included in the paper feeder.

FIG. 26 is a view schematically showing the construction of sheet feeder unit 4001B according to this embodiment. The other sheet feeder units 4001A and 4001C are basically the same in construction as the paper feeder unit 4001B. For this reason, description thereof will be omitted. The paper feeder unit 4001B according to the present embodiment includes a sheet carrier plate 4002B, a lift-up mechanism (not shown), a pickup roller 4003B, a feed roller 4004B, a reverse roller 4005B, a transport roller 4006B, a delivery section 4007B, paper guides 4008B and 4009B, and a receiving section 4010B.

Each of these members functions like the corresponding one of the sheet carrier plate 2B, pickup roller 3B, feed roller 4B, reverse roller 5B, transport roller 6B, delivery section 7B, paper guides 8B and 9B and receiving section 10B of the paper feeder 1B shown in FIG. 1.

Figure 27:
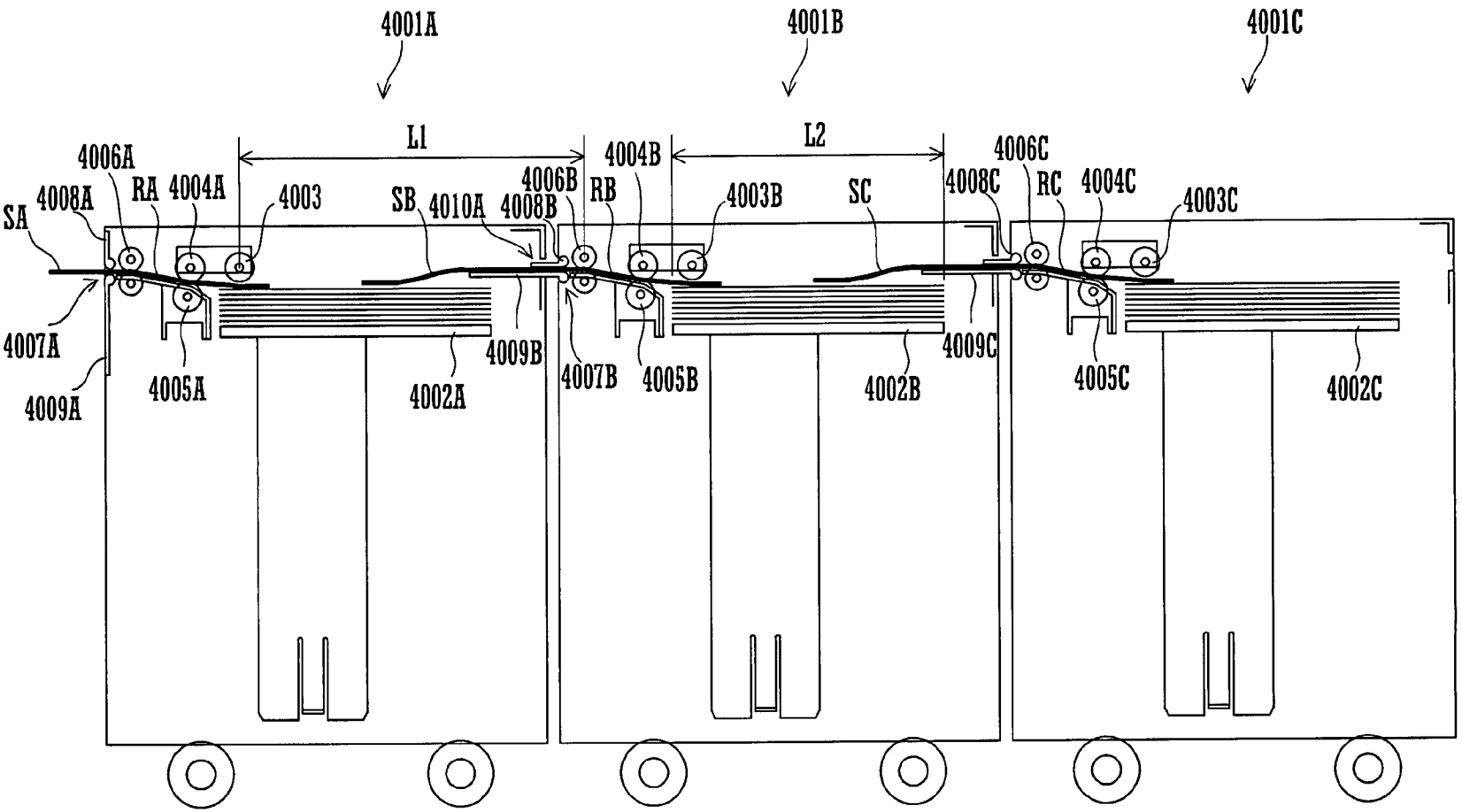
FIG. 27 is a view showing the construction of the paper feeder.

The sheet feeder units 4001A, 4001B and 4001C are arranged in a row as shown in FIG. 27. When the sheet feeder units 4001A and 4001B are coupled to each other, the receiving section 4010A of the sheet feeder unit 4001A faces the delivery section 4007B of the sheet feeder unit 4001B.

In forming the paper feeder 4001 by coupling the sheet feeder units 4001A, 4001B and 4001C to each other, the pair of paper guides 4008A and 4009A of the paper feeder unit 4001A is made to assume its collapsed position, while each of the pair of paper guides 4008B and 4009B and the pair of paper guides 4008C and 4009C made to assume its use position.

Accordingly, the pair of paper guides 4008B and 4009B is inserted into the receiving section 4010A of the sheet feeder unit 4001A. Similarly, the pair of paper guides 4008C and 4009C is inserted into the receiving section 4010B of the sheet feeder unit 4001A.

The paper guide 4009C for guiding the underside of each recording sheet is sized so as to be capable of guiding recording sheet SC onto the upper surface of topmost recording sheet SB of a stack of recording sheets carried on the sheet carrier plate 4002B of the sheet feeder unit 4001B. Similarly, the paper guide 4009B for guiding the underside of each recording sheet is sized so as to be capable of guiding recording sheet SB or SC onto the upper surface of topmost recording sheet SA of a stack of recording sheets carried on the sheet carrier plate 4002A of the sheet feeder unit 4001A. When the paper guides 4008B and 4009B of the sheet feeder unit 4001B are inserted into the receiving section 4010A of the sheet feeder unit 4001A, the feed path RB of the upstream sheet feeder unit 4001B and the feed path RA of the downstream sheet feeder unit 4001A become continuous with each other so as to communicate with each other.

In the present embodiment, the receiving section 4010A, feed path RB and paper guides 4008B and 4009B constitute an intermediate sheet feed path according to the present invention. Similarly, the receiving section 4010B, feed path RC and paper guides 4008C and 4009C constitute an intermediate sheet feed path according to the present invention.

In the state where the sheet feeder units 4001A and 4001B are arranged side by side, distance L1 between the pickup roller 4003A of the sheet feeder unit 4001A and the transport roller 4006B of the upstream sheet feeder unit 4001B is set shorter than dimension L2 of each recording sheet parallel with the sheet feed direction as in the paper feeder 3001 shown in FIG. 20.

Each recording sheet fed from the upstream sheet feeder unit 4001B and then received into the receiving section 4010A of the sheet feeder unit 4001A is guided onto the upper surface of topmost recording sheet SA of the stack of recording sheets stored in the sheet feeder unit 4001A. That is, the upper surface of topmost recording sheet SA on the sheet carrier plate 4002A forms part of the feed path interconnecting the image forming apparatus 100 and the sheet feeder units 4001A, 4001B and 4001C.

Recording sheet SB being fed along the upper surface of topmost recording sheet SA of the sheet stack carried on the sheet carrier plate 4002A of the sheet feeder unit 4001A by the driving force of the transport roller 4006B of the sheet feeder unit 4001B is gripped at its downstream edge portion and picked up by the pickup roller 4003A of the sheet feeder unit 4001A configured to descend with predetermined timing while being gripped by the transport roller 4006B of the sheet feeder unit 4001B. Then, the recording sheet SB is further fed downstream by the transport roller 4006A of the sheet feeder unit 4001A.

As described above, in the paper feeder 4001 according to the present invention each recording sheet stored in the sheet feeder unit 4001B is fed to the image forming apparatus 100 through the feed paths RB and RA of respective of the sheet feeder units 4001B and 4001A sequentially. That is, the feed path RA of the downstream sheet feeder unit 4001A is used to feed recording sheets stored in the sheet feeder unit 4001A as well as recording sheets stored in the sheet feeder units 4001B and 4001C.

The sheet feeder unit 4001A is disposed adjacent to the image forming apparatus 100 so that the delivery section 4007A thereof faces the sheet receiving section 114 of the image forming apparatus 100. Each recording sheet stored in the sheet feeder unit 4001A, 4001B or 4001C is fed to the sheet transport path F3 through the sheet receiving section 114 of the image forming apparatus 100 and then transported to the transfer position. Each recording sheet stored in the sheet feeder unit 4001C for example is passed through the feed path RC of the sheet feeder unit 4001C, feed path RB of the sheet feeder unit 4001B and feed path RA of the sheet feeder unit 4001A sequentially, received into the image forming apparatus 100 through the sheet receiving section 114, and then transported to the transfer position.

Since the sheet feeder units 4001A, 4001B and 4001C of the paper feeder 4001 can be horizontally arranged in a row laterally of the image forming apparatus 100, the feed paths RA, RB and RC form a substantially straight line. Therefore, the paper feeder 4001 can feed each recording sheet through the feed paths RA, RB and RC with less possibility of curving, thereby inhibiting the occurrence of jam during feeding. Further, it is less likely that each recording sheet is imparted with undesirable stiffness due to curving during feeding, since the possibility that the recording sheet is curved during feeding is very low. Thus, the occurrence of an image formation failure in the image forming apparatus 100 is not likely.

Further, in the paper feeder 4001, the upper surface of each of topmost recording sheets SA, SB and SC on respective sheet carrier plates 4002A, 4002B and 4002C forms part of the feed paths RA, RB and RC. This feature eliminates the need to provide a feed path separately and hence allows the paper feeder 4001 to be downsized.

Each of the sheet members to be stored in the paper feeder 4001 and fed therefrom to the processing apparatus is not limited to a recording sheet but may be an OHP film or the like. Also, the processing apparatus to be fed with such sheet members by the paper feeder 4001 is not limited to an image forming apparatus. The paper feeder 4001 can be used with any processing apparatus which performs processing on such sheet members.

Figure 28:
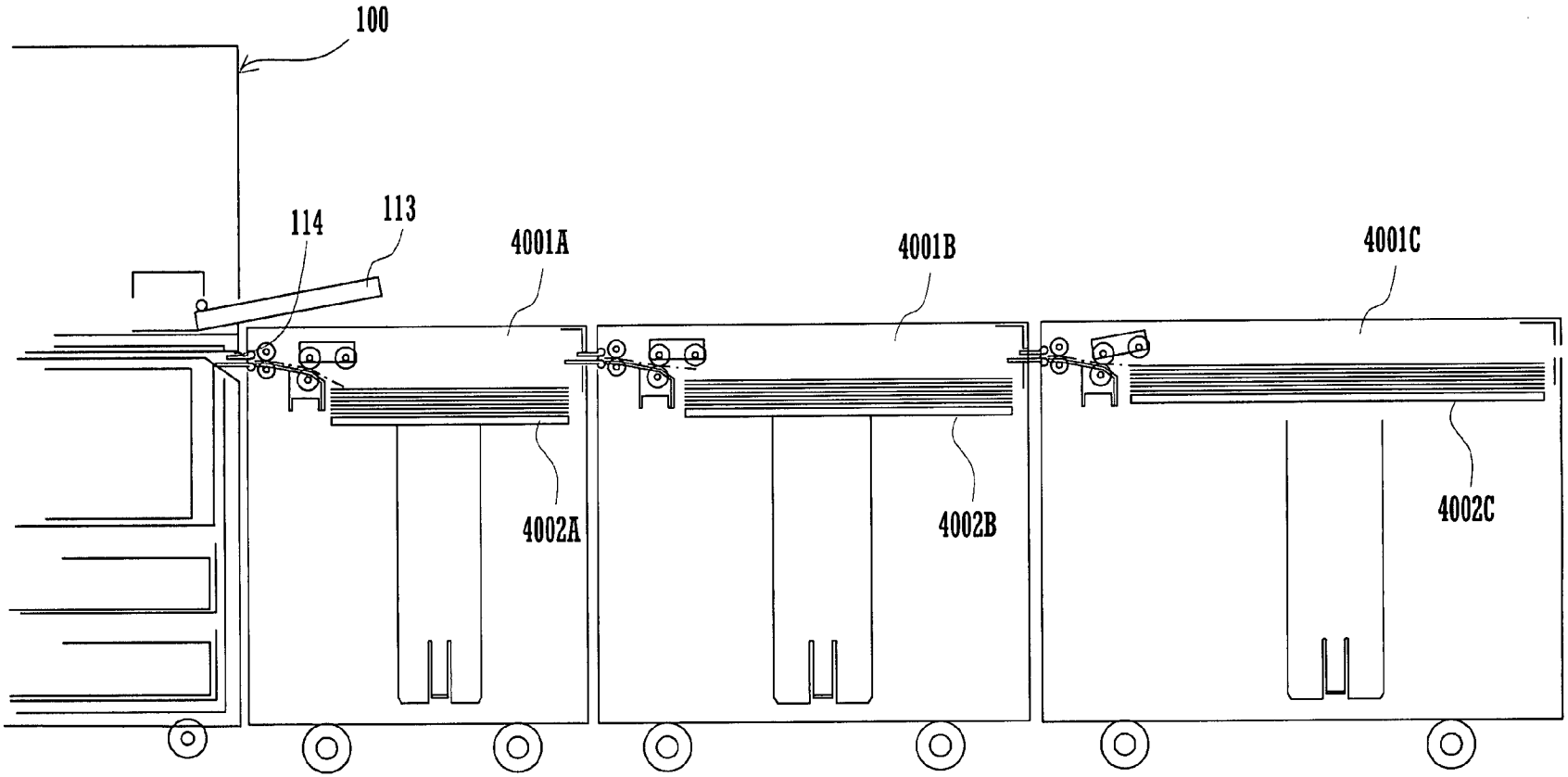
FIG. 28 is a view showing the arrangement of sheet feeder units in the paper feeder.

The sheet feeder units 4001A, 4001B and 4001C are arranged in the paper feeder 4001 as shown in FIG. 28. The sheet feeder unit 4001A holds recording sheets of A4 size in portrait orientation. The "portrait orientation", as used herein, is meant by an orientation in which the longitudinal dimension of each recording sheet extends in the direction perpendicular to the plane of the FIG. 28 drawing sheet. The sheet feeder unit 4001B holds recording sheets of B4 size in landscape orientation, while the sheet feeder unit 4001C holds recording sheets of A3 size in landscape orientation.

In the present embodiment the sequence of arrangement of the sheet feeder units 4001A, 4001B and 4001C is determined so that each recording sheet stored in a closer one of the sheet feeder units 4001A, 4001B and 4001C to the image forming apparatus 100 is smaller in the dimension parallel with the sheet feed direction than each recording sheet stored in a farther one of the sheet feeder units 4001A, 4001B and 4001C from the image forming apparatus 100. With this arrangement, the occurrence of a sheet feed failure is not likely during feeding of a recording sheet from any one of the sheet feeder units 4001A, 4001B and 4001C.

Now, consideration will be given to the case where an A3-size recording sheet is fed from the sheet feeder unit 4001C in the arrangement of the sheet feeder units 4001A, 4001B and 4001C shown in FIG. 28. The A3-size recording sheet fed from the sheet feeder unit 4001C is transported to the sheet feeder unit 4001B through the delivery section 4007C and receiving section 4010B. The A3-size recording sheet transported into the sheet feeder unit 4001B is fed downstream in the sheet feed direction along the upper surface of the topmost B4-size recording sheet stored in the sheet feeder unit 4001B.

Each of B4-size recording sheets stored in the sheet feeder unit 4001B is 365 mm long in the sheet feed direction, while the A3-size recording sheet being fed is 420 mm long in the sheet feed direction. Since the dimension of the A3-size recording sheet parallel with the sheet feed direction is larger than that of the B4-size recording sheet, the downstream edge of the A3-size recording sheet reaches the pickup roller 4003B while the upstream edge thereof is still gripped by the transport roller 4006C.

Subsequently, the A3-size recording sheet is further fed into the sheet feeder unit 4001A through the delivery section 4007B and the receiving section 4010A. Each A4-size recording sheet stored in the sheet feeder unit 4001A is 210 mm long in the sheet feed direction and, hence, the dimension of each A4-size recording sheet parallel with the sheet feed direction is smaller than that of the A3-size recording sheet parallel with the sheet feed direction. Accordingly, the downstream edge of the A3-size recording sheet reaches the pickup roller 4003A while the upstream edge thereof is still gripped by the transport roller 4006B.

Similar consideration will be given to the case where a B4-size recording sheet is fed from the sheet feeder unit 4001B. Initially, the B4-size recording sheet is transported into the sheet feeder unit 4001A through the delivery section 4007B and receiving section 4010A. The dimension of each A4-size recording sheet parallel with the sheet feed direction is 210 mm and hence is smaller than that of the B4-size recording sheet parallel with the sheet feed direction. Accordingly, the downstream edge of the B4-size recording sheet reaches the pickup roller 4003A while the upstream edge thereof is still gripped by the transport roller 4006B.

By thus arranging the sheet feeder units 4001A, 4001B and 4001C so that each recording sheet stored in a closer one of the sheet feeder units 4001A, 4001B and 4001C to the image forming apparatus 100 is smaller in the dimension parallel with the sheet feed direction than each recording sheet stored in a farther one of the sheet feeder units 4001A, 4001B and 4001C from the image forming apparatus 100, the dimension of each recording sheet parallel with the sheet feed direction can be effectively utilized during feeding to prevent the occurrence of a break in sheet feeding thereby preventing the recording sheet from being left untransported. Thus, the recording sheet can be smoothly transported to the image forming apparatus 100 regardless of the number of sheet feeder units through which the recording sheet passes.

Figure 29:
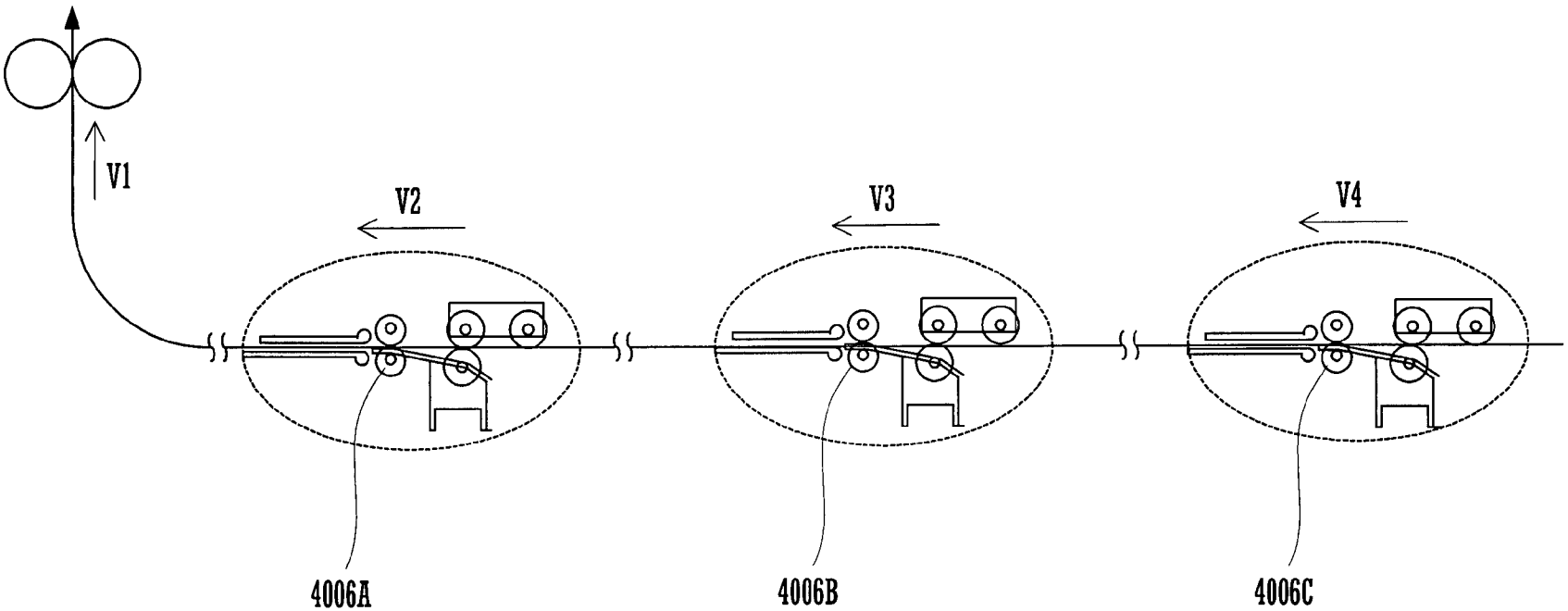
FIG. 29 is a view illustrating sheet feed velocities in the paper feeder.
Figure 30:
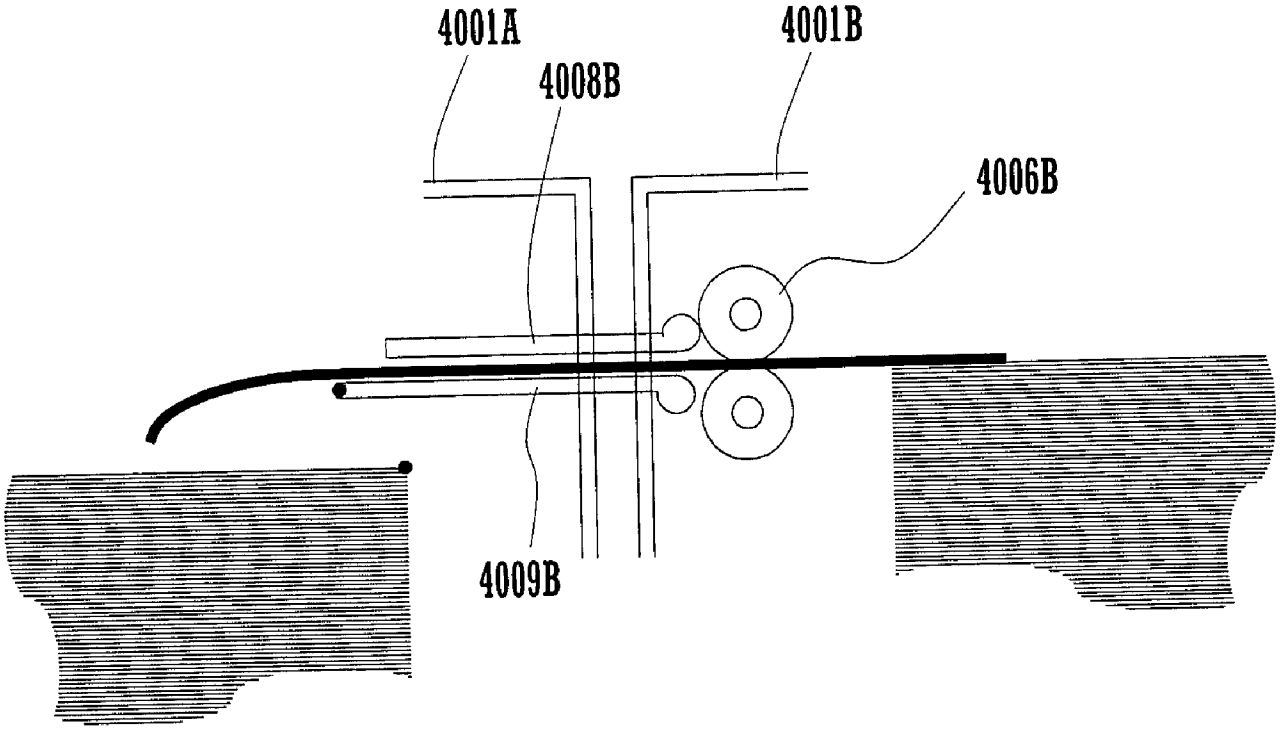
FIG. 30 is a view illustrating paper guides of the paper feeder.

Referring to FIG. 29, the circumferential velocity V1 of registration roller 111, sheet feed velocity V2 within the sheet feeder unit 4001A, sheet feed velocity V3 within the sheet feeder unit 4001B and sheet feed velocity V4 within the sheet feeder unit 4001C are established as follows.

The sheet feed velocity V2 is established so as to satisfy the requirements related to the number of recording sheets to be printed and to the spacing between adjacent recording sheets as well as to prevent the downstream edge of a recording sheet being fed from colliding with the upstream edge of the preceding recording sheet during registration by the registration roller 111. The sheet feed velocity V3 is established so as to satisfy the requirements related to the number of recording sheets to be printed and to the spacing between adjacent recording sheets as well as to prevent the downstream edge of a recording sheet being fed from colliding with the upstream edge of the preceding recording sheet within the sheet feeder unit 4001A. The sheet feed velocity V4 is established so as to satisfy the requirements related to the number of recording sheets to be printed and to the spacing between adjacent recording sheets as well as to prevent the downstream edge of a recording sheet being fed from colliding with the upstream edge of the preceding recording sheet within the sheet feeder unit 4001B.

Specifically, the velocities V1, V2, V3 and V4 are established to satisfy the relation: $V1<V2\leqq V3\leqq V4$. The velocities are thus established for the purpose of transporting each recording sheet to the registration roller 111 properly and preventing the printing speed of the image forming apparatus 100 from lowering.

The length of paper guide 4009B is established so that the paper guide 4009B extends to a location downstream from the upstream edge of the A4-size recording sheets stored in the sheet feeder unit 4001A. Likewise, the length of paper guide 4009C is established so that the paper guide 4009C extends to a location downstream from the upstream edge of the B4-size recording sheets stored in the sheet feeder unit 4001B. With this feature, each recording sheet can be fed smoothly regardless of the stiffness of the recording sheet. For example, even a recording sheet which is poor in stiffness can be fed downstream in the sheet feed direction without flexing sharply since the recording sheet is supported by the paper guides 4009B and 4009C from below.

Figure 31:
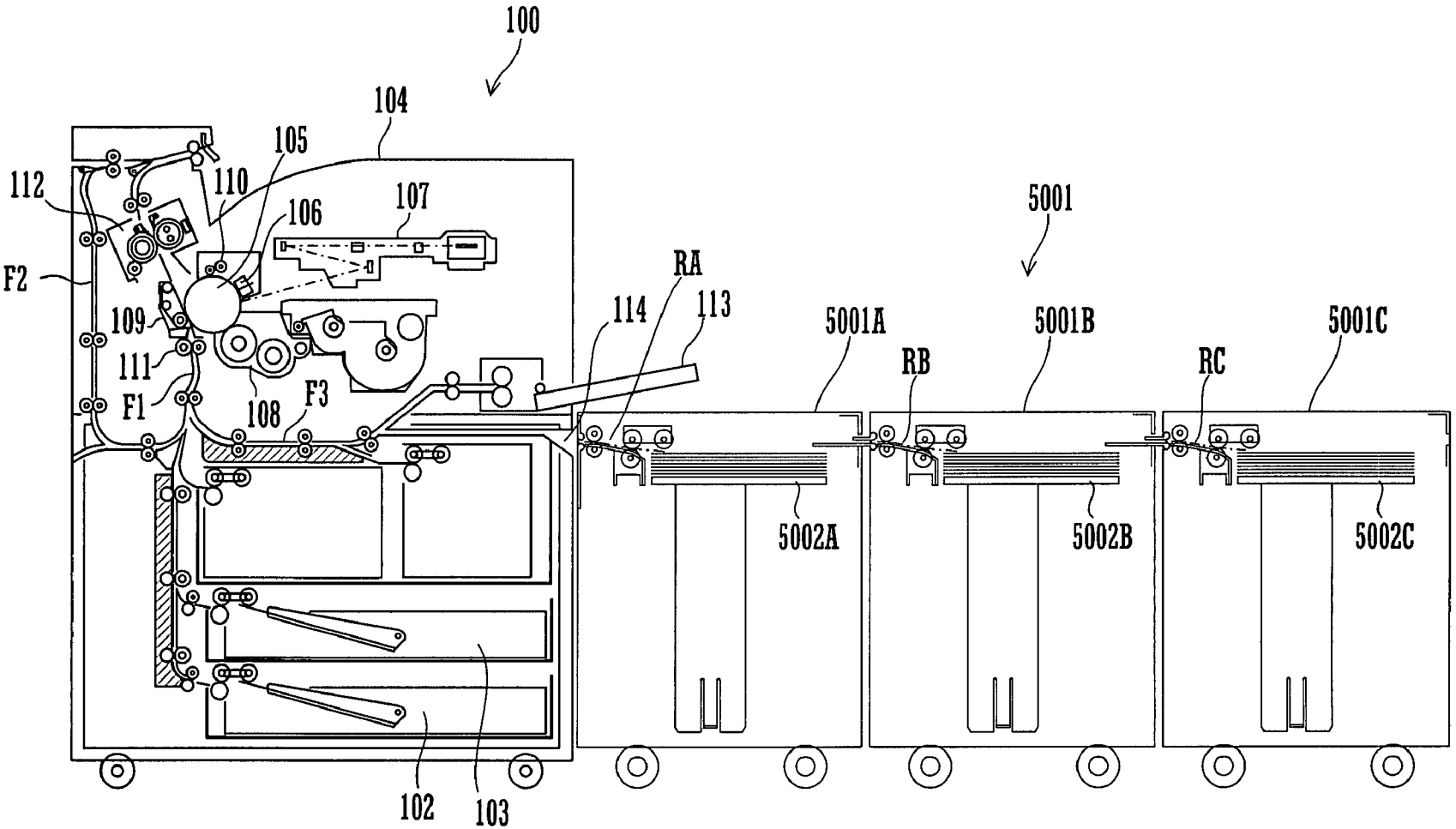
FIG. 31 is a view showing a paper feeder according to a sixth embodiment of the present invention as coupled to image forming apparatus.

FIG. 31 shows a paper feeder 5001 according to a sixth embodiment of the present invention disposed laterally of image forming apparatus 100 which is identical with that shown in FIG. 3. The main part of the image forming apparatus 100 and the main part of the paper feeder 5001 are similar in configuration to the corresponding parts of the image forming apparatus 100 and paper feeder 4001 shown in FIG. 25. Each of sheet feeder units 5001A, 5001B and 5001C of the paper feeder 5001 is similar in construction to the sheet feeder unit 4001B shown in FIG. 26.

Figure 32:
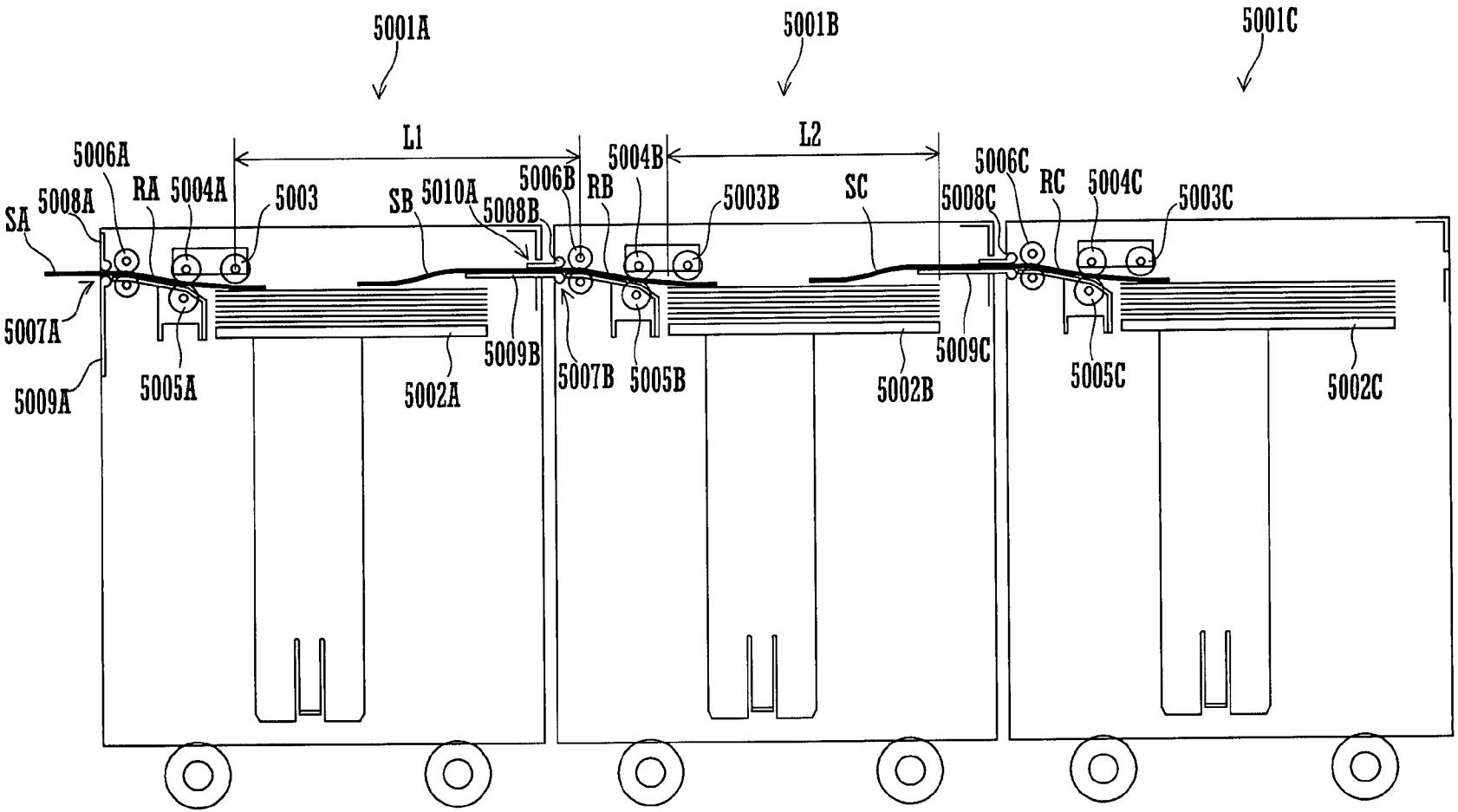
FIG. 32 is a view showing the construction of the paper feeder.

As shown in FIG. 32, the sheet feeder units 5001A, 5001B and 5001C are arranged in the paper feeder 5001 so that the receiving section 5010A of the sheet feeder unit 5001A and the receiving section 5010B of the sheet feeder unit 5001B face the delivery section 5007B of the sheet feeder unit 5001B and the delivery section 5007C of the sheet feeder unit 5001C, respectively.

In forming the paper feeder 5001 by coupling the sheet feeder units 5001A, 5001B and 5001C to each other, the pair of paper guides 5008A and 5009A of the sheet feeder unit 5001A is made to assume its collapsed position, while each of the pair of paper guides 5008B and 5009B and the pair of paper guides 5008C and 5009C made to assume its use position. Accordingly, the pair of paper guides 5008B and 5009B is inserted into the receiving section 5010A of the sheet feeder unit 5001A. Similarly, the pair of paper guides 5008C and 5009C is inserted into the receiving section 5010B of the sheet feeder unit 5001B.

The paper guide 5009C for guiding the underside of each recording sheet is sized so as to be capable of guiding the recording sheet onto the upper surface of the topmost recording sheet of a stack of recording sheets carried on the sheet carrier plate 5002B of the sheet feeder unit 5001B. Similarly, the paper guide 5009B for guiding the underside of each recording sheet is sized so as to be capable of guiding the recording sheet onto the upper surface of the topmost recording sheet of a stack of recording sheets carried on the sheet carrier plate 5002A of the sheet feeder unit 5001A. When the paper guides 5008B and 5009B of the sheet feeder unit 5001B are inserted into the receiving section 5010A of the sheet feeder unit 5001A, the feed path RB of the upstream sheet feeder unit 5001B and the feed path RA of the downstream sheet feeder unit 5001A become continuous with each other for communication. In the present embodiment, the receiving section 5010A, feed path RB and paper guides 5008B and 5009B constitute an intermediate sheet feed path according to the present invention. Similarly, the receiving section 5010B, feed path RC and paper guides 5008C and 5009C constitute an intermediate sheet feed path according to the present invention.

In the state where the sheet feeder units 5001A and 5001B are arranged side by side, distance L1 between the pickup roller 5003A of the sheet feeder unit 5001A and the transport roller 5006B of the upstream sheet feeder unit 5001B is set shorter than dimension L2 of each recording sheet parallel with the sheet feed direction, as in the paper feeder 3001 shown in FIG. 20.

Each recording sheet fed from the upstream sheet feeder unit 5001B and then received into the receiving section 5010A of the sheet feeder unit 5001A is guided onto the upper surface of topmost recording sheet SA of the stack of recording sheets carried on the sheet carrier plate 5002A. That is, the upper surface of topmost recording sheet SA on the sheet carrier plate 5002A forms part of the feed path interconnecting the image forming apparatus 100 and the sheet feeder units 5001A, 5001B and 5001C.

Each recording sheet being fed along the upper surface of topmost recording sheet SA of the sheet stack carried on the sheet carrier plate 5002A of the sheet feeder unit 5001A by the driving force of the transport roller 5006B of the sheet feeder unit 5001B is gripped at its downstream edge portion and picked up by the pickup roller 5003A of the sheet feeder unit 5001A configured to descend with predetermined timing while being gripped by the transport roller 5006B of the sheet feeder unit 5001B. Then, the recording sheet is further fed downstream by the transport roller 5006A of the sheet feeder unit 5001A.

As described above, in the paper feeder 5001 according to the present invention, each recording sheet stored in the sheet feeder unit 5001B is fed to the image forming apparatus 100 through the feed paths RB and RA of respective of the sheet feeder units 5001B and 5001A sequentially. That is, the feed path RA of the downstream sheet feeder unit 5001A is used to feed recording sheets stored in the sheet feeder unit 5001A as well as recording sheets stored in the sheet feeder units 5001B and 5001C.

The sheet feeder unit 5001A is disposed adjacent to the image forming apparatus 100 so that the delivery section 5007A thereof faces the sheet receiving section 114 of the image forming apparatus 100. Each recording sheet stored in the sheet feeder unit 5001A, 5001B or 5001C is fed to the sheet transport path F3 through the sheet receiving section 114 of the image forming apparatus 100 and then transported to the transfer position. Each recording sheet stored in the sheet feeder unit 5001C for example is passed through the feed path RC of the sheet feeder unit 5001C, feed path RB of the sheet feeder unit 5001B and feed path RA of the sheet feeder unit 5001A sequentially, received into the image forming apparatus 100 through the sheet receiving section 114, and then transported to the transfer position.

Since the sheet feeder units 5001A, 5001B and 5001C of the paper feeder 5001 can be horizontally arranged in a row laterally of the image forming apparatus 100, the feed paths RA, RB and RC form a substantially straight line. Therefore, the paper feeder 5001 can feed each recording sheet through the feed paths RA, RB and RC with less possibility of curving, thereby inhibiting the occurrence of jam during feeding. Further, it is less likely that each recording sheet is imparted with undesirable stiffness due to curving during feeding, since the possibility that the recording sheet is curved during feeding is very low. Thus, the occurrence of an image formation failure in the image forming apparatus 100 is not likely.

Further, in the paper feeder 5001, the upper surface of each of topmost recording sheets SA, SB and SC on respective sheet carrier plates 5002A, 5002B and 5002C forms part of the feed paths RA, RB and RC. This feature makes it possible to eliminate the need to provide a feed path separately and hence allows the paper feeder 5001 to be downsized.

Each of the sheet members to be stored in the paper feeder 5001 and fed therefrom to the processing apparatus is not limited to a recording sheet but may be an OHP film or the like. Also, the processing apparatus to be fed with such sheet members by the paper feeder 5001 is not limited to an image forming apparatus. The paper feeder 5001 can be used with any processing apparatus which performs processing on such sheet members.

Figure 33:
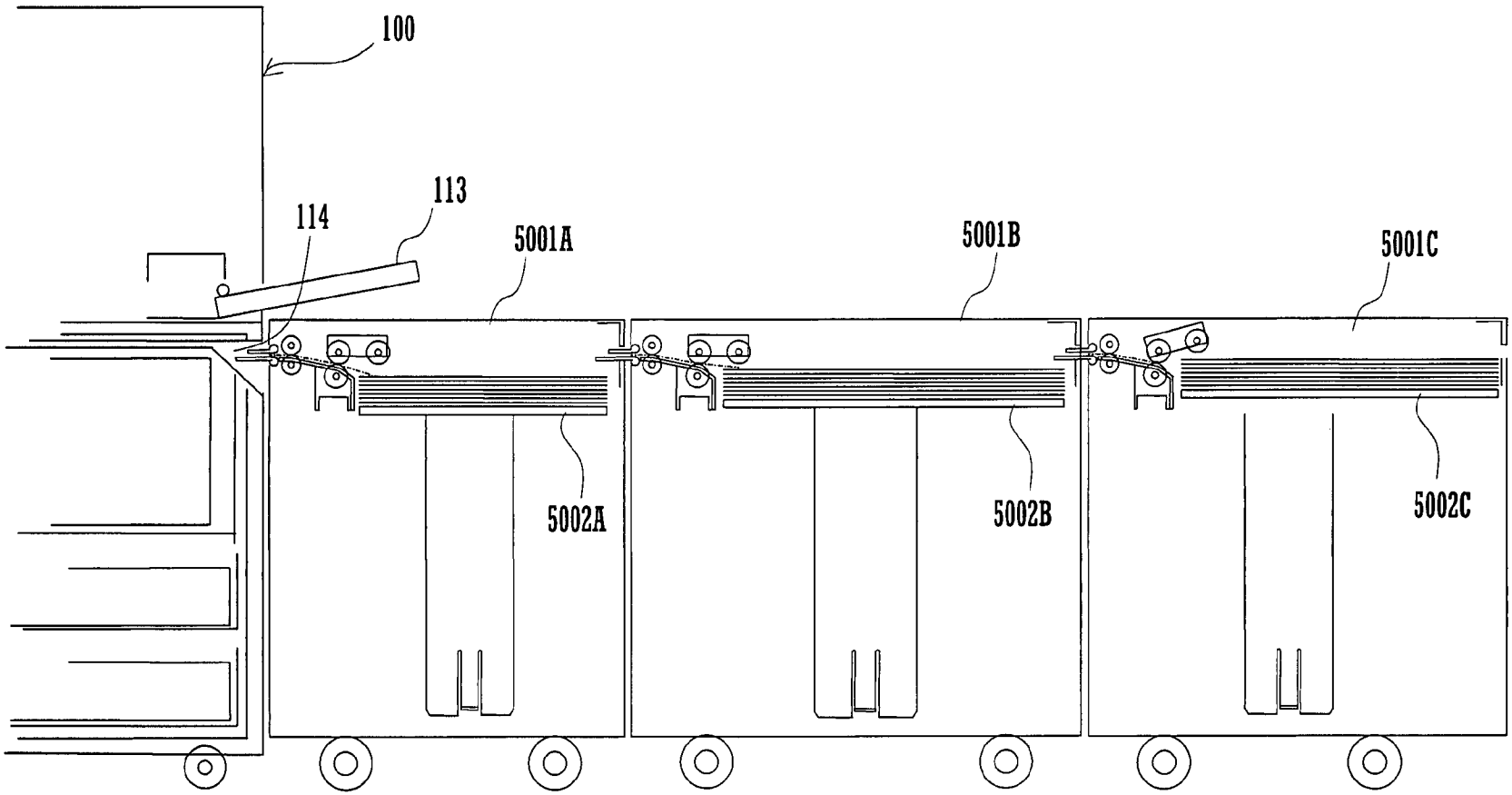
FIG. 33 is a view showing the arrangement of sheet feeder units in the paper feeder.
Figure 34:
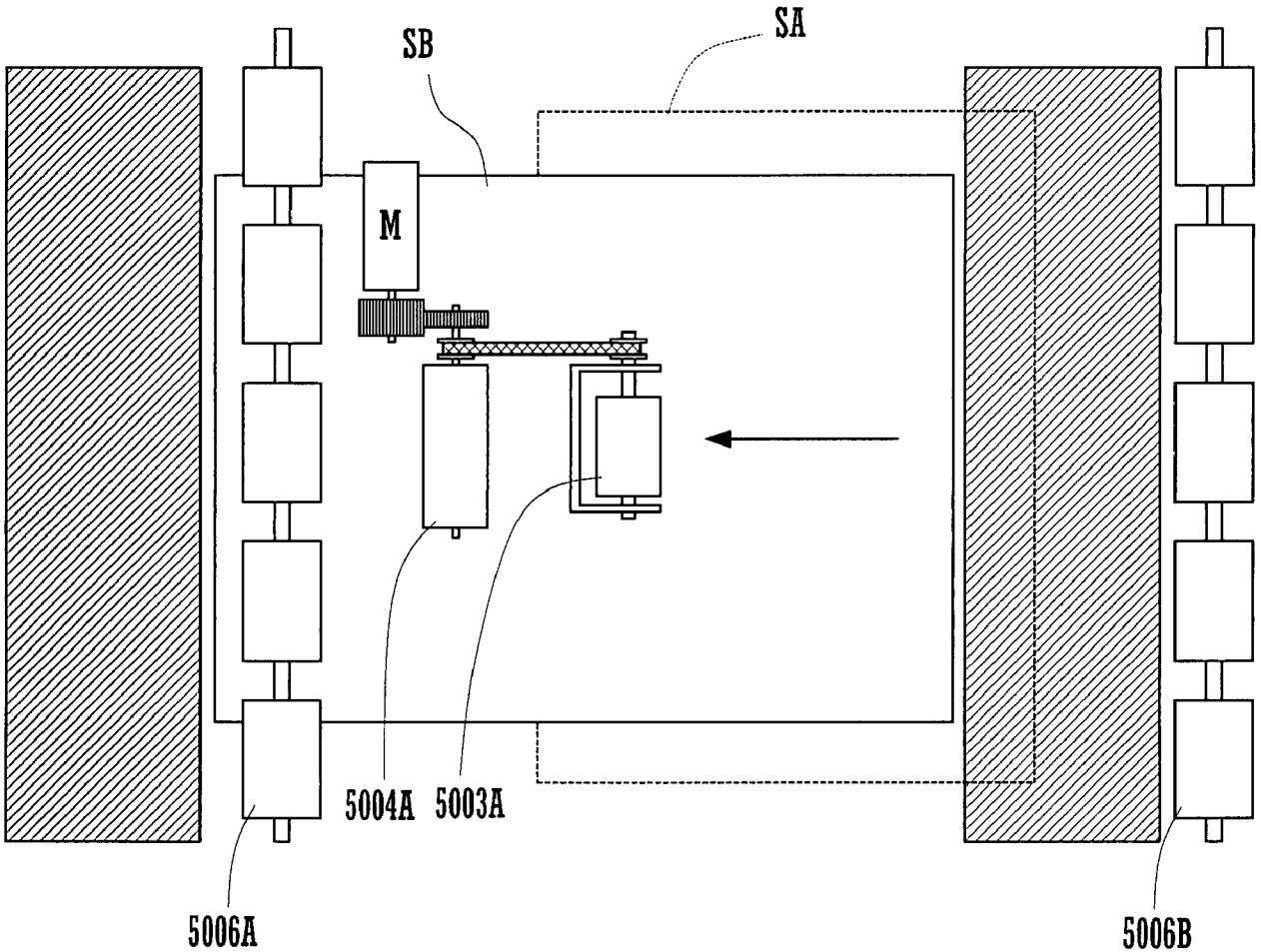
FIG. 34 is a view illustrating a sheet feed condition of the paper feeder.

FIG. 33 shows the sequence of arrangement of the sheet feeder units 5001A, 5001B and 5001C in the paper feeder 4001. The sheet feeder unit 5001A holds recording sheets of A4 size in portrait orientation. The "portrait orientation", as used herein, is meant by an orientation in which the longitudinal dimension of each recording sheet extends in the direction perpendicular to the plane of the FIG. 28 drawing sheet. The sheet feeder unit 5001B holds recording sheets of B4 size in landscape orientation, while the sheet feeder unit 5001C holds recording sheets of A4 size in landscape orientation.

In the present embodiment the sequence of arrangement of the sheet feeder units 5001A, 5001B and 5001C is determined so that each recording sheet stored in a closer one of the sheet feeder units 5001A, 5001B and 5001C to the image forming apparatus 100 is smaller in the widthwise dimension than each recording sheet stored in a farther one of the sheet feeder units 5001A, 5001B and 5001C from the image forming apparatus 100. With this arrangement, the occurrence of a sheet feed failure is not likely during feeding of a recording sheet from any one of the sheet feeder units 5001A, 5001B and 5001C.

Now, consideration will be given to the case where a B4-size recording sheet is fed from the sheet feeder unit 5001B in the arrangement of the sheet feeder units 5001A, 5001B and 5001C shown in FIG. 33. The B4-size recording sheet fed from the sheet feeder unit 5001B is transported to the sheet feeder unit 5001A through the delivery section 5007B and receiving section 5010A. The B4-size recording sheet transported into the sheet feeder unit 5001A is fed to the image forming apparatus 100 along the upper surface of the topmost A4-size recording sheet stored in the sheet feeder unit 5001A.

The widthwise dimension of each A4-size recording sheet stored in the sheet feeder unit 5001A is 297 mm, while the widthwise dimension of B4-size recording sheet being fed is 254 mm. Since the widthwise dimension of the A4-size recording sheet is larger than that of the B4-size recording sheet, the entire width of the B4-size recording sheet passing through the sheet feeder unit 5001A is supported by the A4-size recording sheet from below. For this reason, the B4-size recording sheet passing through the sheet feeder unit 5001A is not likely to curve in the widthwise direction of the B4-size recording sheet, whereby the B4-size recording sheet is kept flat during feeding.

Also, since the widthwise dimension of each A4-size recording sheet held in landscape orientation in the sheet feeder unit 5001C is 210 mm, the A4-size recording sheet fed as held in landscape orientation from the sheet feeder unit 5001C which is farthest from the image forming apparatus 100 can be kept flat during feeding.

Figure 35:
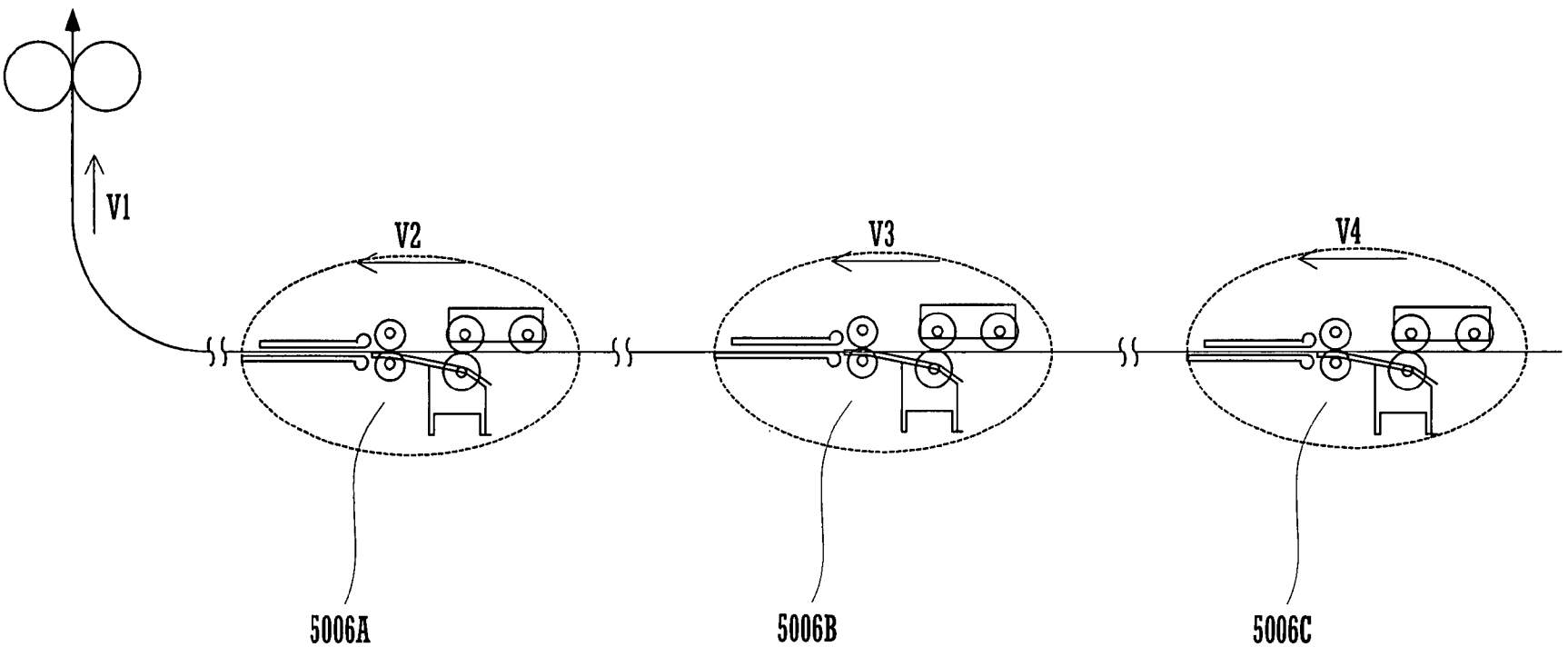
FIG. 35 is a view illustrating sheet feed velocities in the paper feeder.
Figure 36:
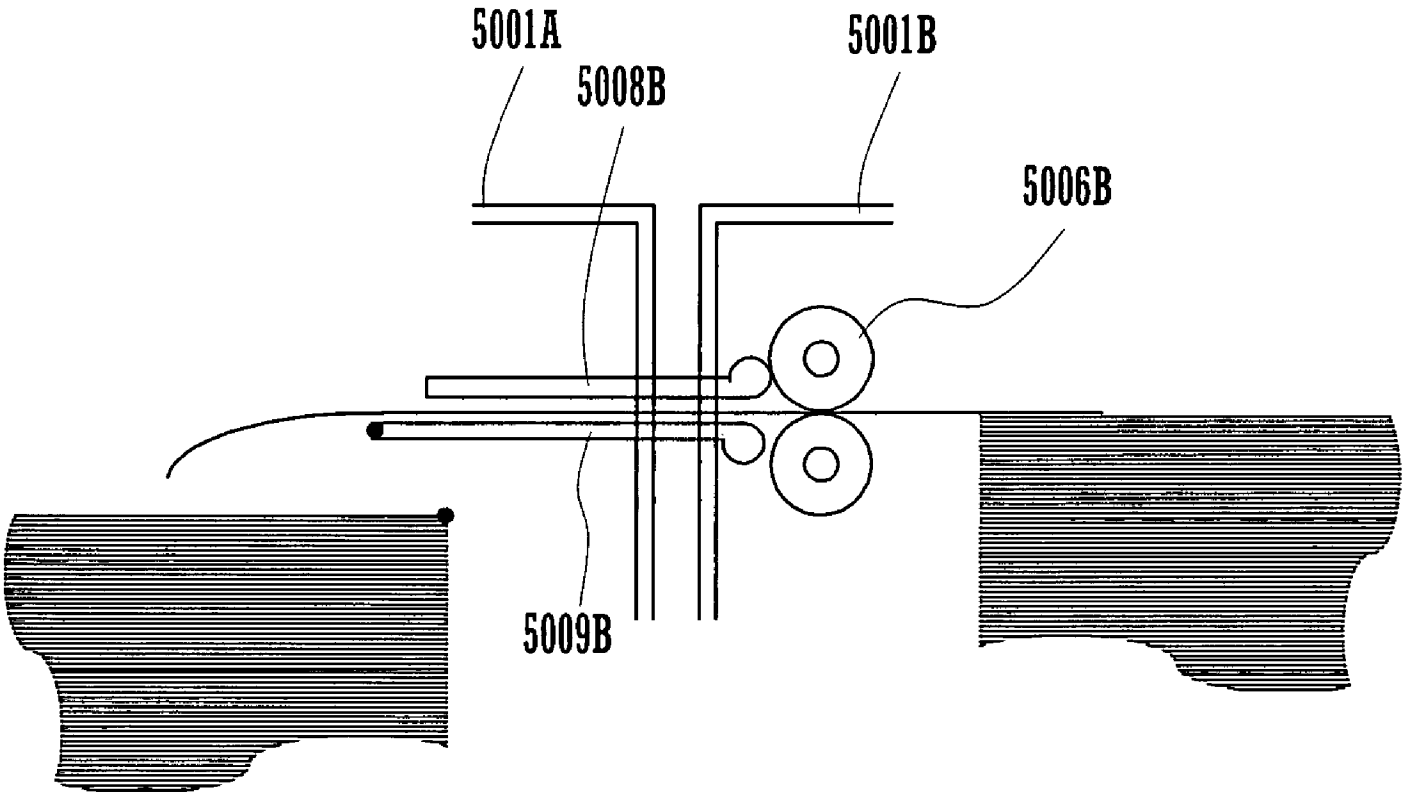
FIG. 36 is a view illustrating paper guides of the paper feeder.

Referring to FIG. 35, the circumferential velocity V1 of registration roller 111, sheet feed velocity V2 within the sheet feeder unit 5001A, sheet feed velocity V3 within the sheet feeder unit 5001B and sheet feed velocity V4 within the sheet feeder unit 5001C are established as follows.

The sheet feed velocity V2 is established so as to satisfy the requirements related to the number of recording sheets to be printed and to the spacing between adjacent recording sheets as well as to prevent the downstream edge of a recording sheet being fed from colliding with the upstream edge of the preceding recording sheet during registration by the registration roller 111. The sheet feed velocity V3 is established so as to satisfy the requirements related to the number of recording sheets to be printed and to the spacing between adjacent recording sheets as well as to prevent the downstream edge of a recording sheet being fed from colliding with the upstream edge of the preceding recording sheet within the sheet feeder unit 5001A. The sheet feed velocity V4 is established so as to satisfy the requirements related to the number of recording sheets to be printed and to the spacing between adjacent recording sheets as well as to prevent the downstream edge of a recording sheet being fed from colliding with the upstream edge of the preceding recording sheet within the sheet feeder unit 5001B.

Specifically, the velocities V1, V2, V3 and V4 are established to satisfy the relation: $V1<V2\leqq V3\leqq V4$. The velocities are thus established for the purpose of transporting each recording sheet to the registration roller 111 properly and preventing the printing speed of the image forming apparatus 100 from lowering.

The length of paper guide 5009B is established so that the paper guide 5009B extends to a location downstream from the upstream edge of the A4-size recording sheets stored in the sheet feeder unit 5001A. Likewise, the length of paper guide 5009C is established so that the paper guide 5009C extends to a location downstream from the upstream edge of the B4-size recording sheets stored in the sheet feeder unit 5001B. With this feature, each recording sheet can be fed smoothly regardless of the stiffness of the recording sheet. For example, even a recording sheet which is poor in stiffness can be fed downstream in the sheet feed direction without flexing sharply since the recording sheet is supported by the paper guides 5009B and 5009C from below.

The foregoing embodiments are illustrative in all points and should not be construed to limit the present invention. The scope of the present invention is defined not by the foregoing embodiment but by the following claims. Further, the scope of the present invention is intended to include all modifications within the meanings and scopes of claims and equivalents.

What is claimed is:

1. A paper feeder comprising:

a storage section configured to store therein plural sheet members to be fed to a processing apparatus which is operative to perform processing on the sheet members;

a feed path allowing each of the plural sheet members fed from the storage section to pass therethrough in a feed direction toward the processing apparatus;

a delivery section located most downstream on the feed path in the feed direction, wherein the feed path is open to exterior; and a receiving section located upstream of the feed path in the feed direction for communication with a delivery section of a first separate paper feeder having an identical construction with the present paper feeder when the first separate paper feeder is disposed upstream of the present paper feeder in the feed direction, said receiving section feeding a sheet member delivered from a delivery section of a first separate paper feeder to contact with the top of the sheet members in the storage section, wherein the feed path is passing on an upper surface of topmost one of the plural sheet members stored in the storage section, and wherein the delivery section has a guide member configured to guide each of the plural sheet members onto an upper surface of topmost one of plural sheet members stored in a storage section of a second separate paper feeder having an identical construction with the present paper feeder when the second separate paper feeder is disposed downstream of the present paper feeder in the sheet feed direction.

2. The paper feeder according to claim 1, further comprising:

a pickup member configured to pay out topmost one of the sheet members stored in the storage section downstream in the sheet feed direction; and a transport member disposed downstream of the pickup member in the sheet feed direction and configured to transport the sheet member paid out by the pickup member in the sheet feed direction.

3. The paper feeder according to claim 2, wherein the pickup member and the transport member are positioned such that when the second separate paper feeder is disposed downstream of the present paper feeder in the sheet feed direction, a downstream edge of the sheet member being fed reaches a location where a pickup member of the second separate paper feeder is disposed before an upstream edge of the sheet member passes a location where the transport member is disposed.

4. The paper feeder according to claim 3, wherein the guide member is curved in a plane perpendicular to the sheet feed direction to such an extent that when the downstream edge of the sheet member having passed through the guide member contacts the pickup member of the second separate paper feeder, at least a portion of the downstream edge contacting the pickup member becomes flat in a plane perpendicular to the sheet feed direction.

5. The paper feeder according to claim 1, wherein the guide member has ends, at least a downstream end of which is positioned downstream from an upstream end of the topmost one of the plural sheet members stored in the storage section of the second separate paper feeder.

6. The paper feeder according to claim 1, wherein the guide member is curved in a plane perpendicular to the sheet feed direction at least in a portion thereof which lies downstream in the sheet feed direction.

7. The paper feeder according to claim 6, wherein the guide member has a portion which lies downstream in the sheet feed direction and which downwardly protrudes centrally thereof in the plane perpendicular to the sheet feed direction.

8. The paper feeder according to claim 6, wherein the curvature of the guide member becomes sharper as the guide member extends downstream in the sheet feed direction.

9. The paper feeder according to claim 8, wherein the guide member has a portion which lies upstream in the sheet feed direction and which is flat in a plane perpendicular to the sheet feed direction.

10. The paper feeder according to claim 6, wherein the guide member has an end which lies downstream in the sheet feed direction and which is positioned above the upper surface of the topmost one of the plural sheet members stored in the storage section of the second separate paper feeder.

11. The paper feeder according to claim 1, wherein the storage section has a liftable sheet carrier plate on an upper surface of which stores a stack of sheet members, the paper feeder further comprising:

a lifting mechanism configured to lift up and down the sheet carrier plate; and a control section configured to operate the lifting mechanism to change a height position of an upper surface of a topmost one of the sheet members in such a manner that the height position taken when the receiving section receives a sheet member is different from that taken when the delivery section delivers the sheet member.

12. The paper feeder according to claim 11, wherein the lifting mechanism is operative to set the height position of the upper surface of the topmost one of the sheet members to a lower limit of a predetermined pickup range when the receiving section receives the sheet member and to an upper limit of the predetermined pickup range when the delivery section delivers the sheet member.

13. The paper feeder according to claim 1, further comprising a lifting mechanism configured to lift up and down the sheet members stored in the storage section to change a height position of an upper surface of topmost one of the sheet members, the sheet members including a sheet member having reached the pickup member from the first separate paper feeder through the receiving section, wherein the lifting mechanism is operative to change the height position of the upper surface of the topmost one of the sheet members in a manner that the height position taken when the receiving section receives the sheet member is different from that taken when the delivery section delivers the sheet member.

14. The paper feeder according to claim 1, wherein:

the storage section comprises a sheet carrier plate configured to carry a stack of sheet members on an upper surface thereof;

the pickup member is vertically movable within a predetermined range and is configured to pay out topmost one of the sheet members carried on the sheet carrier plate downstream in the sheet feed direction when the topmost one of the sheet members takes a height position within a predetermined pickup range;

the paper feeder further comprises a lifting mechanism configured to lift the sheet carrier plate up and down to change a height position of an upper surface of the topmost one of the sheet members carried on the sheet carrier plate; and the lifting mechanism is operative to position the upper surface of the topmost one of the sheet members or the upper surface of the sheet carrier plate carrying no sheet member thereon into a height position falling within the predetermined pickup range upon receipt of a sheet member through the receiving section when the first separate paper feeder is disposed upstream of the present paper feeder in the sheet feed direction.

15. The paper feeder according to claim 14, wherein the lifting mechanism is operative to keep a height position of the upper surface of the sheet carrier plate carrying no sheet member thereon at a predetermined replenishment position for replenishment of sheet members during a period for which feeding of a sheet member to the processing apparatus does not proceed.

16. The paper feeder according to claim 14, wherein the lifting mechanism is operative to position the upper surface of the topmost one of the sheet members or the upper surface of the sheet carrier plate carrying no sheet member thereon into a height position falling within the predetermined pickup range during a period for which replenishment of sheet members does not proceed.

17. The paper feeder according to claim 14, further comprising sheet detection means operative to detect the presence or absence of any sheet member on the sheet carrier plate, and display means operative to display a sign indicative of the absence of any sheet member on the sheet carrier plate upon detection of the absence of any sheet member on the sheet carrier plate by the detection means.

18. A paper feeder comprising plural paper feeder units each configured to feed sheet members stored in a storage section thereof in a predetermined feed direction, the sheet feeder units being arranged in a row extending in the feed direction, wherein:

the storage section of each of the paper feeder units stores therein the sheet members such that a height position of a topmost surface of the sheet members stored in an upstream one of the paper feeder units which is located upstream in the sheet feed direction is higher than a height position of a topmost surface of the sheet members stored in a downstream one of the paper feeder units which is located downstream of the upstream one of the paper feeder units in the sheet feed direction; and each of the sheet members stored in the upstream one of the paper feeder units is fed to the topmost surface of the sheet members stored in the downstream one of the paper feeder units;

wherein:

each of the plural paper feeder units has a delivery section which is open to exterior on a downstream side in the sheet feed direction; and each of the plural paper feeder units except one located most upstream in the feed direction has a receiving section which is open to exterior on an upstream side in the feed direction for communication with a delivery section of an adjacent one of the other paper feeder units which is located immediately upstream in the feed direction;

wherein the receiving section is in a same height position as the delivery section of the adjacent one of the other paper feeder units which is located immediately upstream in the sheet feed direction; and wherein each of the plural paper feeder units has the receiving section positioned higher than the delivery section thereof.

* * * * *